US010392213B2

(12) United States Patent
Matsuda et al.

(10) Patent No.: US 10,392,213 B2
(45) Date of Patent: Aug. 27, 2019

(54) SHEET CONVEYING DEVICE AND IMAGE FORMING APPARATUS INCORPORATING THE SHEET CONVEYING DEVICE

(71) Applicants: Hiromichi Matsuda, Kanagawa (JP); Katsuaki Miyawaki, Kanagawa (JP); Tetsuo Watanabe, Kanagawa (JP); Jun Yamane, Kanagawa (JP); Hideyuki Takayama, Kanagawa (JP)

(72) Inventors: Hiromichi Matsuda, Kanagawa (JP); Katsuaki Miyawaki, Kanagawa (JP); Tetsuo Watanabe, Kanagawa (JP); Jun Yamane, Kanagawa (JP); Hideyuki Takayama, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/832,872

(22) Filed: Dec. 6, 2017

(65) Prior Publication Data

US 2018/0162667 A1 Jun. 14, 2018

(30) Foreign Application Priority Data

Dec. 8, 2016 (JP) ..... 2016-238740
Nov. 27, 2017 (JP) ..... 2017-226818

(51) Int. Cl.
*B65H 9/00* (2006.01)
*B65H 9/20* (2006.01)
(Continued)

(52) U.S. Cl.
CPC ..... *B65H 9/002* (2013.01); *B65H 5/06* (2013.01); *B65H 7/14* (2013.01); *B65H 9/20* (2013.01);
(Continued)

(58) Field of Classification Search
CPC . B65H 9/002; B65H 9/00; B65H 9/20; B65H 2404/1424; B65H 2404/14212;
(Continued)

(56) References Cited

U.S. PATENT DOCUMENTS 7,300,054 B2 * 11/2007 Suga ..... B65H 5/062 271/228
8,186,664 B2 * 5/2012 Yahata ..... B65H 9/10 270/58.07
(Continued)

FOREIGN PATENT DOCUMENTS

JP 6-234441 8/1994
JP 9-175694 7/1997
(Continued)

*Primary Examiner* — Luis A Gonzalez
(74) *Attorney, Agent, or Firm* — Harness, Dickey & Pierce, P.L.C.

(57) ABSTRACT

A sheet conveying device, which is included in an image forming apparatus, includes a sheet holding roller to move while holding a sheet, a detector to perform a primary detection to detect a sheet position before the sheet holding roller holds the sheet and a secondary detection to detect a sheet position downstream from the sheet position detected by the primary detection, and a controller configured to cause the sheet holding roller to perform a first drive to move the sheet holding roller in at least one direction of a width direction of the sheet and a rotation direction in a sheet conveying surface based on a result of the primary detection and a second drive to move the sheet holding roller opposite to the at least one direction of the first drive, based on a result of the secondary detection.

16 Claims, 41 Drawing Sheets

(51) Int. Cl.
*B65H 7/14* (2006.01)
*B65H 5/06* (2006.01)
*G03G 15/00* (2006.01)

(52) U.S. Cl.
CPC ... *G03G 15/6561* (2013.01); *B65H 2301/331* (2013.01); *B65H 2404/1424* (2013.01); *B65H 2404/14212* (2013.01); *B65H 2404/15212* (2013.01); *B65H 2601/272* (2013.01); *B65H 2801/03* (2013.01); *G03G 15/6511* (2013.01)

(58) Field of Classification Search
CPC .. B65H 2404/15212; B65H 2404/1523; B65H 2301/331; B65H 2553/416; G03G 15/6561; G03G 15/6567
See application file for complete search history.

(56) References Cited

U.S. PATENT DOCUMENTS

2014/0193186 A1* 7/2014 Furuyama ..... G03G 15/657 399/388
2016/0159598 A1* 6/2016 Yamane ..... B65H 9/002 271/227
2016/0272448 A1* 9/2016 Nakai ..... B65H 7/10

FOREIGN PATENT DOCUMENTS

| | | |
|---|---|---|
| JP | 10-067448 | 3/1998 |
| JP | 10-120253 | 5/1998 |
| JP | 2005-041603 | 2/2005 |
| JP | 2005-041604 | 2/2005 |
| JP | 2005-053646 | 3/2005 |
| JP | 2005-178929 | 7/2005 |
| JP | 2006-027859 | 2/2006 |
| JP | 2007-022806 | 2/2007 |
| JP | 2011-098790 | 5/2011 |
| JP | 2014-088263 | 5/2014 |
| JP | 2014-193769 | 10/2014 |
| JP | 2016-024546 | 2/2016 |
| JP | 2016-044067 | 4/2016 |
| JP | 2016-175776 | 10/2016 |
| JP | 2016-188142 | 11/2016 |
| JP | 2017-202916 | 11/2017 |

* cited by examiner

SHEET CONVEYING DEVICE AND IMAGE FORMING APPARATUS INCORPORATING THE SHEET CONVEYING DEVICE

CROSS-REFERENCE TO RELATED APPLICATIONS

This patent application is based on and claims priority pursuant to 35 U.S.C. § 119(a) to Japanese Patent Application Nos. 2016-238740, filed on Dec. 8, 2016, and 2017-226818, filed on Nov. 27, 2017, in the Japan Patent Office, the entire disclosure of each of which is hereby incorporated by reference herein.

BACKGROUND

Technical Field

This disclosure relates to a sheet conveying device to perform at least one of a correction of angular displacement and a correction of lateral displacement, with respect to a sheet conveyed along a sheet conveyance passage, and an image forming apparatus that includes the above-described sheet conveying device, such as a copier, printer, facsimile machine, printer, printing machine, and a multi-functional apparatus including at least two functions of the copier, facsimile machine, printer, and printing machine.

Related Art

Various types of known image forming apparatuses such as copiers and printers include a pair of sheet holding rollers disposed in a sheet conveyance passage. Such known image forming apparatuses cause the pair of sheet holding rollers to move in a radial direction and a width direction, relative to the sheet conveyance passage, so that the pair of sheet holding rollers corrects an angular displacement of the sheet and a lateral displacement in a width direction of the sheet (in other words, a positional deviation in the width direction of the sheet).

In the known image forming apparatuses, an angular displacement sensor and a lateral displacement sensor, both of which are disposed upstream from the pair of sheet holding rollers. With this configuration, a deviation angle of the sheet and a lateral displacement amount of the sheet are detected. However, there is a case in which the deviation angle and the lateral displacement amount further change before the sheet reaches the pair of sheet holding rollers. In addition, when the pair of sheet holding rollers holds and conveys the sheet, the deviation angle and the lateral displacement amount may further change due to fluttering of the sheet and error in precision of dimension of the pair of sheet holding rollers.

Respective expected precisions in correction of the deviation angle and the lateral displacement amount are high. Generally, a precision value of the deviation angle is 0.1 mrad level and a precision value of the lateral displacement amount is some ten μm level.

Further, the registering accuracy of image positions on both sides of an electrophotographic image forming apparatus is expected to be equal to the registering accuracy of image positions on both sides of an offset printing machine in the recent trend. Consequently, the expected correction precision becomes higher.

SUMMARY

At least one aspect of this disclosure provides a sheet conveying device including a sheet holding roller, a detector, and a controller. The sheet holding roller is configured to move and rotate while holding a sheet that passes through a sheet conveyance passage in a sheet conveying direction. The detector is configured to perform a primary detection to detect a position of the sheet before the sheet holding roller holds the sheet and a secondary detection to detect a position of the sheet at a downstream side of the sheet conveying direction, from the position of the sheet detected by the primary detection. The controller is configured to cause the sheet holding roller to perform a first drive in which the sheet holding roller moves in at least one direction of a width direction of the sheet and a rotation direction in a sheet conveying surface based on a result of the primary detection and a second drive in which the sheet holding roller moves in an opposite direction to the at least one direction of the first drive, based on a result of the secondary detection.

Further, at least one aspect of this disclosure provides an image forming apparatus including the above-described sheet conveying device.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
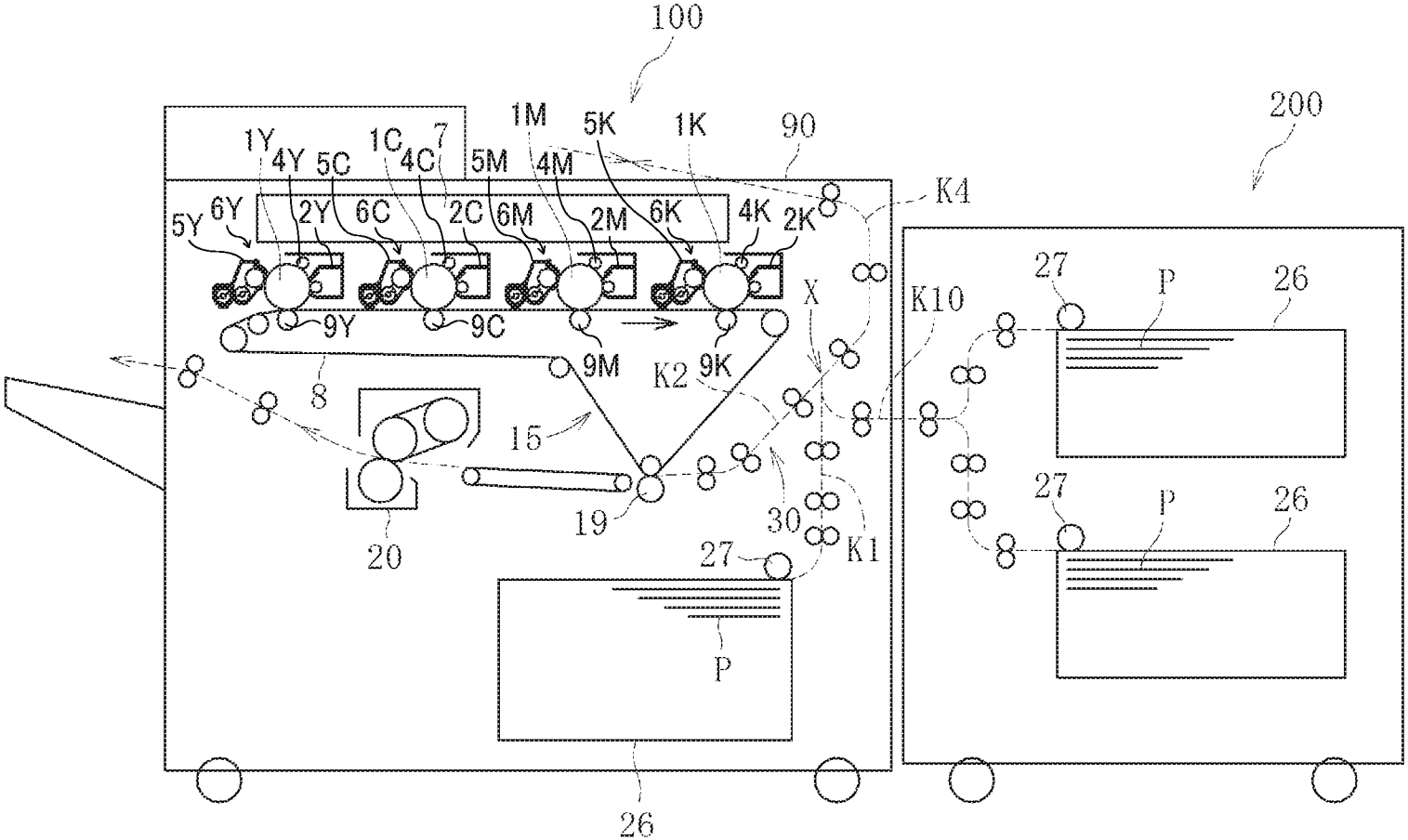
FIG. 1 is a diagram illustrating an entire configuration of an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

A description is given of a sheet conveying device and an image forming apparatus incorporating the sheet conveying device, according to an embodiment of this disclosure, with reference to the drawings attached.

It is to be noted that elements (for example, mechanical parts and components) having the same functions and shapes are denoted by the same reference numerals throughout the specification and redundant descriptions are omitted.

Image Forming Apparatus

Figure 2:
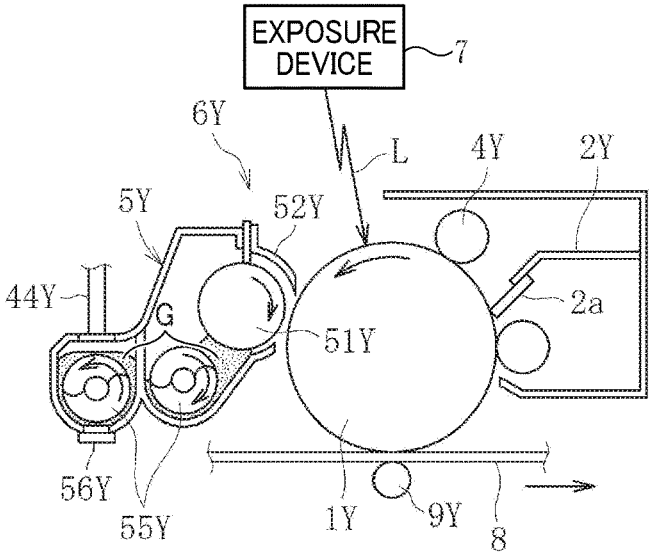
FIG. 2 is an enlarged view illustrating an image forming device of the image forming apparatus of FIG. 1.

Now, a description is given of an overall configuration and operations of an image forming apparatus 100 according to an embodiment of this disclosure, with reference to FIGS. 1 and 2.

FIG. 1 is a diagram illustrating an entire configuration of an image forming apparatus 100 according to an embodiment of this disclosure. FIG. 2 is an enlarged view illustrating an image forming device 6Y of the image forming apparatus 100 of FIG. 1.

The image forming apparatus 100 may be a copier, a facsimile machine, a printer, a multifunction peripheral or a multifunction printer (MFP) having at least one of copying, printing, scanning, facsimile, and plotter functions, or the like. According to the present example, the image forming apparatus 100 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

As illustrated in FIG. 1, the image forming apparatus 100 includes an intermediate transfer belt device 15 at the center of an apparatus body thereof. The intermediate transfer belt device 15 includes an intermediate transfer belt 8.

The image forming apparatus 100 farther includes image forming devices 6Y, 6M, 6C and 6K, a registration correcting device 30 and a sheet feeding device 26.

The image forming devices 6Y, 6M, 6C and 6K corresponding to respective colors of yellow, magenta, cyan and black are aligned facing the intermediate transfer belt 8.

The registration correcting device 30 functions as a corrector to correct lateral displacement and angular displacement of the sheet P and a sheet conveyance speed deviation of the sheet P and is disposed on a straight sheet conveyance passage K2 located at a position lower right from the intermediate transfer belt device 15 in FIG. 1.

The sheet feeding device 26 is located below the straight sheet conveyance passage K2 and stores a sheet P that functions as a recording medium and a transfer medium.

Further, the image forming apparatus 100 according to the present embodiment of this disclosure is connected to a large capacity tray (LCT) 200 that functions as a sheet feeding device. According to this configuration, the sheet P can be conveyed from an external device (i.e., the LCT 200 in the present embodiment) from outside of the apparatus body of the image forming apparatus 100.

As illustrated in FIG. 2, which is an enlarged view of the image forming device 6Y producing a yellow color image of the image forming apparatus 100. The image forming device 6Y includes a photoconductor drum 1Y and image forming components disposed around the photoconductor drum 1Y, such as a charging device 4Y, a developing device 5Y, a cleaning device 2Y and an electric discharging device. A series of image formation processes, which are a charging process, an exposing process, a developing process, a transfer process and a charging process) is performed on the photoconductor drum 1Y, and a yellow image is formed on a surface of the photoconductor drum 1Y.

The image forming devices 6Y, 6M, 6C and 6K have configurations basically identical to each other, except the colors of toners to be used for image formation. The image forming devices 6M, 6C and 6K perform the same image formation processes as the image forming device 6Y. Accordingly, the following description is given of the configuration and image formation processes of the image forming device 6Y, with reference to FIG. 2. However, it is to be noted that the image forming devices 6M, 6C and 6K basically have the same configuration as the image forming device 6Y and perform the same image formation processes as the image forming device 6Y.

As illustrated in FIG. 2, a drive motor drives to rotate the photoconductor drum 1Y in a counterclockwise direction in FIG. 2. At the charging device 4Y, the surface of the photoconductor drum 1Y is uniformly charged. (This is a charging process.)

As a result, a charging potential is formed on the surface of the photoconductor drum 1Y. Then, as the photoconductor drum 1Y is rotated, the charged surface of the photoconductor drum 1Y is brought to a light emitting position of each of the laser light beams L emitted from an exposure device 7. The laser light beam L corresponding to the yellow component is emitted to the surface of the photoconductor drum 1Y to the surface of the photoconductor drum 1Y by scanning at this position. Accordingly, an electrostatic latent image having the yellow component is formed on the surface of the photoconductor drum 1Y. (This is an exposing process.)

After the electrostatic latent image having the yellow component is formed on the surface of the photoconductor drum 1Y, the photoconductor drum 1Y comes to an opposing position to the developing device 5Y, at which the surface of the photoconductor drum 1Y faces the developing device 5Y. The developing device 5Y supplies yellow toner onto the surface of the photoconductor drum 1Y, so that the electrostatic latent image formed on the surface of the photoconductor drum 1Y is developed into a visible yellow toner image. (This is a developing process.)

Thereafter, the surface of the photoconductor drum 1Y comes to an opposing positions to the intermediate transfer belt 8 and a transfer roller 9Y (i.e., transfer rollers 9Y, 9M, 9C and 9K), at which the surface of the photoconductor drum 1Y faces a surface of the intermediate transfer belt 8 and the transfer roller 9Y. At the opposing position, the yellow toner image formed on the surface of the photoconductor drum 1Y is transferred onto the surface of the intermediate transfer belt 8. (This is a primary transfer process.)

At this time, a small amount of residual toner remains on the surface of the photoconductor drum 1Y.

The photoconductor drum 1Y is further rotated and brought to an opposing position at which the surface of the photoconductor drum 1Y faces the cleaning device 2Y. The cleaning device 2Y includes a cleaning blade 2*a*. At this position, (the small amount of) residual toner untransferred and remaining on the surface of the photoconductor drum 1Y is mechanically removed by the cleaning blade 2*a*. The removed untransferred toner is collected into the cleaning device 2Y. (This is a cleaning process.)

Finally, the photoconductor drum 1Y is brought to an opposing position at which the surface of the photoconductor drum 1Y faces the electric discharging device. At this opposing position, residual potential remaining on the surface of the photoconductor drum 1Y is removed.

After these processes, a series of image formation processes of the photoconductor drum 1Y is completed.

It is to be noted that the above-described image formation processes of the image forming device 6Y are also performed in the image forming devices 6M, 6C and 6K. That is, the exposure device 7 disposed above the image forming devices 6M, 6C and 6K emits respective laser light beams L based on respective image data, toward the photoconductor drum 1M of the image forming device 6M, the photoconductor drum 1C of the image forming device 6C and the photoconductor drum 1K of the image forming device 6K.

To be more specific, the exposure device 7 emits the laser light beam L from a light source. At this time, a polygon mirror rotates at high speed to deflect the laser light beam L having each color component in a direction of rotational axis of the corresponding photoconductor drum 1 of the photoconductor drums 1Y, 1M, 1C and 1K, via multiple optical elements, so as to scan the photoconductor drum 1. Then, the respective toner images formed on the respective photoconductor drums 1Y, 1M, 1C and 1K through the developing process are sequentially transferred onto the surface of the intermediate transfer belt 8 that functions as an image bearer. Accordingly, a color image is formed on the surface of the intermediate transfer belt 8.

Figure 3:
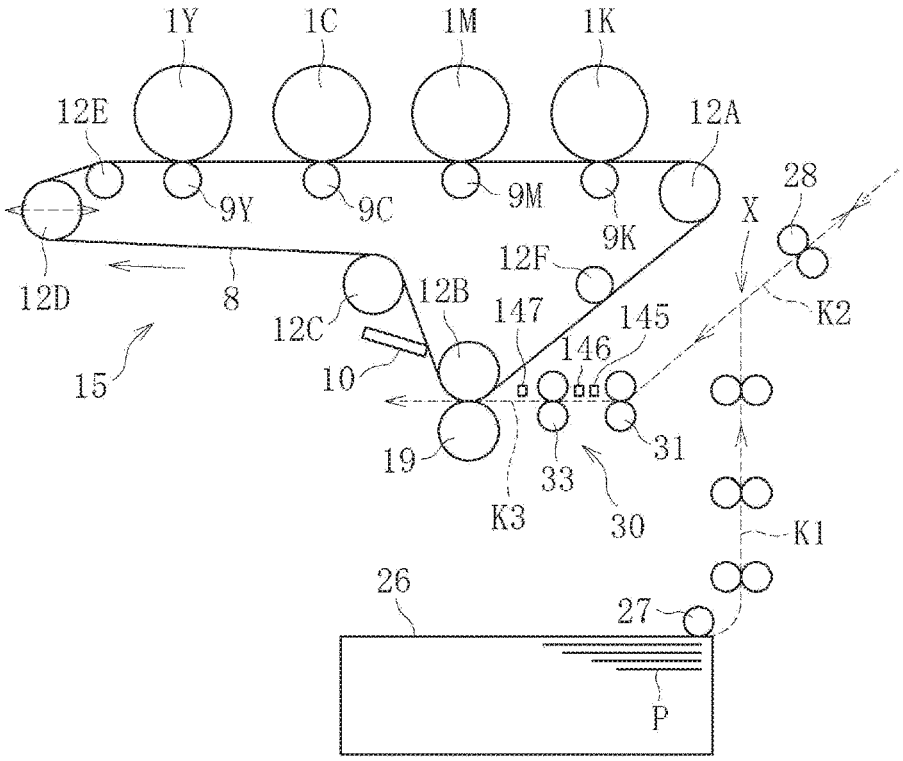
FIG. 3 is a diagram illustrating an intermediate transfer belt of the image forming apparatus and a mechanism in the vicinity of the intermediate transfer belt.

FIG. 3 is a diagram illustrating the intermediate transfer belt device 15 of the image forming apparatus 100 and a mechanism in the vicinity of the intermediate transfer belt device 15.

As illustrated in FIG. 3, the intermediate transfer belt device 15 includes the intermediate transfer belt 8, the four primary transfer rollers 9Y, 9M, 9C and 9K, a drive roller 12A, an opposing roller 12B, tension rollers 12C through 12F, and an intermediate transfer cleaning device 10. The intermediate transfer belt 8 is wound around multiple rollers 12A through 12F, i.e., the drive roller 12A, the opposing roller 12B and the tension rollers 12C through 12F. While being stretched by the multiple rollers 12A through 12F, the intermediate transfer belt 8 is moved together with rotation of the drive roller 12A and is rotated endlessly in a direction indicated by arrow in FIG. 3.

The four primary transfer rollers 9Y, 9M, 9C and 9K contact the photoconductor drums 1Y, 1M, 1C and 1K, respectively with the intermediate transfer belt 8 interposed therebetween, and form respective primary transfer nip regions. A transfer voltage (i.e., a transfer bias) having a polarity opposite a transfer voltage of toner is applied to each of the primary transfer rollers 9Y, 9M, 9C and 9K.

Then, the intermediate transfer belt 8 that functions as an image bearer having a belt shape moves in the direction indicated by arrow in FIG. 3 and passes the respective primary transfer nip regions of the primary transfer rollers 9Y, 9M, 9C and 9K sequentially in this order. According to this operation, respective toner images formed on the photoconductor drums 1Y, 1M, 1C and 1K are sequentially transferred and overlaid onto the surface of the intermediate transfer belt 8.

Then, the intermediate transfer belt 8 having a composite toner image formed by overlaying the respective toner images formed on the photoconductor drums 1Y, 1M, 1C and 1K is brought to an opposing position (i.e. an image transfer position) at which the composite toner image faces a secondary transfer roller 19. At this position, while interposing the intermediate transfer belt 8 therebetween, the opposing roller 12B and the secondary transfer roller 19 form a secondary transfer nip region (i.e., the image forming position of the sheet P).

The four color toner image formed on the surface of the intermediate transfer belt 8 is transferred onto the sheet P, such as a transfer paper, conveyed to the secondary transfer nip region. (This is a secondary transfer process.)

At this time, residual toner that is untransferred onto the sheet P remains on the surface of the intermediate transfer belt 8.

After the secondary transfer process, the intermediate transfer belt 8 comes to an opposing position at which the surface of the intermediate transfer belt 8 faces the intermediate transfer cleaning device 10. At this position, the residual toner untransferred and remaining on the surface of the intermediate transfer belt 8 is removed.

After these processes, a series of transfer processes of the intermediate transfer belt 8 is completed.

Referring to FIG. 1 again, the sheet P conveyed to the secondary transfer nip region is fed by a sheet feed roller 27 from the sheet feeding device 26 disposed below the apparatus body of the image forming apparatus 100 (or the sheet feeding device 26 of the LCT 200 disposed adjacent to or on the side of the apparatus body of the image forming apparatus 100). The sheet P is conveyed through the sheet feed passage K1 (or the second sheet feed passage K10) and the straight sheet conveyance passage K2. The sheet feeding device 26 stores multiple sheets P such as transfer sheets loaded in layers. Consequently, as the sheet feed roller 27 is rotated, an uppermost sheet P is fed toward the sheet feed passage K1 (or the second sheet feed passage K10).

The sheet P fed to the sheet feed passage K1 (or the second sheet feed passage K10) is conveyed to a meeting point X located at an upstream side of the registration correcting device 30. The sheet feed passage K1 (or the second sheet feed passage K10) meets the straight sheet conveyance passage K2 at the meeting point X. Then, the sheet P is conveyed to a direction to separate from the registration correcting device 30 in the straight sheet conveyance passage K2, which is an upward right direction in FIG. 1). After the trailing end of the sheet P is completely conveyed in the straight sheet conveyance passage K2, a direction of conveyance of the sheet P is reversed (i.e., is switched back) to convey the sheet P toward the registration correcting device 30.

After the sheet P has been conveyed to the registration correcting device 30, the registration correcting device 30 performs correction of angular displacement (i.e., correction of positional deviation in the radial direction), correction of lateral displacement (i.e., correction of positional deviation in the width direction) and correction of sheet conveyance speed deviation (i.e., correction of positional deviation in the sheet conveying direction). After the corrections are completed, the sheet P is conveyed toward the secondary transfer nip region (i.e., the image forming position of the sheet P) in synchronization with movement of the color image formed on the surface of the intermediate transfer belt 8.

Accordingly, a desired color image is formed on the sheet face P.

It is to be noted that respective configurations and operations of the sheet feed passage K1 and the straight sheet conveyance passage K2 are described referring to FIG. 3.

The sheet P on which the color image is formed in the secondary transfer nip region (i.e., the image forming portion of the sheet P) is conveyed to a fixing device 20. Then, the color image transferred onto the surface of the sheet P is fixed by application of heat and pressure by a fixing belt and a pressure roller in the fixing device 20.

Thereafter, the sheet P is ejected by a sheet ejecting roller to an outside of the apparatus body of the image forming apparatus 100. After having been ejected by the sheet ejecting roller to the outside of the apparatus body of the image forming apparatus 100, the sheet P is sequentially stacked on a stacker as an output image or output images.

After these processes, a series of image formation of the image forming apparatus 100 is completed.

It is to be noted that a process linear velocity of the image forming apparatus 100 according to the present embodiment (i.e., a moving speed of the intermediate transfer belt 8 and a conveying speed of the sheet P) is set to approximately 400 mm/sec.

As described above, the image forming apparatus 100 according to the present embodiment has a configuration in which the sheet feed passage K1 is provided to meet and merge a middle point (i.e., the meeting point X) of the straight sheet conveyance passage K2 in which the registration correcting device 30 that functions as a lateral displacement corrector is provided, as illustrated in FIG. 1. Further, the sheet feed passage K1 is located at a position closer to the center of the apparatus body of the image forming apparatus 100 (i.e., on the left side of FIG. 1), than an end of the upstream side of the straight sheet conveyance passage K2 in the sheet conveying direction (i.e., on the upper right side of FIG. 1). Accordingly, a reduction in size of the image forming apparatus 100 in a horizontal direction can be achieved.

Further, in the present embodiment, the straight sheet conveyance passage K2 has a slope that goes up from a downstream side of the sheet conveying direction toward an upstream side of the sheet conveying direction. Accordingly, a space between the intermediate transfer belt device 15 and the straight sheet conveyance passage K2 is effectively used, and therefore a reduction in size of the straight sheet conveyance passage K2 in the horizontal direction can be achieved. In addition, a large space is provided below the straight sheet conveyance passage K2, and therefore an increase in freedom of layout of the sheet feeding device 26 disposed below the straight sheet conveyance passage K2 can be achieved.

In addition, in the present embodiment, a curved sheet conveyance passage K4 having a curved shape is provided to the upstream side of the straight sheet conveyance passage K2 in the sheet conveying direction.

Further, an opening 90 is disposed on the upstream side of the straight sheet conveyance passage K2 in the sheet conveying direction (i.e., an upstream side of the curved sheet conveyance passage K4). The opening 90 is exposed toward an outside of the image forming apparatus 100 (i.e., toward the top of the image forming apparatus 100).

According to the above-described configuration, a large sheet P having a long length in the sheet conveying direction (for example, a banner paper) can be conveyed easily, without increasing the size of the image forming apparatus 100 in the horizontal direction. To be more specific, in a case in which a large sheet P having a long length in the sheet conveying direction is conveyed, the large sheet P that is fed from the meeting point X is temporarily stored in the straight sheet conveyance passage K2 and the curved sheet conveyance passage K4, both of which are disposed upstream from the meeting point X (or, occasionally, part of the large sheet P is exposed to the outside of the apparatus body of the image forming apparatus 100 via the opening 90). Then, the direction of conveyance of the large sheet P is reversed, that is, in a direction opposite the sheet conveying direction, so that the large sheet P is conveyed toward the registration correcting device 30.

Configuration and Operations of Developing Device.

Now, a description is given of a configuration and operations of the developing device 5 in the image forming device 6, with reference to FIG. 2.

It is to be noted that, even though the following description explains the developing device 5Y of the image forming device 6Y, the following description is also applied to the developing device 5M in the image forming device 6M, the developing device 5C in the image forming device 6C, and the developing device 5K in the image forming device 6K.

The developing device 5Y includes a developing roller 51Y, a doctor blade 52Y, two toner conveyance screws 55Y, a toner supply passage 44Y, and a toner concentration detection sensor 56Y. The developing roller 51Y is disposed opposing the photoconductor drum 1Y. The doctor blade 52Y is disposed opposing the developing roller 51Y. The two toner conveyance screws 55Y are disposed in respective developer containers. The toner supply passage 44Y communicate with the developer containers via an opening. The toner concentration detection sensor 56Y detects the concentration of toner in developer G.

The developing roller 51Y includes magnet and a sleeve. The magnet is fixedly disposed inside the developing roller 51Y. The sleeve rotates about the magnet. The developer G is a two-component developer contained in the developer containers. The developer G includes carrier including carrier particles and toner including toner particles.

The developing device 5Y having the above-described configuration operates as follows.

The sleeve of the developing roller 51Y rotates in a direction indicated by arrow in FIG. 2. The magnet generates a magnetic field. The developer G borne on the developing roller 51Y moves on the developing roller 51Y by the magnetic field, along with rotation of the sleeve. The developer G in the developing device 5Y is adjusted so that the percentage of the toner in the developer G (i.e., the toner concentration) falls within a predetermined range.

The two developer containers are disposed facing each other with a partition being interposed therebetween. Toner supplied into the developer containers is circulated in the two developer containers while being stirred and mixed with the developer by the two toner conveyance screws 55Y (i.e., in a direction orthogonal to the drawing sheet of FIG. 2). The toner in the developer G is electrically charged by friction with the carrier. Both the toner and the carrier are held on the developing roller 51Y due to a magnetic force formed on the developing roller 51Y.

After having been borne on the developing roller 51Y, the developer G is conveyed in a direction indicated by arrow in FIG. 2, and then comes to an opposing position of the doctor blade 52Y. After having been adjusted to an appropriate amount by the doctor blade 52Y at this opposing position, the developer G on the developing roller 51Y is then conveyed to an opposing position to the photoconductor drum 1Y (i.e., a developing region).

Then, the toner of the developer G on the developing roller MY adheres to the electrostatic latent image formed on the surface of the photoconductor drum 1Y due to the electric field formed in the developing region. After the adhesion to the electrostatic latent image on the photoconductor drum 1Y, the developer G remaining on the developing roller 51Y is conveyed to the upper part of the developer containers along with rotation of the sleeve of the developing roller 51Y, where the developer G is separated from the developing roller 51Y.

Figure 4B:
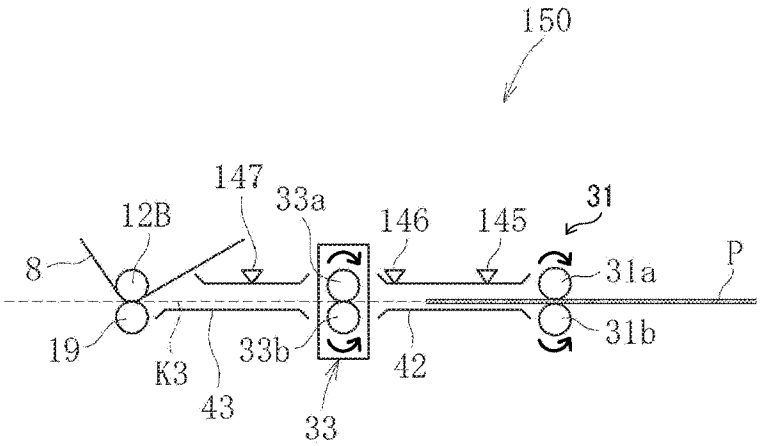
FIG. 4B is a side view illustrating the sheet conveying device of FIG. 4A.
Figure 4A:
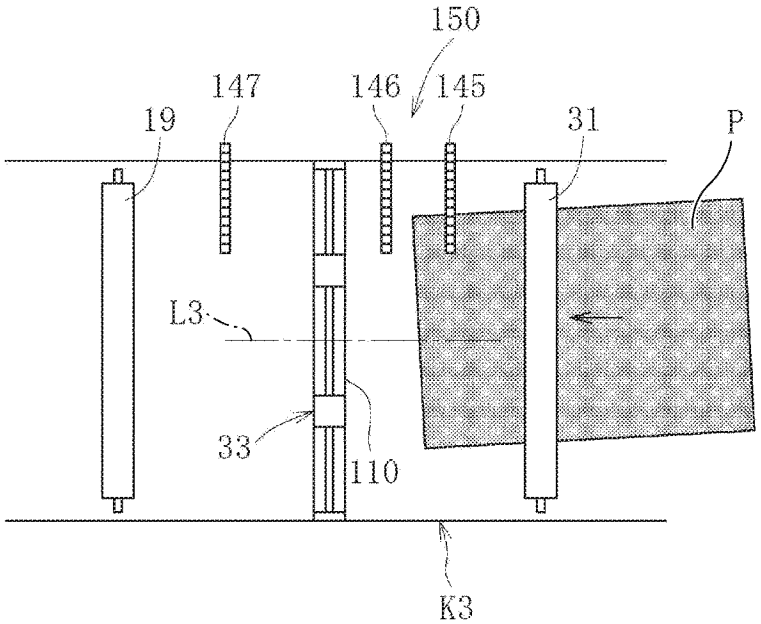
FIG. 4A is a top view illustrating a sheet conveying device according to an embodiment of this disclosure.

Next, a description is given of respective configurations and operations of the sheet feed passage K1, the straight sheet conveyance passage K2 and a straight sheet conveyance passage K3, with reference to FIGS. 3, 4A and 4B.

FIG. 3 is a diagram illustrating the intermediate transfer belt device 15 of the image forming apparatus 100 and a mechanism in the vicinity of the intermediate transfer belt device 15. FIG. 4A is a top view illustrating a sheet conveying device 150 according to an embodiment of this disclosure. FIG. 4B is a side view illustrating the sheet conveying device 150 of FIG. 4A.

A pair of sheet conveying rollers 28 that functions as a sheet reversing member, the meeting point X and the registration correcting device 30 are disposed on the straight sheet conveyance passage K2. The registration correcting device 30 is disposed on the straight sheet conveyance passage K3 that a horizontal passage continuously extending to the straight sheet conveyance passage K2.

A pair of sheet conveying rollers 31, a first CIS 145, a second CIS 146, a pair of sheet holding rollers 33, a third CIS 147 and the secondary transfer roller 19 are disposed in this order from the upstream side of the straight sheet conveyance passage K3, along with the sheet conveying direction of the straight sheet conveyance passage K3. The first CIS 145, the second CIS 146 and the third CIS 147 function as detectors to detect lateral displacement of the sheet P in the width direction. The pair of sheet holding rollers 33 functions as and corresponds to the registration correcting device 30 to correct angular displacement and lateral displacement of the sheet P and a sheet conveyance speed deviation of the sheet P in the sheet conveying direction. The term "CIS" stands for a contact image sensor. Specifically, the first CIS 145, the second CIS 146 and the third CIS 147 are multiple photosensors (including a light emitting element such as a light receiving diode, LED, and a light receiving element such as a photo diode) aligned equally spaced apart in the width direction of the sheet P. The first CIS 145, the second CIS 146 and the third CIS 147 detect respective side edge positions of the sheet P in the width direction to obtain respective amounts of lateral displacement of the sheet P in the width direction. Then, as described below, the pair of sheet holding rollers 33 performs correction of lateral displacement and correction of angular displacement, based on the detection results obtained by the first CIS 145, the second CIS 146 and the third CIS 147.

The pair of sheet holding rollers 33 that functions as a sheet positional deviation corrector is disposed upstream from the image forming portion of the sheet P (the secondary transfer nip region) in the sheet conveying direction.

The straight sheet conveyance passage K2 is provided on the upstream side of the sheet conveying direction up to the pair of sheet holding rollers 33. At the same time, the straight sheet conveyance passage K2 has a slope going up from the upstream side toward the downstream side.

According to the above-described configuration, the size of a space between (the surface of) the intermediate transfer belt 8 and the registration correcting device 30 is reduced and the sheet P is not conveyed to the image forming portion (the secondary transfer nip region) at a steep angle. Therefore, the secondary transfer process can be performed reliably.

The pair of sheet conveying rollers 28 that functions as a sheet reversing member is disposed on the straight sheet conveyance passage K2 and disposed upstream from the meeting point X in the sheet conveying direction of the sheet P. The pair of sheet conveying rollers 28 includes an upper roller and a lower roller and is controlled by a driving mechanism so that the upper roller and the lower roller of the pair of sheet conveying rollers 28 contact to and separate from each other.

The upper roller and the lower roller of the pair of sheet conveying rollers 28 are caused by a drive motor to rotate in both directions, which are a forward direction and a reverse direction opposite the forward direction.

In addition, a switching claw is disposed at the meeting point X so as to switch the direction of conveyance of the sheet P. Specifically, the switching claw is used to switch the direction of the sheet P between a direction from the sheet feed passage K1 and the second sheet feed passage K10 toward the upstream side of the straight sheet conveyance passage K2 and a direction from the upstream side of the straight sheet conveyance passage K2 to the downstream side of the straight sheet conveyance passage K2.

Then, when the sheet P is conveyed from the sheet feed passage K1 to the meeting point X, the pair of sheet conveying rollers 28 is rotated in the forward direction to separate the sheet P from the registration correcting device 30 in the straight sheet conveyance passage K2. Thereafter, the pair of sheet conveying rollers 28 is rotated in the reverse direction to reverse the direction of conveyance of the sheet P, so that the sheet P is conveyed toward the registration correcting device 30. That is, the pair of sheet conveying rollers 28 functions as a sheet reversing member.

It is to be noted that this configuration according to the present embodiment includes the pair of sheet conveying rollers 28 that functions as a sheet reversing member located in the straight sheet conveyance passage K2. However, the location of the pair of sheet conveying rollers 28 is not limited thereto. For example, the pair of sheet conveying rollers 28 may be disposed in the curved sheet conveyance passage K4 that is disposed upstream from the straight sheet conveyance passage K2 in the sheet conveying direction, as illustrated in FIG. 1.

While the sheet P is being held at the nip region of the pair of sheet holding rollers 33, a roller holding member 110 shifts in the width direction of the sheet P and rotates about a support shaft 110*a*. According to this operation, the lateral displacement of the sheet P and the angular displacement of the sheet P are corrected.

The first CIS 145, the second CIS 146 and the third CIS 147 detect respective positions of one edge in the width direction of the sheet P, so as to detect the amount of lateral displacement and the deviation angle. Then, based on the detection results, the pair of sheet holding rollers 33 performs the correction of lateral displacement and the correction of angular displacement.

A sheet P (an uppermost sheet P) placed on top of multiple sheets P stored in the sheet feeding device 26 of the image forming apparatus 100 is fed by the sheet feed roller 27 toward the pair of sheet holding rollers 33. The pair of sheet holding rollers 33 performs the correction of lateral displacement and the correction of angular displacement of the sheet P. Then, the sheet P is conveyed toward the image forming portion (the secondary transfer nip region) in synchronization with movement of an image formed on the surface of the photoconductor drum 1, for positioning with the image.

Then, after completion of the transfer process, the sheet P passes the image forming portion of the sheet P (the secondary transfer nip region). Thereafter, the sheet P passes through a sheet conveyance passage extending from the secondary transfer roller 19 toward the downstream side of the sheet conveying direction, and reaches the fixing device 20. In the fixing device 20, the image formed on the sheet P is fixed to the sheet P by application of heat and pressure. After passing the fixing device 20, the sheet P having a fixed image thereon is ejected from the image forming apparatus 100.

Accordingly, a series of image formation processes is completed.

Sheet Conveying Device.

As described above, the image forming apparatus 100 includes the straight sheet conveyance passage K3 along the sheet conveying direction of the sheet P. The straight sheet conveyance passage K3 is defined by pairs of straight conveying guide plates 42 and 43. Each of the pairs of straight conveying guide plates 42 and 43 is disposed such that plates thereof sandwich front and back of the sheet P that is conveyed, as illustrated in FIG. 4B.

The pair of sheet conveying rollers 31 includes a driven roller 31*a* and a drive roller 31*b* and conveys the sheet P while holding the sheet P in a nip region formed between the driven roller 31*a* and the drive roller 31*b*. The driven roller

31*a* is disposed on the upper side of the pair of sheet conveying rollers 31 and is movable vertically. The drive roller 31*b* is disposed on the lower side of the pair of sheet conveying rollers 31 and is fixed to the apparatus body of the image forming apparatus 100. The pair of sheet holding rollers 33 includes a driven roller 33*a* and a drive roller 33*b* and conveys the sheet P while holding the sheet P in a nip region formed between the driven roller 33*a* and the drive roller 33*b*. The driven roller 33*a* is disposed on the upper side of the pair of sheet holding rollers 33 and is movable vertically. The drive roller 33*b* is disposed on the lower side of the pair of sheet holding rollers 33 and is fixed to the apparatus body of the image forming apparatus 100. After passing the sheet P to a corresponding downstream side roller or rollers, the driven roller 31*a* of the pair of sheet conveying rollers 31 and the driven roller 33*a* of the pair of sheet holding rollers 33 move upwardly to release the respective nip regions temporarily.

The pair of sheet conveying rollers 31, the first CIS 145, the second CIS 146, the third CIS 147 and the pair of sheet holding rollers 33 form the sheet conveying device 150 according to the present embodiment of this disclosure. The first CIS 145, the second CIS 146 and the third CIS 147 have a configuration identical to each other, and therefore the number of parts can be reduced to achieve a reduction in manufacturing cost of the image forming apparatus 100. The sheet conveying device 150 performs correction of angular displacement of the sheet P and the correction of lateral displacement of the sheet P by the first CIS 145, the second CIS 146, the third CIS 147 and the pair of sheet holding rollers 33.

Now, a description is given of the sheet conveying device 150, with reference to FIGS. 4A, 4B, 5A and 5B.

Figure 5A:
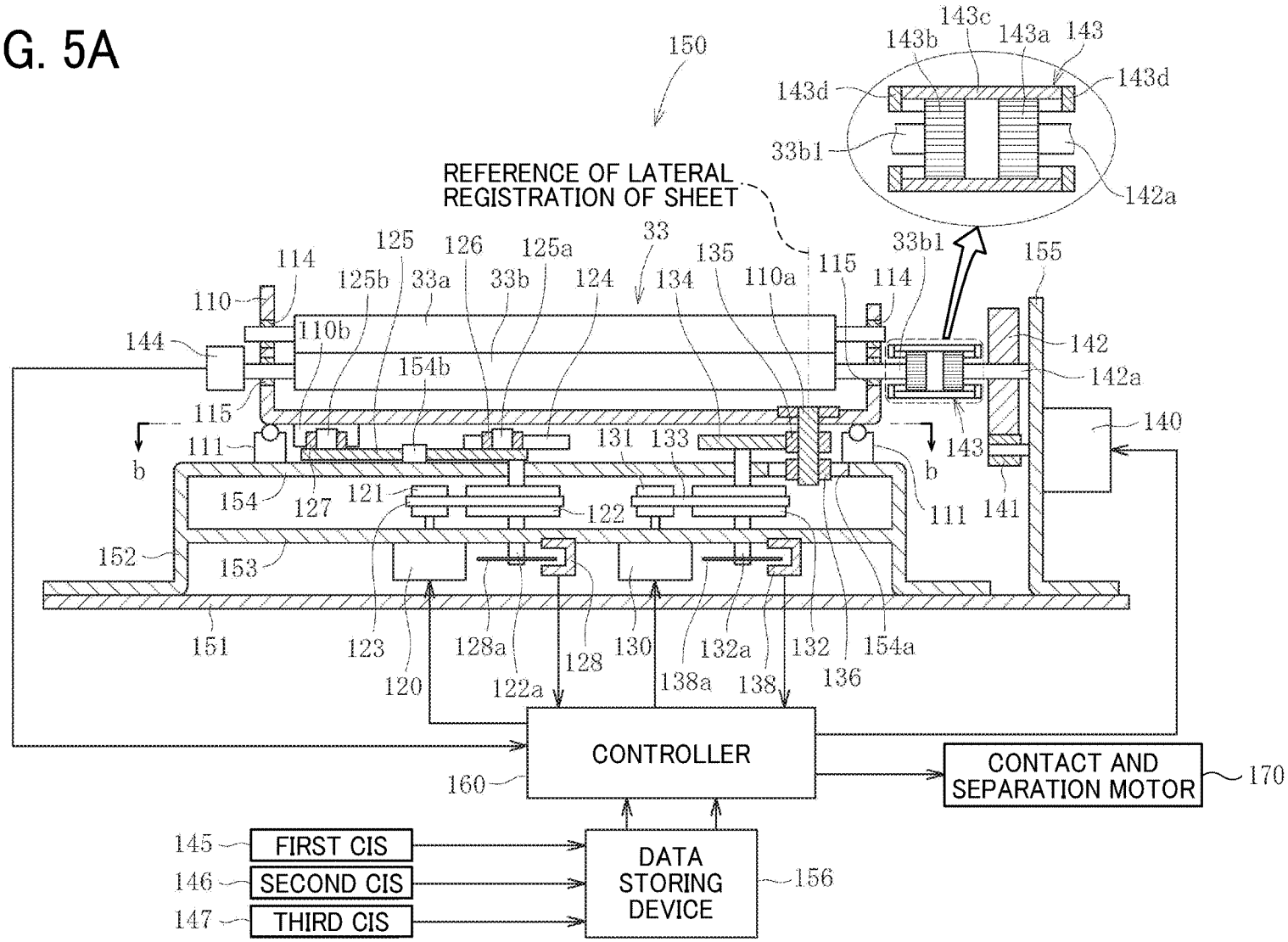
FIG. 5A is a cross sectional view illustrating the sheet conveying device according to an embodiment of this disclosure.
Figure 5B:
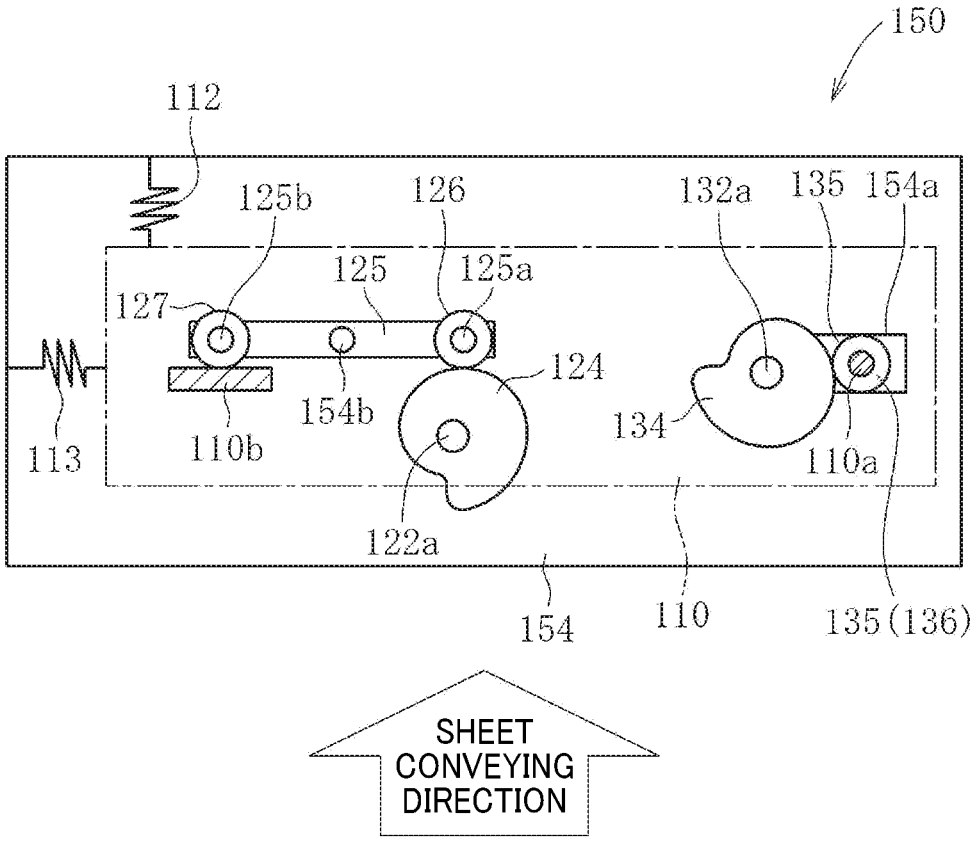
FIG. 5B is a plan view illustrating the sheet conveying device of FIG. 5A, along a line b-b of FIG. 5A.

FIG. 5A is a cross sectional view illustrating the sheet conveying device 150 according to an embodiment of this disclosure. FIG. 5B is a plan view illustrating the sheet conveying device 150 of FIG. 5A, along a line b-b of FIG. 5A.

As illustrated in FIG. 5A, the sheet conveying device 150 includes a main frame 151 and a base frame 152. The main frame 151 is fixedly disposed along the straight sheet conveyance passage K3, below the pair of sheet holding rollers 33. The base frame 152 is fixedly disposed on the main frame 151. The base frame 152 includes a lower horizontal plate 153 and an upper horizontal plate 154 arranged vertically. The roller holding member 110 that supports the pair of sheet holding rollers 33 is disposed on the upper horizontal plate 154. The roller holding member 110 is movable in the horizontal direction.

As illustrated in FIG. 5B, four free bearings 111 (ball transfers) are disposed at respective positions of four corners of a base surface of the roller holding member 110, on the upper horizontal plate 154. The roller holding member 110 is disposed on the free bearings 111 to be movable horizontally in any directions, which are front, back, left and right directions.

Each of the free bearings 111 is known to include a steel ball 95*a* inserted into a recess portion of a base. The top end of the steel ball 95*a* contacts the base surface of the roller holding member 110 as a point contact. The free bearings 111 are provided at least three bearings. In the present embodiment, the four free bearings 111 are provided so that the roller holding member 110 can move stably and reliably.

The roller holding member 110 includes a plate frame extending in a direction perpendicular to the sheet conveying direction of the sheet P. Both ends of the plate frame of the roller holding member 110 are upwardly bent at a right angle. An upper bearing 114 and a lower bearing 115 are vertically arranged at each of respective belt portions of both ends of the roller holding member 110. The roller holding member 110 further includes a rotation receiver 110*b* on one side on a lower face thereof. The rotation receiver 110*b* extends in a direction perpendicular to the sheet conveying direction of the sheet P and projects downwardly from the lower face of the roller holding member 110, as a single unit.

The pair of sheet holding rollers 33 includes the drive roller 33*b* disposed on the lower side thereof and the driven roller 33*a* disposed on the upper side thereof. A rotary shaft of the driven roller 33*a* on the upper side of the pair of sheet holding rollers 33 is supported by the upper bearing 114 of the roller holding member 110 and a rotary shaft of the drive roller 33*b* on the lower side of the pair of sheet holding rollers 33 is supported by the lower bearing 115 of the roller holding member 110.

A rotary encoder 144 is mounted on an outwardly projected portion of the rotary shaft of the drive roller 33*b*, from the lower bearing 115. The rotary encoder 144 detects the number of rotations of the drive roller 33*b*, and a rotation variable roller drive motor is driven based on the number of rotations of the drive roller 33*b* detected by the rotary encoder 144. Then, the driven roller 33*a* is rotated along with rotation of the drive roller 33*b*.

The roller holding member 110 further includes a support shaft 110*a* fixed on the other side on the lower face thereof. The support shaft 110*a* functions as a guide target portion that projects downwardly from the lower face of the roller holding member 110. A guide roller 136 is rotatably disposed on a lower end of the support shaft 110*a*. A cam follower 135 is rotatably disposed at an axial center of the support shaft 110*a*.

A first motor 120, a second motor 130, a first motor encoder (a rotary encoder) 128 and a second motor encoder (a rotary encoder) 138 are aligned on the lower horizontal plate 153 in the horizontal direction (i.e., the left and right directions). The first motor 120 is an angular displacement correction motor to correct the angular displacement, and therefore a drive pulley 121 is attached to a rotary shaft of the first motor 120. The second motor 130 is a lateral displacement correction motor to correct the lateral displacement, and therefore a drive pulley 131 is attached to a rotary shaft of the second motor 130.

It is to be noted that, instead of the first motor encoder 128, any encoder (for example, a linear encoder) to detect movement of a first rotation cam 124 and any sensor (for example, a laser displacement sensor) to detect a position of a lever 125 may be provided to the sheet conveying device 150.

Further, it is to be noted that, instead of the second motor encoder 138, any encoder (for example, a linear encoder) to detect movement of a second rotation cam 134 and any sensor (for example, a laser displacement sensor) to detect a position of the roller holding member 110 may be provided to the sheet conveying device 150.

Driven pulleys 122 and 132 are rotatably supported between the lower horizontal plate 153 and the upper horizontal plate 154. Both upper and lower ends of a rotary shaft 122*a* of the driven pulley 122 are rotatably supported by the lower horizontal plate 153 and the upper horizontal plate 154. Similarly, both upper and lower ends of a rotary shaft 132*a* of the driven pulley 132 are rotatably supported by the lower horizontal plate 153 and the upper horizontal plate 154. The rotary shaft 122*a* and the rotary shaft 132*a* are disposed in parallel to each other. A timing belt 123 is wound around the drive pulley 121 and the driven pulley 122. A timing belt 133 is wound around the drive pulley 131 and the driven pulley 132.

The rotary shaft 122*a* of the driven pulley 122 projects downwardly form the lower horizontal plate 153. A rotary plate 128*a* that functions as a rotary side part of the first motor encoder 128 is fixed to the rotary shaft 122*a* of the driven pulley 122. Similarly, the rotary shaft 132*a* of the driven pulley 132 projects downwardly form the lower horizontal plate 153. A rotary plate 138*a* that functions as a rotary side part of the second motor encoder 138 is fixed to the rotary shaft 132*a* of the driven pulley 132. Multiple slits are sequentially formed on a peripheral end of the rotary plate 128*a* of the first motor encoder 128 and on a peripheral end of the rotary plate 138*a* of the second motor encoder 138. The first motor encoder 128 includes a light emitting element and a light receiving element, both of which function as side parts thereof and are disposed to vertically hold the peripheral end of the rotary plate 128*a*. Similarly, the second motor encoder 138 includes a light emitting element and a light receiving element, both of which function as side parts thereof and are disposed to vertically hold the peripheral end of the rotary plate 138*a*.

The rotary shaft 122*a* of the driven pulley 122 also projects upwardly form the upper horizontal plate 154. A first rotation cam 124 is fixed to the rotary shaft 122*a* of the driven pulley 122. Similarly, the rotary shaft 132*a* of the driven pulley 132 also projects upwardly form the upper horizontal plate 154. A second rotation cam 134 is fixed to the rotary shaft 132*a* of the driven pulley 132. A cam curve of the first rotation cam 124 and a cam curve of the second rotation cam 134 are manufactured to generate respective motion curves having a constant velocity. By employing the motion curves having a constant velocity, the angle of rotation of the first rotation cam 124 is controlled to have an amount of change in proportion to the distance of linear motion of a cam follower 126 and the angle of rotation of the second rotation cam 134 is controlled to have an amount of change in proportion to the distance of linear motion of the cam follower 135. Therefore, the shift position of the support shaft 110*a* and the rotation of the lever 125 are controlled easily.

A slot 154*a* that functions as a guide is disposed extending in a direction perpendicular to the sheet conveying direction of the sheet P, on one side of the upper horizontal plate 154, at a position adjacent to the second rotation cam 134. The guide roller 76 disposed on the lower end of the support shaft 110*a* is inserted into the slot 154*a*.

The cam follower 135 disposed at the middle portion of the support shaft 110*a* contacts a cam face of the peripheral end of the second rotation cam 134 by a force applied by a second tension spring 113.

It is to be noted that the slot 154*a* is used to guide the guide roller 136 linearly, and therefore may be replaced by a groove.

A support shaft 154*b* is disposed projecting from the upper horizontal plate 154, on the opposite side where the second rotation cam 134 is disposed. The lever 125 is mounted on the support shaft 154*b* to be rotatable in the horizontal direction.

Support shafts 125*a* and 125*b* are integrally formed on both ends of the lever 125. The cam follower 126 and a roller 127 that functions as a first pressing portion are rotatably disposed on the support shafts 125*a* and 125*b* via bearings such as ball bearings. An outer circumferential surface of the cam follower 126 contacts an outer circumferential surface of the first rotation cam 124 by a spring force applied by a first tension spring 112. An outer circumferential surface of the roller 127 contacts the rotation receiver 110*b* by the spring force applied by the first tension spring 112.

Specifically, the first motor 120, the drive pulley 121, the timing belt 123, the driven pulley 122, the first rotation cam 124, the lever 125 and the roller 127 are used to perform correction of angular displacement and form a first drive device 180. The first drive device 180 has a configuration in which the roller 127 that functions as a first pressing portion moves in the forward and backward direction in the sheet conveyance passage (i.e., the sheet conveying direction) of the sheet P.

In addition, the second motor 130, the drive pulley 131, the timing belt 133, the driven pulley 132 and the second rotation cam 134 are used to perform correction of lateral displacement and form a second drive device 190. The second drive device 190 further includes a second pressing portion (i.e., an outer circumferential surface of the second rotation cam 134) to contact the support shaft 110*a* that functions as a guide target, via the cam follower 135. The second pressing portion has a configuration in which the support shaft 110*a* moves in left and right in the direction perpendicular to the sheet conveyance passage (i.e., the sheet conveying direction) of the sheet P.

A bracket 155 is disposed vertically on the main frame 151 on one side of the straight sheet conveyance passage K3, at one axial end of the pair of sheet holding rollers 33. The bracket 155 has an outer surface on which a rotation variable roller drive motor 140 that functions as a drive device to rotate the drive roller 33*b* of the pair of sheet holding rollers 33 is disposed. A rotary shaft of the rotation variable roller drive motor 140 projects horizontally toward an inside of the bracket 155. A pinion gear 141 is fixed to the rotary shaft that projects toward the inside of the bracket 155. The pinion gear 141 is meshed with a reduction gear 142 that is supported at the inside of the bracket 155.

A rotary shaft 142*a* of the reduction gear 142 is coupled to a rotary shaft 33*b*1 of the pair of sheet holding rollers 33 via a two-step spline coupling 143. According to this configuration, a rotation driving force applied by the rotation variable roller drive motor 140 is transmitted to the drive roller 33*b* of the pair of sheet holding rollers 33 via the pinion gear 141, the reduction gear 142 and the two-step spline coupling 143. Accordingly, the pair of sheet holding rollers 33 is rotated. Accordingly, as the drive roller 33*b* of the pair of sheet holding rollers 33 is rotated by the rotation variable roller drive motor 140 while the pair of sheet holding rollers 33 is holding the sheet P, the sheet P is conveyed at any conveying speed.

The two-step spline coupling 143 is a constant velocity universal joint and, as illustrated in an enlarged area in FIG. 5A, includes a first spline gear 143*a*, a second spline gear 143*b*, an intermediate spline gear 143*c* and guide rings 143*d*.

The first spline gear 143*a* is an external gear and is mounted on the rotary shaft 142*a* that rotates together with the reduction gear 142 of the first drive device. The rotary shaft 142*a* is rotatably held by the bracket 155 via a bearing.

The second spline gear 143*b* is an external gear and is coupled to the rotary shaft 33*b*1 of the drive roller 33*b* of the pair of sheet holding rollers 33.

The intermediate spline gear 143*c* is an internal gear and is extended in the width direction so that the intermediate spline gear 143*c* constantly meshes with the first spline gear 143*a* and the second spline gear 143*b* even when the pair of sheet holding rollers 33 (attached to the roller holding member 110) shifts (slides) in the width direction.

Each of the first spline gear 143*a* and the second spline gear 143*b* has a crown shape so that the first spline gear 143*a* and the second spline gear 143*b* mesh with the intermediate spline gear 143*c* even when the pair of sheet holding rollers 33 (attached to the roller holding member 110) rotates in a direction of rotation of the sheet P.

By employing the above-described two-step spline coupling 143, the pair of sheet holding rollers 33 is rotated preferably. Specifically, even when the pair of sheet holding rollers 33 is rotated in the substantially horizontal direction about the support shaft 110*a* or is shifted (slid) in the width direction of the sheet P, the driving force of the rotation variable roller drive motor 140 disposed on the fixed side of the roller holding member 110 is transmitted to the drive roller 33*b* of the pair of sheet holding rollers 33 reliably with accuracy.

It is to be noted that each of the guide rings 143*d* is a stopper having a substantially ring shape. The guide rings 65*d* are mounted at both ends of the intermediate spline gear 143*c* in the width direction, so as to prevent the first spline gear 143*a* and the second spline gear 143*b* from moving relatively in the width direction and from falling from the two-step spline coupling 143.

The first CIS 145, the second CIS 146 and the third CIS 147 are fixed to the sheet conveyance passages (e.g., the straight sheet conveyance passages K2 and K3) through which the sheet P is conveyed. In the present embodiment, the first CIS 145 and the second CIS 146 are disposed between the pair of sheet conveying rollers 31 and the pair of sheet holding rollers 33, at a right angle to the sheet conveying direction relative to the pair of straight conveying guide plate 42 with the plates disposed vertically, as illustrated in FIGS. 4A and 4B. The position of the first CIS 145 and the position of the second CIS 146 are changeable within the range between the pair of sheet conveying rollers 31 and the pair of sheet holding rollers 33. The third CIS 147 is disposed between the pair of sheet holding rollers 33 and the secondary transfer roller 19, at a right angle to the sheet conveying direction relative to the pair of straight conveying guide plates 43 with the plates disposed vertically.

The first motor 120, the second motor 130, the rotation variable roller drive motor 140, the first motor encoder 128, the second motor encoder 138 and the rotary encoder 144 are connected to a controller 160, as illustrated in FIG. 5A. The first CIS 145, the second CIS 146 and the third CIS 147 are connected to the controller 160 via a data storing device 156.

The controller 160 controls drive units (i.e., the first motor 120 and the second motor 130) of the pair of sheet holding rollers 33 (attached to the roller holding member 110) as follows. Specifically, after the first CIS 145 and the second CIS 146 detect the respective positions of the sheet P, the detection results are stored in the data storing device 156, as a first positional deviation amount SF1 (i.e., a first deviation angle θ1 and a first lateral displacement amount δ1) of a first detection. Based on the first positional deviation amount SF1, the controller 160 causes the drive units (i.e., the first motor 120 and the second motor 130) to drive the pair of sheet holding rollers 33 to perform a pick up and hold operation.

Subsequently, after a leading end of the sheet P is held by the pair of sheet holding rollers 33, the first CIS 145 and the second CIS 146 detect the respective positions of the sheet P. The detection results are stored in the data storing device 156, as a second positional deviation amount SF2 (i.e., a second deviation angle θ2 and a second lateral displacement amount δ2) of a second detection. Based on the second positional deviation amount SF2, the controller 160 causes the drive device to drive the pair of sheet holding rollers 33 to perform an adjustment and feed operation in an opposite direction to the pick up and hold operation.

As described above, by causing the pair of sheet holding rollers 33 and the roller holding member 110 to perform the pick up and hold operation and the adjustment and feed operation according to the respective positional deviation amounts of the sheet P, the positional deviation of the sheet P can be corrected.

The term the "pick up and hold operation" is an operation to cause the pair of sheet holding rollers 33 and the roller holding member 110 to shift from a home position (i.e., an initial position) and rotate on the sheet conveying surface, according to the positional deviation amounts (i.e., the lateral displacement amount in the width direction and the deviation angle) of the sheet P that is to be held by the pair of sheet holding rollers 33, so that the pair of sheet holding rollers 33 faces the front of the leading end of the sheet P. Further, the term the "adjustment and feed operation" is an operation to cause the pair of sheet holding rollers 33 with the sheet P being held due to the pick up and hold operation to shift in an opposite direction opposite the direction of the pick up and hold operation and rotate on the sheet conveying surface in the opposite direction, so that the pair of sheet holding rollers 33 returns to the home position.

Further, the adjustment and feed operation is performed by controlling the drive device (the first motor 120 and the second motor 130) to correct the amount of the adjustment and feed operation of the pair of sheet holding rollers 33 based on the second positional deviation amount SF2 (i.e., the second deviation angle θ2 and the second lateral displacement amount δ2) of the second detection detected by the first CIS 145 and the second CIS 146 and stored in the data storing device 156.

Figure 11:
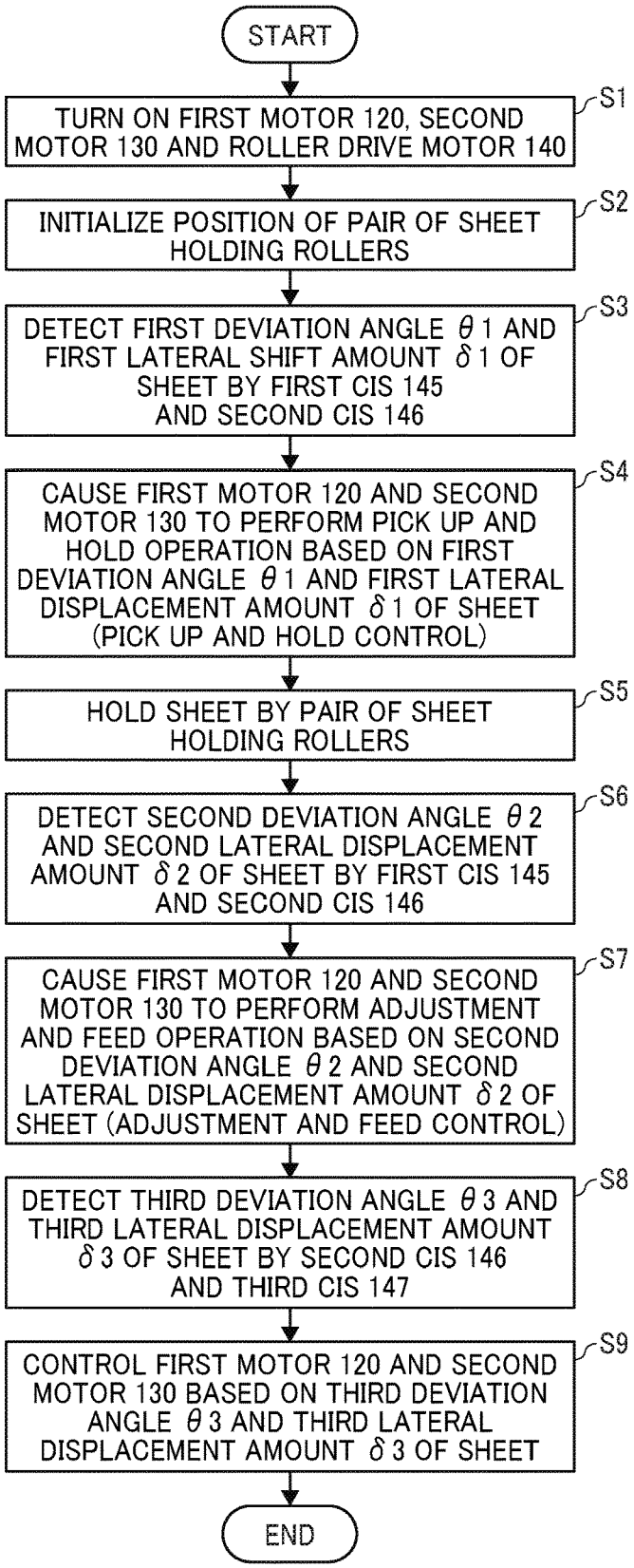
FIG. 11 is a flowchart of correction operations performed in the sheet conveying device.

As respective signals from the first motor encoder 128, the second motor encoder 138 and the rotary encoder 144 and the data storing device 156 are inputted to the controller 160, the controller 160 causes the first motor 120, the second motor 130 and the rotation variable roller drive motor 140 to rotate based on the signals, as described in the flowchart of FIG. 11.

Figure 6:
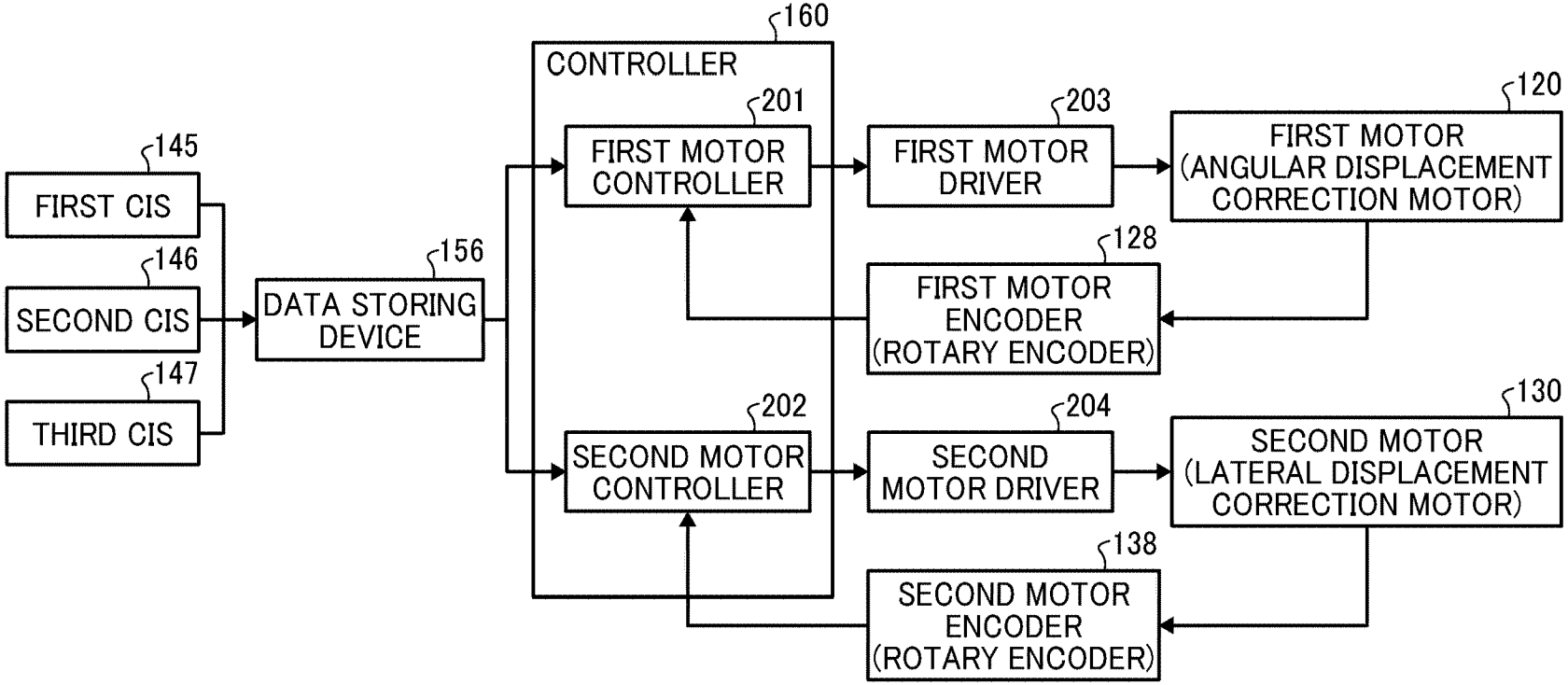
FIG. 6 is a block diagram illustrating details of a control system of a first motor and a second motor.

FIG. 6 is a block diagram illustrating details of a control system of the first motor 120 (i.e., a deviation angle correction motor) and the second motor 130 (i.e., a lateral displacement correction motor).

As illustrated in FIG. 6, the controller 160 includes a first motor controller 201 and a second motor controller 202.

The first motor controller 201 controls the first motor 120 that is an angular displacement correction motor. Specifically, the first motor controller 201 controls the first motor 120 based on the first positional deviation amount SF1 (i.e., the first deviation angle θ1 and the first lateral displacement amount δ1) of the primary detection detected by the first CIS 145 and the second CIS 146.

The second motor controller 202 controls the second motor 130 that is a lateral displacement correction motor. Specifically, the second motor controller 202 controls the second motor 130 based on the second positional deviation amount SF2 (i.e., the second deviation angle θ2 and the second lateral displacement amount δ2) of the secondary detection detected by the first CIS 145 and the second CIS 146.

A first motor driver 203 illustrated in FIG. 6 is a driver to receive a control signal from the first motor controller 201 and drive the first motor 120. A second motor driver 204 illustrated in FIG. 6 is a driver to receive a control signal from the second motor controller 202 and drive the second motor 130. Accordingly, when the first motor controller 201 and the second motor controller 202 transmit respective control signals corresponding to the above-described positional deviation amounts (i.e., the first positional deviation amount SF1 and the second positional deviation amount SF2) to the first motor driver 203 and the second motor driver 204, respectively, the first motor driver 203 and the second motor driver 204 drive the first motor 120 and the second motor 130, respectively, and therefore the pair of sheet holding rollers 33 performs the pick up and hold operation and the adjustment and feed operation, respectively.

Further, the amount of movement in the width direction of the pair of sheet holding rollers 33 during the pick up and hold operation is detected indirectly by the first motor encoder 128 (the rotary encoder) that detects an amount of rotation of the first motor 120. The amount of movement in the radial direction in the sheet conveying surface of the pair of sheet holding rollers 33 during the adjustment and feed operation is detected indirectly by the second motor encoder 138 (the rotary encoder) that detects an amount of rotation of the second motor 130. Then, the first motor controller 201 determines, based on the information obtained by the first motor encoder 128 (the rotary encoder), whether or not the pair of sheet holding rollers 33 has performed the pick up and hold operation or the adjustment and feed operation, corresponding to the first positional deviation amount SF1. Similarly, the second motor controller 202 determines, based on the information obtained by the second motor encoder 138 (the rotary encoder), whether or not the pair of sheet holding rollers 33 has performed the pick up and hold operation or the adjustment and feed operation, corresponding to the second positional deviation amount SF2.

Corrections of Angular Displacement and Lateral Displacement by Roller Holding Member.

Figure 7A:
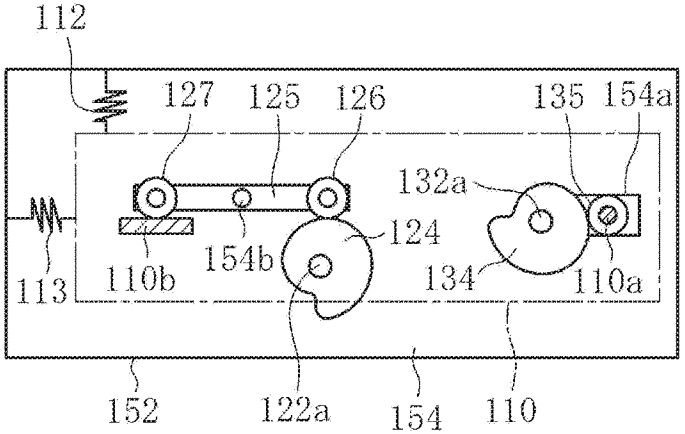
FIGS. 7A, 7B, 7C and 7D are diagrams illustrating motions of a roller holding member in correction of lateral displacement and correction of angular displacement.
Figure 7B:
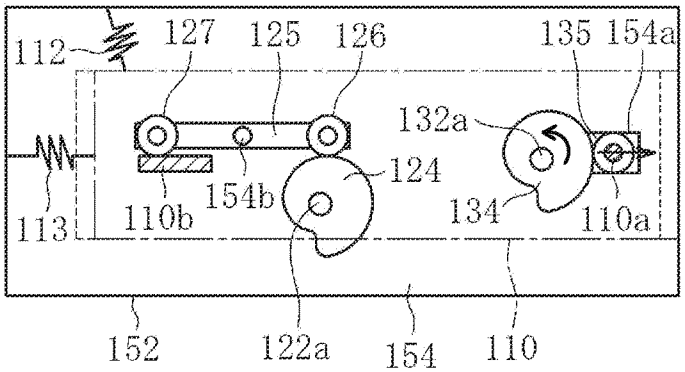
Figure 7C:
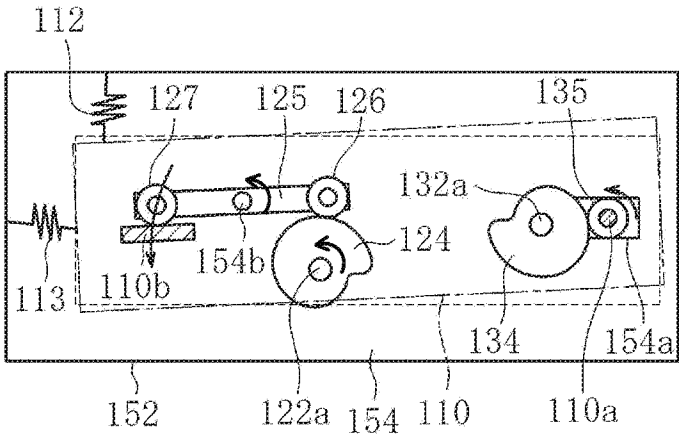
Figure 7D:
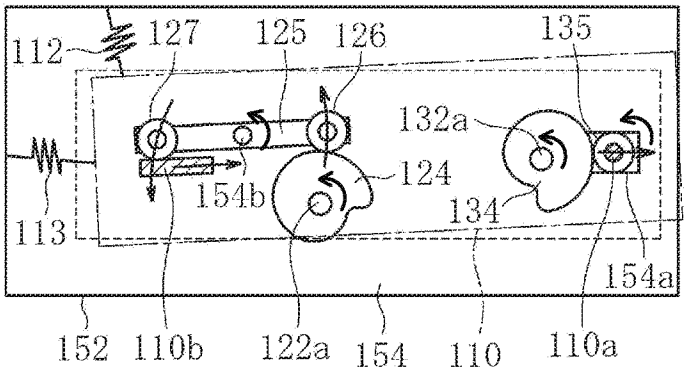

FIGS. 7A, 7B, 7C and 7D are diagrams illustrating motions of the roller holding member 110 in correction of lateral displacement and correction of angular displacement. Specifically, FIG. 7A illustrates the roller holding member 110 located at the home position. FIG. 7B illustrates the roller holding member 110 in a motion of correction of lateral displacement of the sheet P. FIG. 7C illustrates the roller holding member 110 in a motion of correction of angular displacement of the sheet P. FIG. 7D illustrates the roller holding member 110 in a combination of the motion of correction of angular displacement of the sheet P and the motion of correction of lateral displacement of the sheet P. In actual operations, it is rare to perform the motion of correction of lateral displacement of FIG. 7B alone or the motion of correction of angular displacement of FIG. 7C alone. In other words, the combination of the motion of angular displacement of the sheet P and the motion of lateral displacement of the sheet P is usually performed, as illustrated in FIG. 7D.

As described above, the motion of the roller holding member 110 from FIG. 7A to FIG. 7B depicts the flow of the correction of lateral displacement of the sheet P. That is, as the second motor 130 is driven to rotate the second rotation cam 134, the roller holding member 110 slides to the right side of FIG. 7B, against the spring force of the second tension spring 113 by movement of the second rotation cam 134. At this time, the cam follower 135 moves along the outer circumference of the second rotation cam 134 while rotating. Accordingly, a load of movement of the roller holding member 110 to act on the second motor 130 for correction of lateral displacement of the sheet P can be reduced.

Further, the roller 127 of the lever 125 rotates on the surface of the rotation receiver 110*b* while receiving the force applied by the first tension spring 112. Therefore, the roller holding member 110 can slide smoothly. In other words, since the roller 127 does not receive any friction load due to the shift of the roller holding member 110 in the width direction, the roller holding member 110 can rotate and shift smoothly.

It is to be noted that, while the first rotation cam 124 is stopped, the rotation receiver 110*b* is also stopped in the sheet conveying direction, therefore no correction of angular displacement of the sheet P is performed.

The motion of the roller holding member 110 from FIG. 7A to FIG. 7C depicts the flow of the correction of angular displacement of the sheet P. That is, as the first motor 120 is driven to rotate the first rotation cam 124, the lever 125 is pressed by the first rotation cam 124 to rotate in the counterclockwise direction about the support shaft 154*b*.

As a result, the roller holding member 110 is pressed by the roller 127 of the lever 125 at the rotation receiver 110*b*, and rotates in the counterclockwise direction about the support shaft 110*a* at the right end, against the spring force of the first tension spring 112. At this time, the cam followers 126 and 135 move along the outer circumference of the first rotation cam 124 and the outer circumference of the second rotation cam 134 while rotating. Accordingly, a load of movement of the roller holding member 110 to act on the first motor 120 for correction of angular displacement of the sheet P can be reduced.

The motion of the roller holding member 110 from FIG. 7A to FIG. 7D depicts the flow of the combination of correction of lateral displacement of the sheet P and correction of angular displacement of the sheet P. That is, as the first motor 120 is driven to rotate the first rotation cam 124 and the second motor 130 is driven to rotate the second rotation cam 134, the roller holding member 110 performs both the correction of lateral displacement of the sheet P as illustrated in FIG. 7B and the correction of angular displacement of the sheet P as illustrated in FIG. 7C.

As described above, the configuration in the present embodiment includes the roller holding member 110 that is movable in the width direction of the straight sheet conveyance passage K3 and is rotatable about the support shaft 110*a*, with the pair of sheet holding rollers 33 held by the roller holding member 110. With this configuration, the rotation driving force of the rotation variable roller drive motor 140 on the fixed side of the roller holding member 110 is transmitted to the pair of sheet holding rollers 33 via the two-step spline coupling 143. According to this configuration, the rotation variable roller drive motor 140 and the second motor 130 for correction of lateral displacement can be disposed on the fixed side of the roller holding member 110. Therefore, the weight of the device above the roller holding member 110 is reduced, thereby enhancing the responsiveness of correction of angular displacement of the sheet P.

Now, a detailed description of the correction of lateral displacement and the correction of angular displacement is given, with reference to FIGS. 8, 9A, 9B, 10A and 10B.

Figure 8:
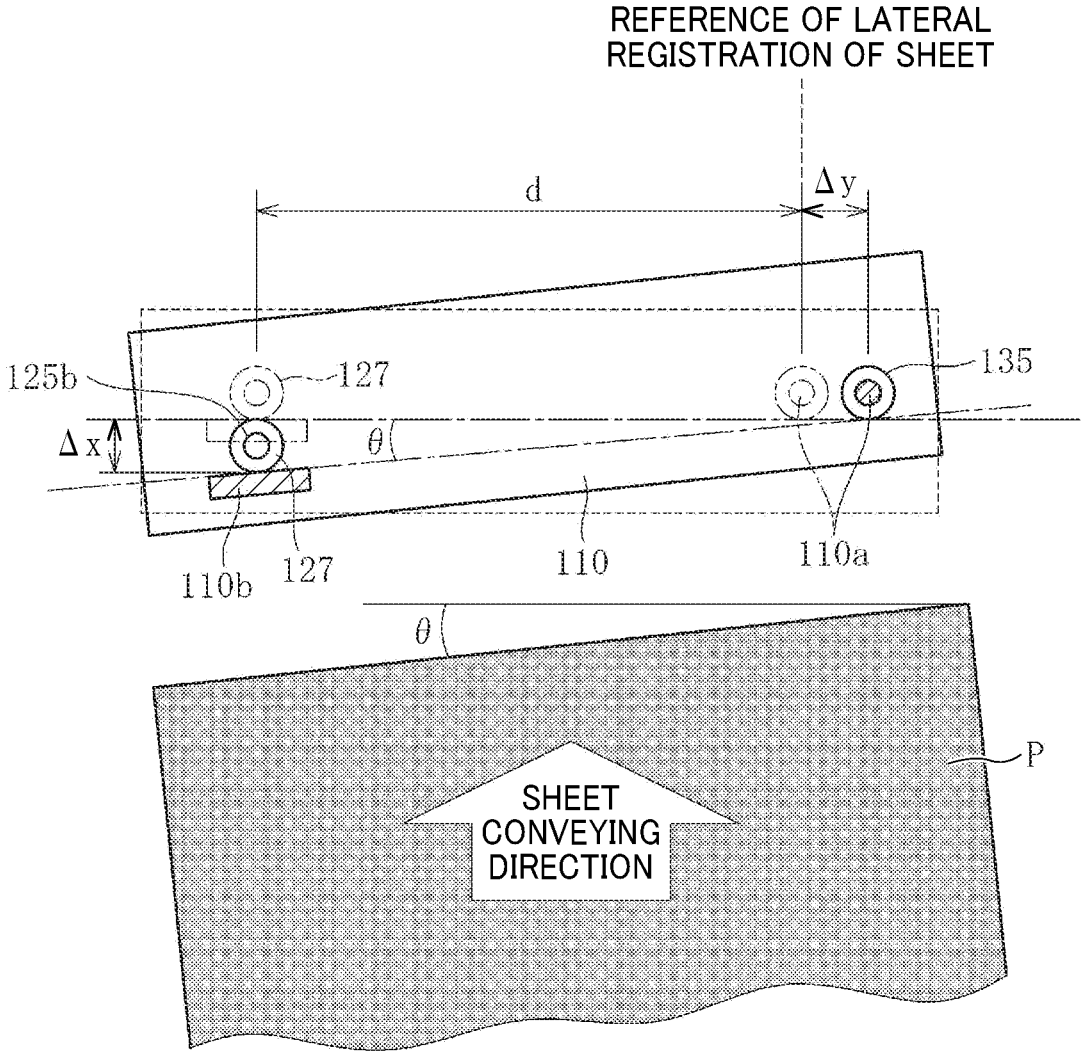
FIG. 8 is a diagram illustrating a lateral displacement amount Δy of the roller holding member and an angular displacement amount Δx of the roller holding member.
Figure 9B:
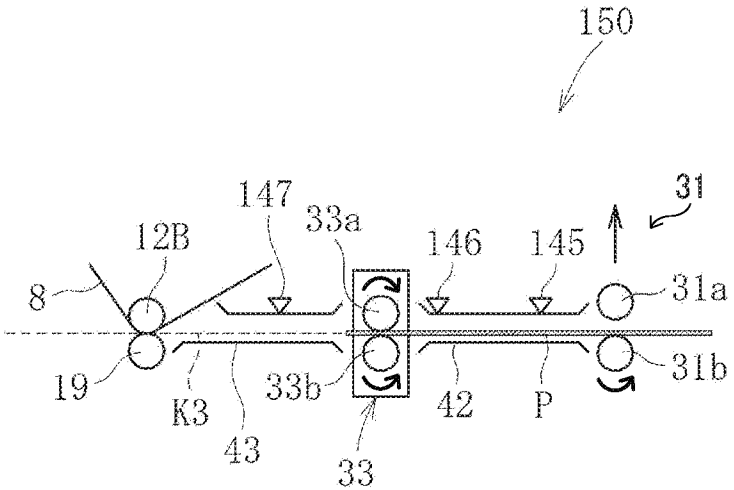
FIG. 9B is a side view illustrating the sheet conveying device before the correction of angular displacement.
Figure 9A:
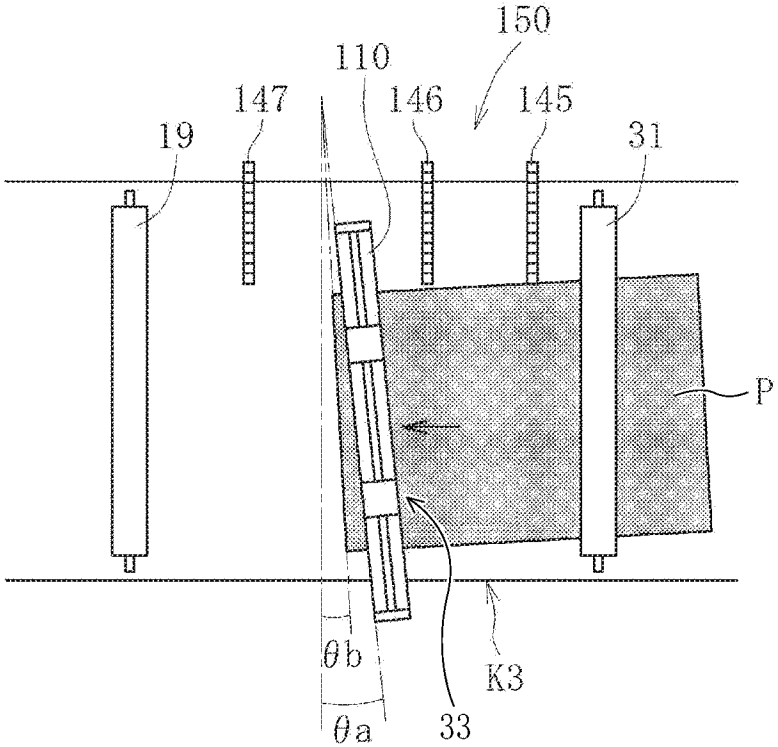
FIG. 9A is a top view illustrating the sheet conveying device having an error in correction of angular displacement of the sheet conveying device before the correction of angular displacement.
Figure 10B:
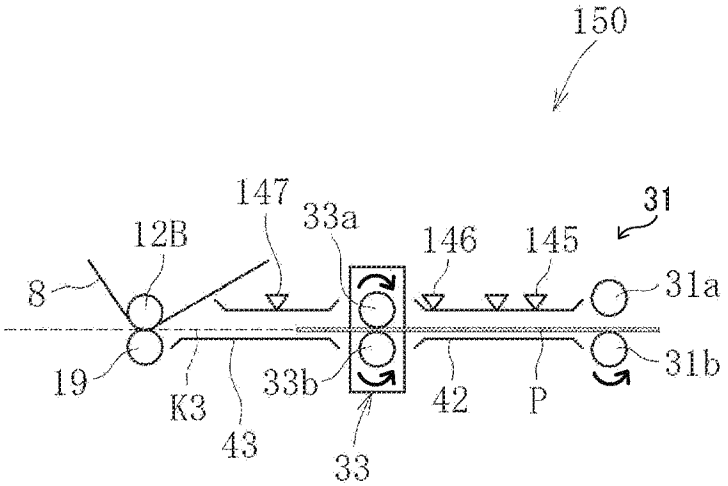
FIG. 10B is a side view illustrating the sheet conveying device after the correction of angular displacement.
Figure 10A:
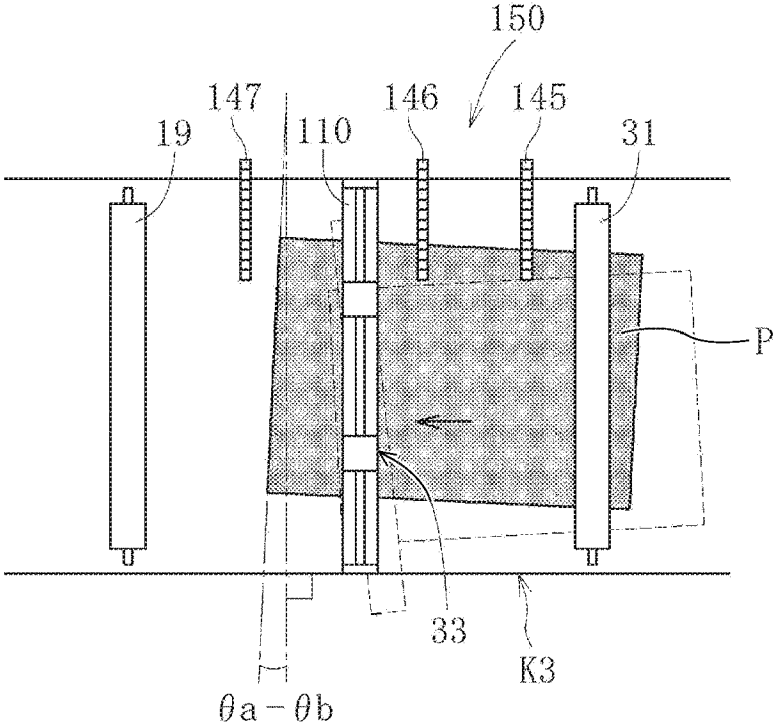
FIG. 10A is a top view illustrating the sheet conveying device having an error in correction of angular displacement of the sheet conveying device after the correction of angular displacement.

FIG. 8 is a diagram illustrating a lateral displacement amount $\Delta y$ of the roller holding member 110 and an angular displacement amount $\Delta x$ of the roller holding member 110. FIG. 9A is a top view illustrating the sheet conveying device 150 having an error in correction of angular displacement of the sheet conveying device 150 before the correction of angular displacement of the sheet P. FIG. 9B is a side view illustrating the sheet conveying device 150 before the correction of angular displacement of the sheet P. FIG. 10A is a top view illustrating the sheet conveying device having an error in correction of angular displacement of the sheet conveying device 150 after the correction of angular displacement of the sheet P. FIG. 10B is a side view illustrating the sheet conveying device 150 after the correction of angular displacement of the sheet P.

In the correction of lateral displacement of the sheet P and the correction of angular displacement of the sheet P described above, as illustrated in FIG. 8, a deviation angle of the sheet P is represented as "θ", a lateral displacement amount of the sheet P is represented as "Δy", a distance between a sheet lateral reference (i.e., the home position of the support shaft 110*a*, that functions as a guide target) and a center of the support shaft 125*b* of the roller 127 that functions as a first pressing portion of the first drive device is represented as "d".

It is to be noted that the lateral displacement amount Δy extends from the sheet lateral reference to the right side of FIG. 8 indicates a plus amount and from the sheet lateral reference to the left side of FIG. 8 indicates a minus amount.

In this case, a forward and backward distance of the rotation receiver 110*b* that moves in the forward and backward direction by the roller 127 is represented as "Δx". Based on a result obtained by calculation with the following Equation (1), the controller 160 controls the first motor 120 for the correction of angular displacement as the first drive device.

$$\Delta x=(d+\Delta y)\tan\theta \qquad \text{Equation (1).}$$

In Equation (1), "Δx" is obtained by not multiplying "tan θ" by "d" but by multiplying "tan θ" by "(d+Δy)". Specifically, as described above, it is rare to perform the motion of correction of lateral displacement of FIG. 7B alone or the motion of correction of angular displacement of FIG. 7C alone. Therefore, the combination of the motion of angular displacement of the sheet P and the motion of lateral displacement of the sheet P, as illustrated in FIG. 7D, is usually performed.

Due to the above-described reasons, in a case in which the roller holding member 110 is moved (to perform the pick up and hold operation) by ignoring the above "Δy" and applying "Δx" that is obtained by Equation (2) described below, the pick up and hold operation is performed by the roller holding member 110 with an excess or insufficient of movement of the roller holding member 110. That is, errors occur in correction of angular displacement associated with correction of lateral displacement.

For example, in a case in which the support shaft 110*a* is shifted to the right by "Δy" for the correction of lateral displacement, as illustrated in FIG. 8, if this shift of the support shaft 110*a* is ignored and the first motor 120 for the correction of angular displacement is driven to move the rotation receiver 110*b* by "Δx", the deviation angle of the sheet P cannot be fully corrected. That is, since the controller 160 calculates the "Δx" using Equation (2) described below, when the amount of movement of the support shaft 110*a* in the pick up and hold operation is too small, if the amount of movement of the support shaft 110*a* in the adjustment and feed operation is same as the amount in the pick up and hold operation, the deviation angle of the sheet P cannot be corrected sufficiently.

$$\Delta x=d^{*}\tan\theta \qquad \text{Equation (2).}$$

By contrast, in a case in which the support shaft 110*a* is shifted to the opposite direction, i.e., the left by Δy for the correction of lateral displacement of the sheet P in FIG. 8, if this shift of the support shaft 110*a* is ignored and the first motor 120 for the correction of angular displacement of the sheet P is driven to move the rotation receiver 110*b* by Δx, the deviation angle of the sheet P is corrected by the excess amount. That is, since the amount of movement of the support shaft 110*a* in the pick up and hold operation is too great, when the amount of movement of the support shaft 110*a* in the adjustment and feed operation is same as the amount in the pick up and hold operation, the deviation angle of the sheet P is corrected by the excess amount.

As described above, FIGS. 9A, 9B, 10A and 10B illustrate the states in which the support shaft 110*a* is shifted to the left by Δy for the correction of lateral displacement of the sheet P, resulting in the correction of the deviation angle of the sheet P by the excess amount. Specifically, after the pick up and hold operation is performed not rotating by a deviation angle θb but by rotating by the deviation angle θa, as illustrated in FIG. 9A, the adjustment and feed operation is performed while the sheet P is being held by the pair of sheet holding rollers 33, as illustrated in FIG. 10A. By so doing, the front of the leading end of the sheet P is displaced by an angle (θa-θb). Due to the above-described reasons, in the present embodiment of this disclosure, the first motor 120 for correction of angular displacement is controlled based on the result obtained using Equation (1).

Flowchart.

Next, a description is given of operations of the sheet conveying device 150 according to the above-described present embodiment, with reference to a flowchart of FIG. 11 together with drawings of FIGS. 12A through 18B.

Figure 12A:
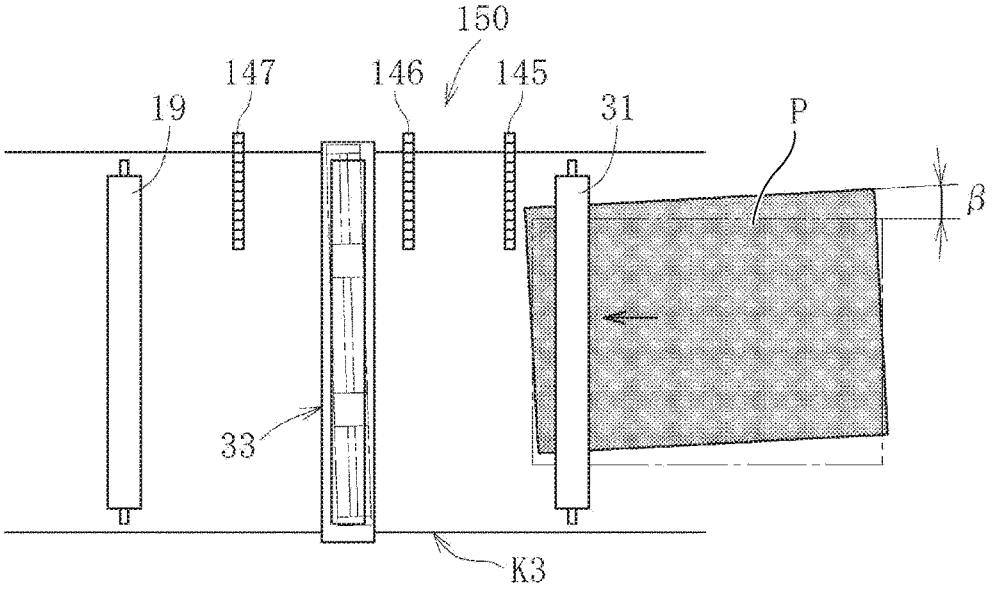
FIGS. 12A and 12B are top views illustrating a first stage of sheet conveyance in the sheet conveying device.
Figure 12B:
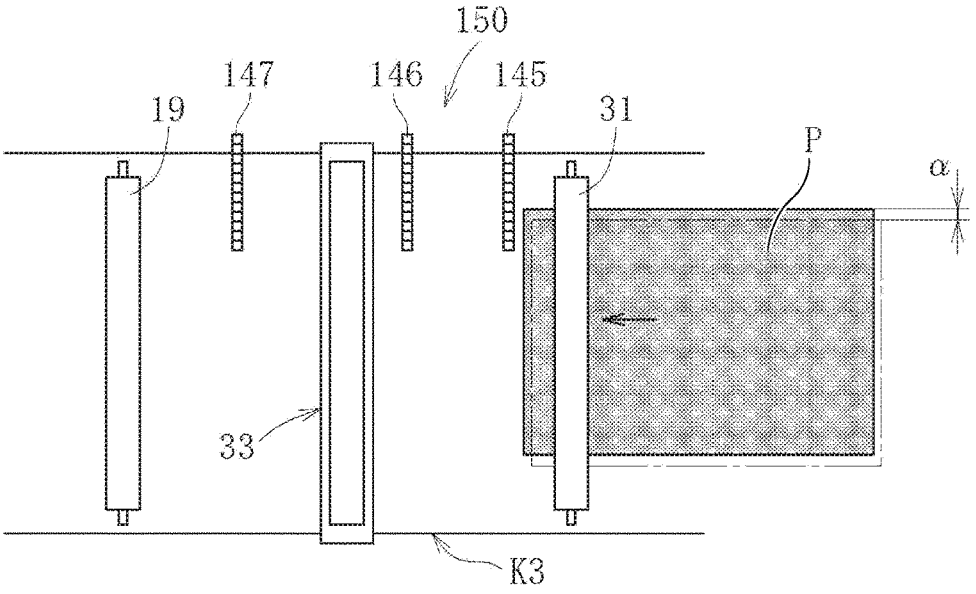
Figure 12C:
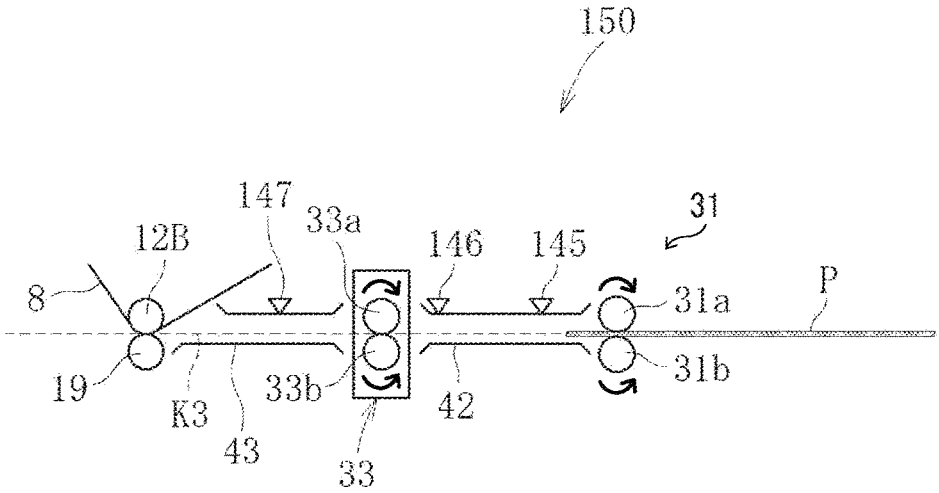
FIG. 12C is a side view illustrating the first stage of the sheet conveyance in the sheet conveying device.
Figure 13B:
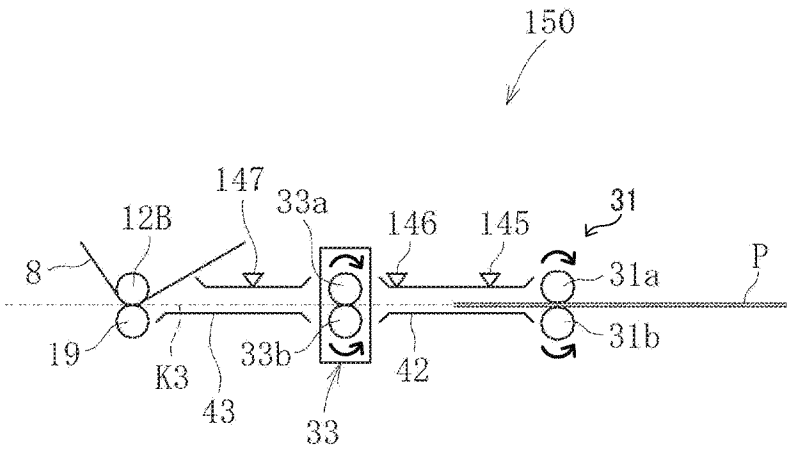
FIG. 13B is a side view illustrating the second stage of the sheet conveyance in the sheet conveying device.
Figure 13A:
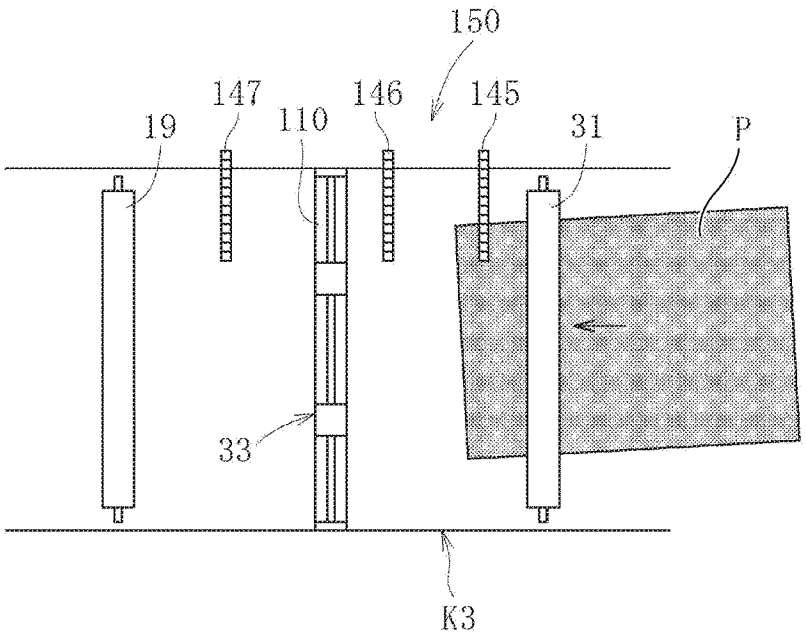
FIG. 13A is a top view illustrating a second stage of the sheet conveyance in the sheet conveying device.
Figure 14B:
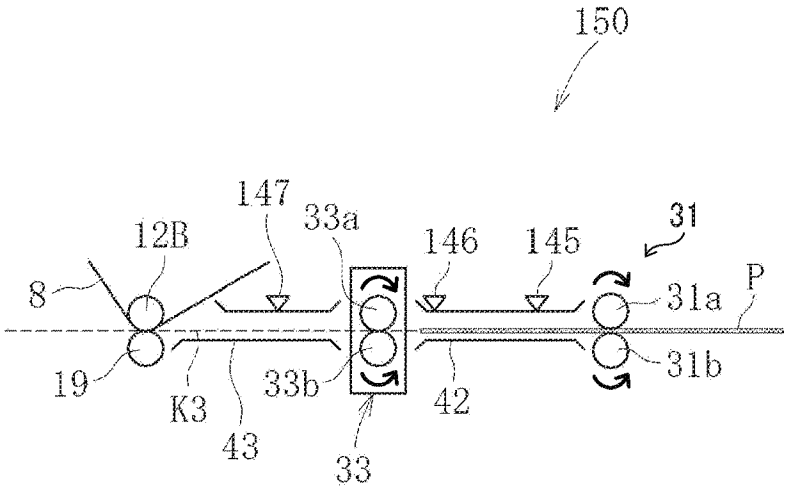
FIG. 14B is a side view illustrating the third stage of the sheet conveyance in the sheet conveying device.
Figure 14A:
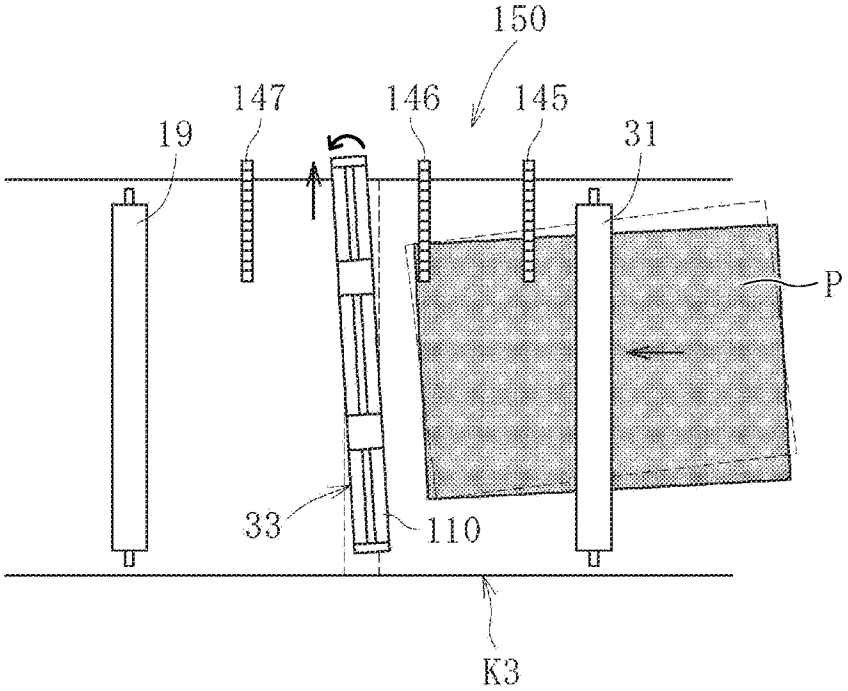
FIG. 14A is a top view illustrating a third stage of the sheet conveyance in the sheet conveying device.
Figure 15B:
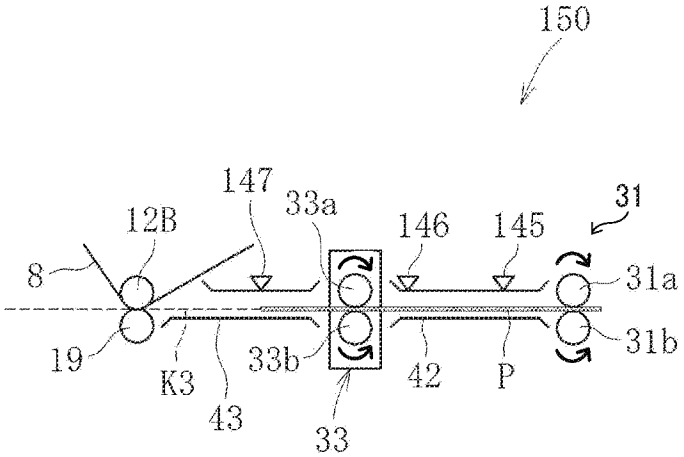
FIG. 15B is a side view illustrating the fourth stage of the sheet conveyance in the sheet conveying device.
Figure 15A:
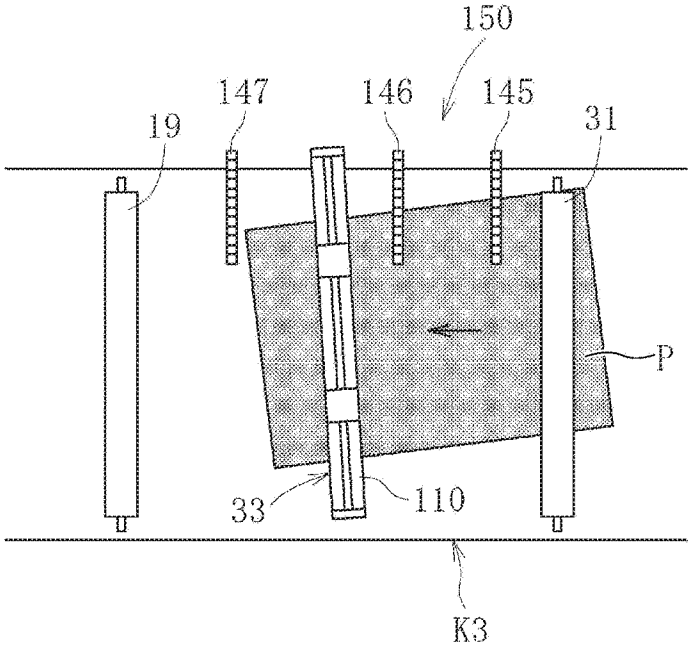
FIG. 15A is a top view illustrating a fourth stage of the sheet conveyance in the sheet conveying device.
Figure 16B:
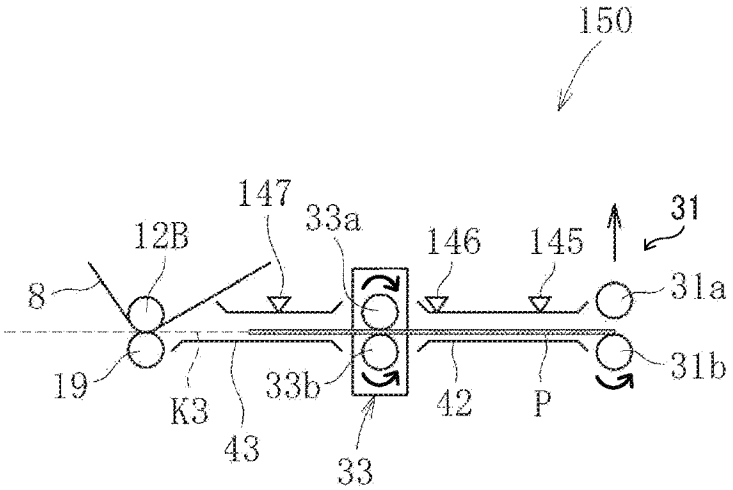
FIG. 16B is a side view illustrating the fifth stage of the sheet conveyance in the sheet conveying device.
Figure 16A:
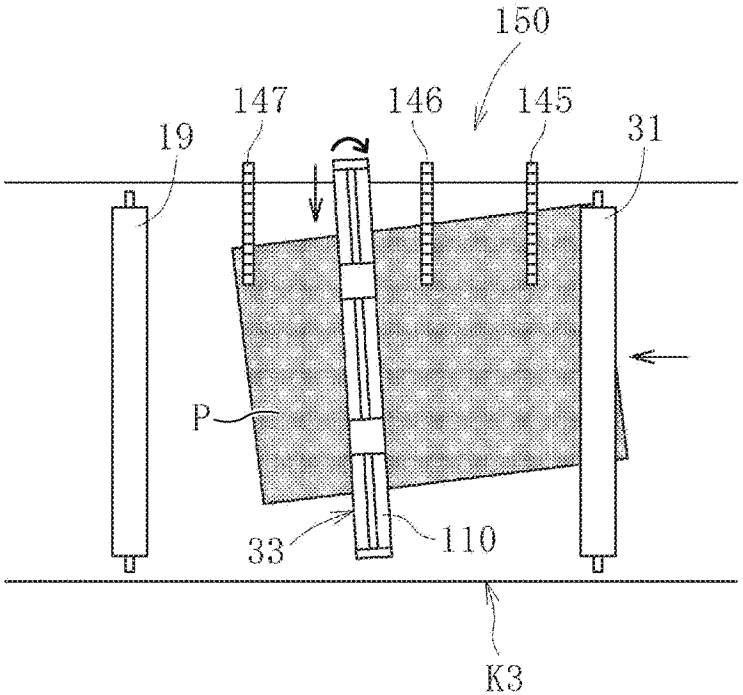
FIG. 16A is a top view illustrating a fifth stage of the sheet conveyance in the sheet conveying device.
Figure 17B:
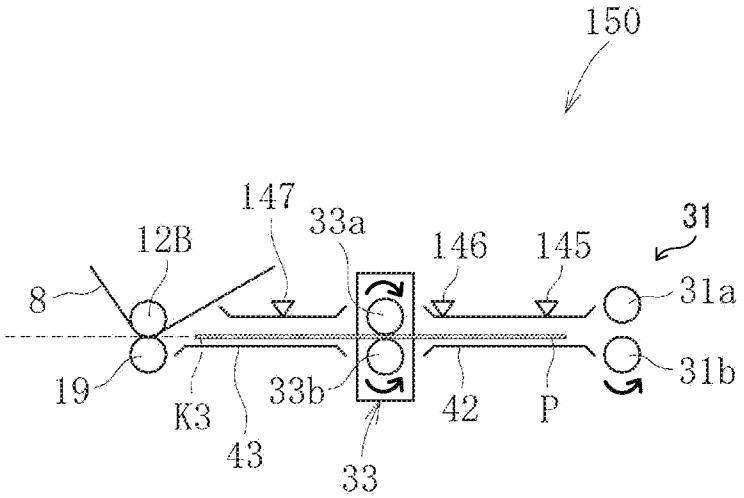
FIG. 17B is a side view illustrating the sixth stage of the sheet conveyance in the sheet conveying device.
Figure 17A:
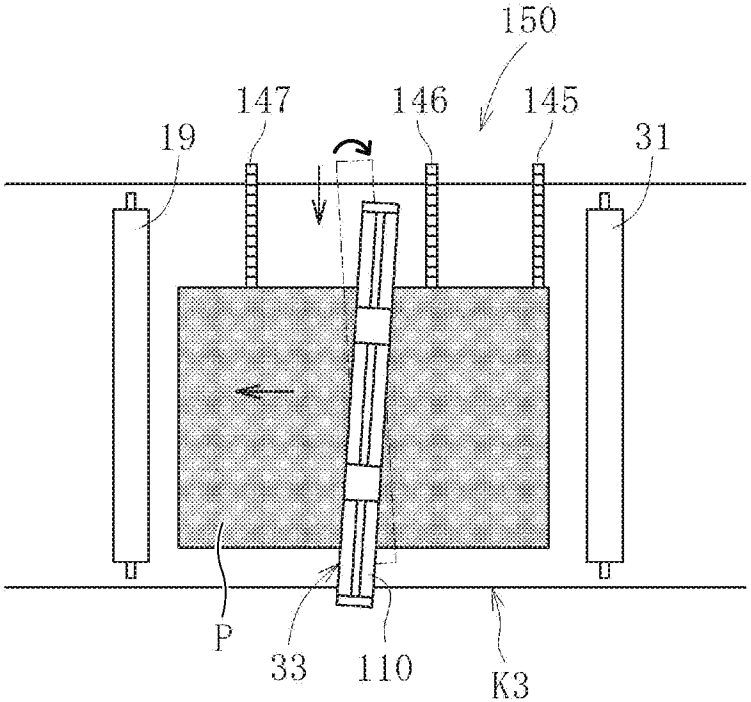
FIG. 17A is a top view illustrating a sixth stage of the sheet conveyance in the sheet conveying device.
Figure 18B:
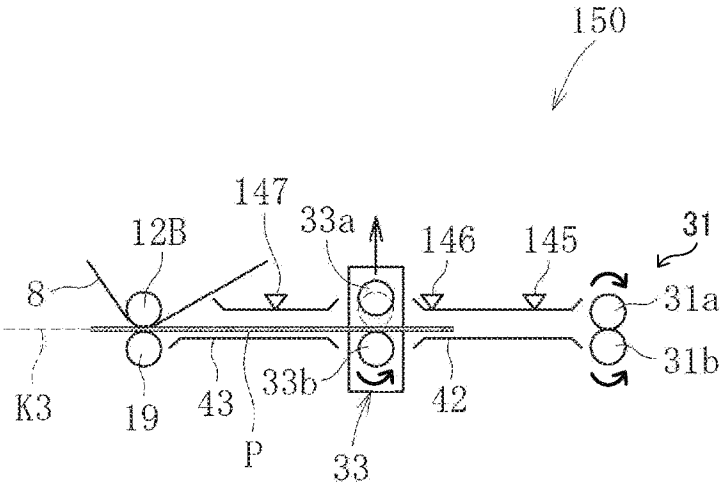
FIG. 18B is a side view illustrating the seventh stage of the sheet conveyance in the sheet conveying device.
Figure 18A:
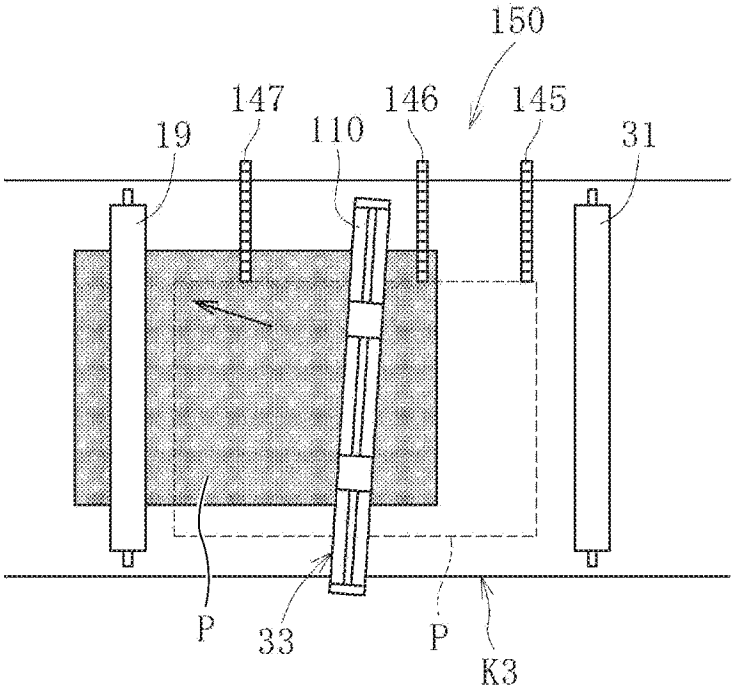
FIG. 18A is a top view illustrating a seventh stage of the sheet conveyance in the sheet conveying device.
Figure 19B:
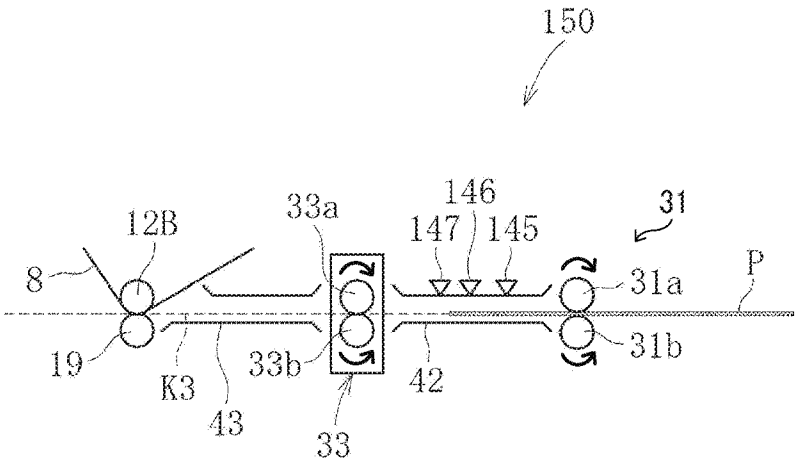
FIG. 19B is a side view illustrating the sheet conveying device of FIG. 19A.
Figure 19A:
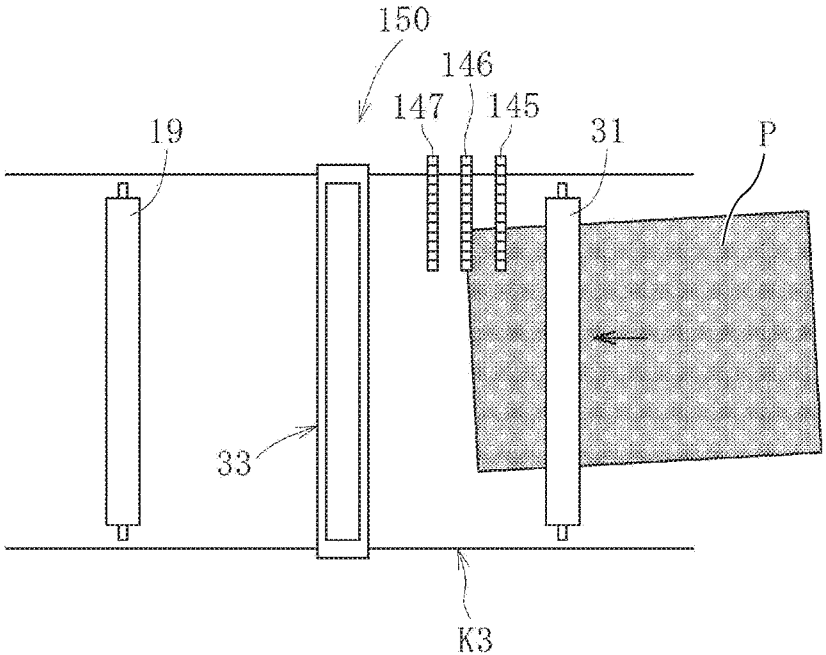
FIG. 19A is a top view illustrating the sheet conveying device according to Variation 1, in which three CISs are aligned in parallel to each other, before detection of positional deviation.

FIG. 11 is a flowchart of correction operations of the sheet conveying device 150. FIGS. 12A and 12B are top views illustrating a first stage of sheet conveyance in the sheet conveying device 150. FIGS. 12A, 12B and 12C illustrate a first stage of sheet conveyance in the sheet conveying device 150. FIGS. 13A and 13B illustrate a second stage of the sheet conveyance in the sheet conveying device 150. FIGS. 14A and 14B illustrate a third stage of the sheet conveyance in the sheet conveying device 150. FIGS. 15A and 15B illustrate a fourth stage of the sheet conveyance in the sheet conveying device 150. FIGS. 16A and 16B illustrate a fifth stage of the sheet conveyance in the sheet conveying device 150. FIGS. 17A and 17B illustrate a sixth stage of the sheet conveyance in the sheet conveying device 150. FIGS. 18A and 18B illustrate a seventh stage of the sheet conveyance in the sheet conveying device 150.

In step S1, the controller 160 turns on the first motor 120 for correction of angular displacement, the second motor 130 for correction of lateral displacement, and the rotation variable roller drive motor 140.

Then, in step S2, the position of the pair of sheet holding rollers 33 (in the width direction of the sheet P and in the direction of rotation of the sheet P) is initialized, that is, the roller holding member 110 returns to the home position.

As the sheet P is conveyed by the pair of sheet conveying rollers 31 from the right side to the left side, as illustrated in FIGS. 13A, 13B, 14A and 14B, a primary detection is performed in step S3. In the primary detection, the first CIS 145 and the second CIS 146 detect the first positional deviation amount SF1 (i.e., the first deviation angle θ1 and the first lateral displacement amount δ1) of the sheet P. Then, in step S4, based on the first deviation angle θ1 and the first lateral displacement amount δ1 obtained through the primary detection, the first motor 120 for correction of angular displacement and the second motor 130 for correction of lateral displacement perform the pick up and hold operation (a pick up and hold control). Accordingly, the pair of sheet holding rollers 33 performs the pick up and hold operation by moving from a position indicated by a broken line to a position indicated by a solid line, as illustrated in FIG. 14A.

Then, after the above-describe pick up and hold operation, the pair of sheet holding rollers 33 holds the leading end of the sheet P, in step S5 (see FIGS. 15A and 15B). Accordingly, after holding the leading end of the sheet P in the pick up and hold operation, the pair of sheet holding rollers 33 conveys the sheet P.

Then, a secondary detection is performed in step S6. In the secondary detection, the first CIS 145 and the second CIS 146 detect the second positional deviation amount SF2 (i.e., the second deviation angle θ2 and the second lateral displacement amount δ2) of the sheet P.

Then, as illustrated in FIGS. 16A, 16B, 17A and 17B, while the pair of sheet holding rollers 33 is holding the sheet P, the first motor 120 for correction of angular displacement and the second motor 130 for correction of lateral displacement perform the adjustment and feed operation (an adjust and feed control), based on the second deviation angle θ2 and the second lateral displacement amount δ2 obtained through the secondary detection, in step S7.

As described above, in the present embodiment, the first CIS 145 and the second CIS 146 function as a first detector to detect the position of the sheet P for the pick up and hold operation and, at the same time, function as a second detector to detect the position of the sheet P again after the primary detection, for the adjustment and feed operation.

In a case in which the detection result of the first detection (the primary detection) is identical to the detection result of the second detection (the secondary detection) and there is no difference in the amount of positional deviation between the first detection (the primary detection) and the second detection (the secondary detection), the adjustment and feed operation that compensate the first positional deviation amount SF1 continues. However, even while the pair of sheet holding rollers 33 is holding and conveying the sheet P, the deviation angle and the lateral displacement amount may further change due to fluttering of the sheet P and error in precision of dimension of the pair of sheet holding rollers 33. Therefore, the adjustment and feed operation along with a feedback control in step S7 is performed to enhance the correction precision.

Therefore, the correction of angular displacement of the sheet P and the correction of lateral displacement of the sheet P are performed based on the amount of positional deviation (i.e., the second positional deviation amount SF2) obtained through the second detection (the secondary detection). Accordingly, even when the amount of positional deviation of the sheet P is changed between step S3 and step S6, that is, between the primary detection and the secondary detection, the angular displacement of the sheet P and the lateral displacement of the sheet P, including the above-described amount of positional deviation, can be corrected.

Thereafter, as illustrated in FIGS. 17A and 17B, in a state in which the leading end of the sheet P reaches the third CIS 147, the second CIS 146 and the third. CIS 147 performs a tertiary detection to detect the side end of the sheet P, in step S8. Accordingly, a third positional deviation amount SF3 (i.e., a third deviation angle θ3 and a third lateral deviation amount δ3) is detected. Then, while the pair of sheet holding rollers 33 is holding and conveying the sheet P, the pair of sheet holding rollers 33 is controlled in step S9 based on the detection result of the tertiary detection. By so doing, the correction of angular displacement of the sheet P and the correction of lateral displacement of the sheet P are performed.

It is to be noted that the third detection performed by the second CIS 146 and the third CIS 147 may be performed by multiple times before the leading end of the sheet P reaches the secondary transfer roller 19 disposed downstream from the second CIS 146 and the third CIS 147 in the sheet conveying direction. In this case, the pair of sheet holding rollers 33 is controlled frequently based on the amount of positional deviation obtained by the results of the multiple detections, and therefore the positional deviation can be eliminated with higher accuracy.

Accordingly, as illustrated in FIGS. 18A and 18B, the position of the sheet P is corrected to the right position.

Hereinafter, by repeating the same operations as described above, the sheet P after completion of the correction of the angular displacement and the correction of the lateral displacement performed with high accuracy is fed from the straight sheet conveyance passage K3.

Corrections of Lateral Displacement and Angular Displacement of Sheet During Sheet Conveyance.

Next, a description is given of operations in correction of the lateral displacement and the angular displacement while the sheet P is being conveyed by the pair of sheet conveying rollers 31 and the pair of sheet holding rollers 33, with reference to FIGS. 12A through 18B.

FIG. 12A illustrates a state in which the sheet P is fed before the first CIS 145 while the sheet P has the angular displacement.

A broken line in FIG. 12A indicates a regular reference position of the sheet P without any angular and lateral displacements. By contrast to the reference position, a solid line in FIG. 12A indicates a position of the sheet P having angular displacement by an angle β in the counterclockwise direction.

FIG. 12B illustrates a state in which the sheet P is fed before the first GIS 145 while the sheet P has lateral displacement with no angular displacement. A broken line in FIG. 12B indicates the regular reference position of the sheet P without any angular and lateral displacements. By contrast to the reference position, a solid line in FIG. 12B indicates a position of the sheet P having lateral displacement by a lateral displacement amount α in an upward direction (to the right side toward the sheet conveying direction).

As the right end of the sheet P is detected by the first CIS 145 as illustrated in FIGS. 13A and 13B, the lateral displacement amount α of the sheet P is detected.

Further, the lateral displacement amount of the sheet P having the angular displacement as illustrated in FIG. 12A is calculated as the lateral displacement amount β in a case in which there is no angular displacement, based on the detection result of the first CIS 145 and the second CIS 146. The lateral displacement amount α is calculated by the controller 160.

Next, when the side end of the sheet P comes to the first CIS 145 and the second CIS 146 as illustrated in FIGS. 13A and 13B, the first lateral displacement amount SF1 (i.e., the first deviation angle θ1 and the first lateral displacement amount δ1) of the sheet P having the angular displacement and the lateral displacement is detected (the primary detection). Consequently, the pair of sheet holding rollers 33 is driven based on the first positional deviation amount SF1 (a first drive), and the pair of sheet holding rollers 33 performs the pick up and hold operation by moving from the position of the broken line to the position of the solid line.

The sheet P depicted with the broken line in FIG. 14A indicates the state in which the amount of positional deviation of the sheet P (i.e., the deviation angle of the sheet P in FIG. 14A) is changed immediately after the detection of the first positional deviation amount SF1. Accordingly, if the amount of positional deviation of the sheet P is changed, even when the pair of sheet holding rollers 33 is caused to perform the pick up and hold control based on the first positional deviation amount SF1 (i.e., the first deviation angle θ1 and the first lateral displacement amount δ1) and then perform the adjust and feed control to compensate the amount of positional deviation, the sufficient correction precision cannot be achieved.

Of the changes of the amount of positional deviation, the change of the angular displacement occurs due to a deviation in pressure of the right side and the left side of a pressure spring of the pair of sheet conveying rollers 31 and a difference in conveying speed of the right side and the left side caused by the deviation of diameter of a roller by a roller part error. Further, the change of the lateral displacement occurs sheet conveyance with angular displacement of the sheet P due to out-of-squareness in assembly of the pair of sheet conveying rollers 31 (that is, a degree not in parallel to the registration mechanism).

Further, after the detection of the first positional deviation amount SF1, as illustrated in FIGS. 15A and 15B, when the sheet P is held and conveyed by the pair of sheet holding rollers 33, the deviation angle and the lateral displacement amount may further change due to fluttering of the sheet P and error in precision of dimension of the pair of sheet holding rollers 33.

In order to address this inconvenience, in the present embodiment, as illustrated in FIGS. 15A and 15B, the first CIS 145 and the second CIS 146 detect the leading end of the sheet P again at a time after the leading end of the sheet P is held by the pair of sheet holding rollers 33 and before the sheet P reaches the secondary transfer roller 19. Accordingly, the second positional deviation amount SF2 (i.e., the second deviation angle θ2 and the second lateral deviation amount δ2) is detected (i.e., the secondary detection).

Then, based on the second positional deviation amount SF2, as illustrated in FIG. 16A to FIG. 17B, the pair of sheet holding rollers 33 is rotated together with the sheet P being held thereby, in a direction opposite the pick up and hold operation (the first drive), so as to perform the adjustment and feed operation. This operation is referred to as a second drive. In the adjustment and feed operation, the controller 160 controls the drive device (i.e., the first motor 120 and the second motor 130) to perform the adjust and feed control by the feedback control, so as to cancel the second deviation angle θ2 and the second lateral displacement amount δ2.

Here, when the first positional deviation amount SF1 detected by the first detection (the primary detection) and the second positional deviation amount SF2 detected by the second detection (the secondary detection) are the same as each other, the amount of drive of the pick up and hold operation (the first drive) and the amount of drive of the adjustment and feed operation (the second drive) are also the same as each other. By contrast, when the first positional deviation amount SF1 and the second positional deviation amount SF2 are different from each other, the amount of drive of the pick up and hold operation (the first drive) and the amount of drive of the adjustment and feed operation (the second drive) become different from each other.

Accordingly, even when the amount of positional deviation of the sheet P is changed between the first detection, in which the pick up and hold operation is determined, and the second detection, the pair of sheet holding rollers 33 is caused to perform the adjust and feed control based on the amount of positional deviation obtained through the secondary detection (i.e., the second positional deviation amount SF2), the deviation angle of the sheet P and the lateral displacement amount of the sheet P can be corrected by performing the adjust and feed operation.

In response to the motion in which the pair of sheet holding rollers 33 holds the leading end of the sheet P in the nip region, the driven roller 31*a* of the pair of sheet conveying rollers 31 moves upwardly to separate from the drive roller 31*b* of the pair of sheet conveying rollers 31, and therefore the upstream end of the sheet P is opened, as illustrated in FIG. 16B.

It is to be noted that, even after the angular displacement of the sheet P is corrected as illustrated in FIGS. 17A and 17B, the axial direction of the pair of sheet holding rollers 33 is generally displaced obliquely by a certain angle from a direction perpendicular to the sheet conveying direction.

In order to prevent occurrence of the lateral displacement of the sheet P due to the angular displacement of the sheet P associated to this oblique attitude, the pair of sheet holding rollers 33 may be shifted to the position illustrated in FIGS. 17A and 17B. Specifically in order to fully cancel the lateral displacement amount of the sheet P at the time the leading end of the sheet P reaches the secondary transfer roller 19 as illustrated in FIGS. 18A and 18B, the pair of sheet holding rollers 33 is shifted to the position illustrated in FIGS. 17A and 17B while performing the adjustment and feed operation from FIG. 16A to FIG. 17B, by including an expected lateral displacement amount caused by the angular displacement of the sheet P.

As illustrated in FIGS. 17A and 17B, after the leading end of the sheet P has reached the third CIS 147, the second CIS 146 and the third CIS 147 further detect the side end of the sheet P one or more times (i.e., the third detection). Accordingly, the third positional deviation amount SF3 (i.e., the third deviation angle θ3 and the third lateral deviation amount δ3) is detected.

Then, before the leading end of the sheet P reaches the secondary transfer roller 19 that is disposed downstream from the pair of sheet holding rollers 33 in the sheet conveying direction, the controller 160 causes the pair of sheet holding rollers 33 to perform the feedback control based on the amount of positional deviation (i.e., the third positional deviation amount SF3) obtained through the tertiary detection, so that the pair of sheet holding rollers 33 is shifted in the width direction of the sheet P or is rotated in the sheet conveying surface. Accordingly, the deviation angle of the sheet P and the lateral displacement amount of the sheet P generated after the adjustment and feed operation can be corrected.

Thereafter, as illustrated in FIGS. 17A, 17B, 18A and 18B, the pair of sheet holding rollers 33 holds and conveys the sheet P to forward the sheet P to the secondary transfer roller 19. By so doing, the sheet P is adjusted to the correct position, and the sheet P with the correction of angular displacement and lateral displacement having been performed with high accuracy is fed from the straight sheet conveyance passage K3.

Accordingly, while being conveyed as described above, the correction of angular displacement and lateral displacement of the sheet is performed simultaneously. Further, the time at which the leading end of the sheet P reaches the image forming portion of the sheet P (the secondary transfer nip region) of the secondary transfer roller 19 is adjusted based on the number of rotations of the pair of sheet holding rollers 33 (i.e., correction of the sheet conveyance speed deviation).

After the trailing end of the sheet P has been passed the pair of sheet conveying rollers 31 as illustrated in FIGS. 17A through 18B, the nip region of the pair of sheet conveying rollers 31 is closed to prepare for conveyance of a subsequent sheet P. On arrival of the leading end of the sheet P at the image forming portion of the sheet P (i.e., the secondary transfer nip region) of the secondary transfer roller 19, a contact and separation motor 170 (see FIG. 5A) causes the pair of sheet holding rollers 33 to open. According to this operation, an image formed on the intermediate transfer belt 8 is transferred onto the sheet P at a desired position, while the sheet P is being conveyed in the image forming portion of the sheet P (i.e., the secondary transfer nip region).

It is to be noted that the conveying speed of the pair of sheet holding rollers 33 is adjusted, so that no distortion of an image formed on the sheet P is generated due to a linear velocity difference generated between the pair of sheet holding rollers 33 and the intermediate transfer belt 8 immediately after the arrival of the leading end of the sheet P to an image forming portion (i.e., the secondary transfer roller 19 in this case).

Image Forming Program.

The image forming apparatus 100 described above performs an image forming operation following the flowchart of FIG. 11, according to a dedicated device configuration. In addition, by generating an executive program (an image formation program) to execute the processes of the flowchart of FIG. 11 in a computer and installing the executive program in a general use image forming apparatus, for example, image forming operations including the operation in the flowchart of FIG. 11 can be performed easily.

The executive program to be installed in the computer can be provided via a storage medium such as a CD-ROM. In this case, the storage medium that stores the executive program is set in a drive device of a computer, where the executive program stored in the storage medium is output from the storage medium and installed to an auxiliary storage included in the computer via the drive device.

It is to be noted that the storage medium is not limited to a CD-ROM but to various types of storage media. For example, any storage medium that optically, electrically or magnetically stores data such as a flexible disk and a magneto-optical disk and any semiconductor memory that electrically stores data such as a read only memory (ROM) and a flash memory.

Further, the computer includes a network connection device capable of connecting to a communication network to acquire an executive programs from any other computer connected to the communication network and execute the acquired program. By so doing, the execution result obtained through the program execution and the set of the executive program according to this disclosure can be provided to other computers.

It is to be noted that the auxiliary storage provided to the computer is a storage device such as a hard disk, and therefore can store the executive program of this disclosure and control programs in the computer and occasionally input and output the programs.

Further, the computer includes a memory that stores an executive program read from the auxiliary storage by the central processing unit (CPU). It is to be noted that the memory includes a read only memory (ROM) and a random access memory (RAM).

Further, the computer include the CPU to control the entire processing of the computer and execute the processes such as various calculations, input and output of data between the devices, based on the control program such as an operating system (OS) and the executive program. Accordingly, the image forming apparatus 100 can perform the image formation processes at low cost without adding any special device configuration.

Further, by installing the programs, the image formation processes can be achieved easily.

Variations of CIS Arrangements.

Variation 1.

Now, a description is given of an arrangement of the CISs according to Variation 1, with reference to FIGS. 19A through 22B. In Variation 1, the first CIS 145, the second CIS 146 and the third CIS 147 are aligned in parallel to each other, between the pair of sheet conveying rollers 31 and the pair of sheet holding rollers 33. It is to be noted that the first CIS 145, the second CIS 146 and the third CIS 147 are aligned at equal intervals but the arrangement of the CIS is not limited thereto.

In Variation 1, the first CIS 145, the second CIS 146 and the third OS 147 disposed parallel to each other detect the respective positions of the side end of the sheet P, so as to detect the amount of lateral displacement and the deviation angle based on the detection results. It is to be noted that a relative distance between the first CIS 145 and the second CIS 146 is indicated by a small letter "a", as explained with reference to FIGS. 37A and 37B.

In the present embodiment described above, the first CIS 145 and the second CIS 146 function as a first detector to detect the position of the sheet P for the pick up and hold operation and as a second detector to detect the position of the sheet P again after the primary detection, for the adjustment and feed operation. The configuration of Variation 1 is different from the configuration of the above-described present embodiment, in which the second CIS 146 and the third CIS 147 function as the second detector. To be more specific, the first CIS 145 and the second CIS 146 detect the sheet P in the pick up and hold operation of the pair of sheet holding rollers 33 in the operations from FIG. 19A to FIG. 20B (i.e., the primary detection), and the first motor 120 for correction of angular displacement performs the pick up and hold operation such that the axial direction of the pair of sheet holding rollers 33 extends in a direction perpendicular to an extension line of the side end of the sheet P in the primary detection.

To be more specific, the first CIS 145 and the second CIS 146 detect the sheet P in the pick up and hold operation of the pair of sheet holding rollers 33 in the operations from FIG. 19A to FIG. 20B (i.e., the primary detection), and the first motor 120 for correction of angular displacement performs the pick up and hold operation such that the axial direction of the pair of sheet holding rollers 33 extends in a direction perpendicular to an extension line of the side end of the sheet P in the primary detection.

Figure 20B:
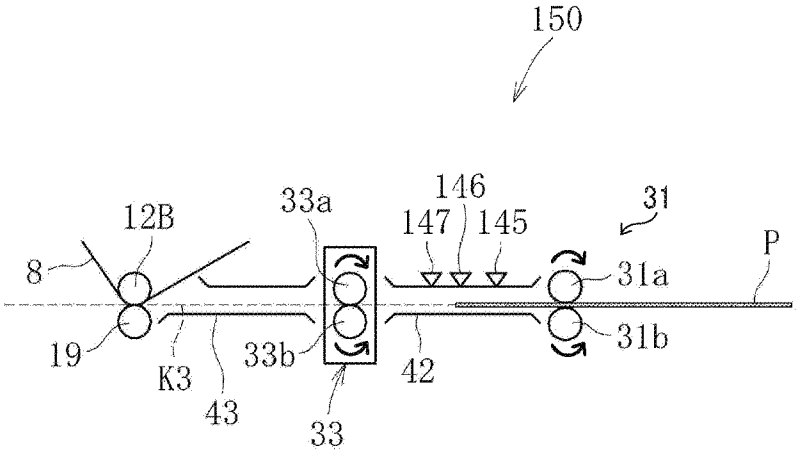
FIG. 20B is a side view illustrating the sheet conveying device of FIG. 20A.
Figure 20A:
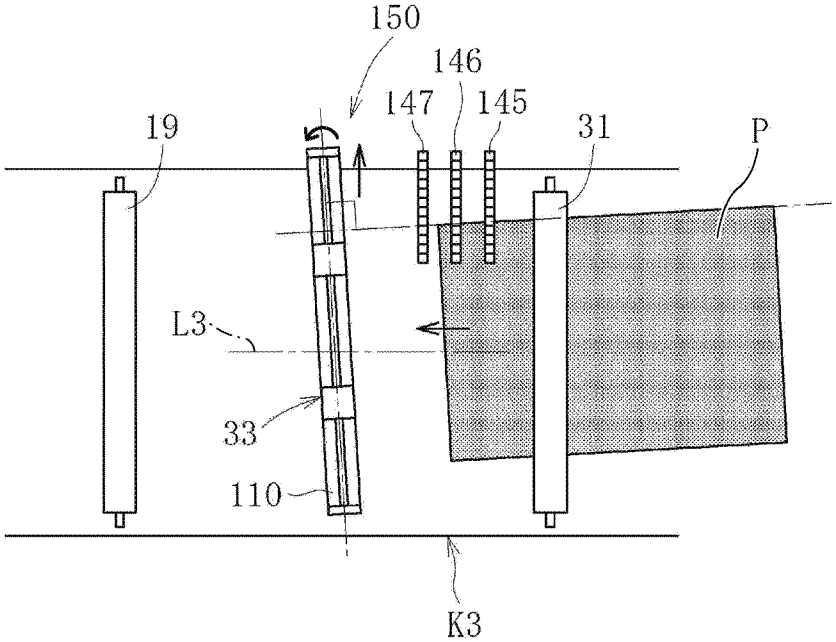
FIG. 20A is a top view illustrating the sheet conveying device according to Variation 1, in which three CISs are aligned in parallel to each other, after a first detection of positional deviation and a pick up and hold operation.

Based on the detection results obtained by the detection by the first CIS 145 and the second CIS 146 (i.e., the first detection), the controller 160 calculates the amount of lateral displacement of the sheet P in a case in which there is no directional error (angular displacement) of the side end of the sheet P. Thereafter, the second motor 130 for the correction of lateral displacement performs the pick up and hold operation in response to the lateral displacement amount of the sheet P. FIGS. 20A and 20B illustrate the state of the above-described pick up and hold operation.

Figure 21B:
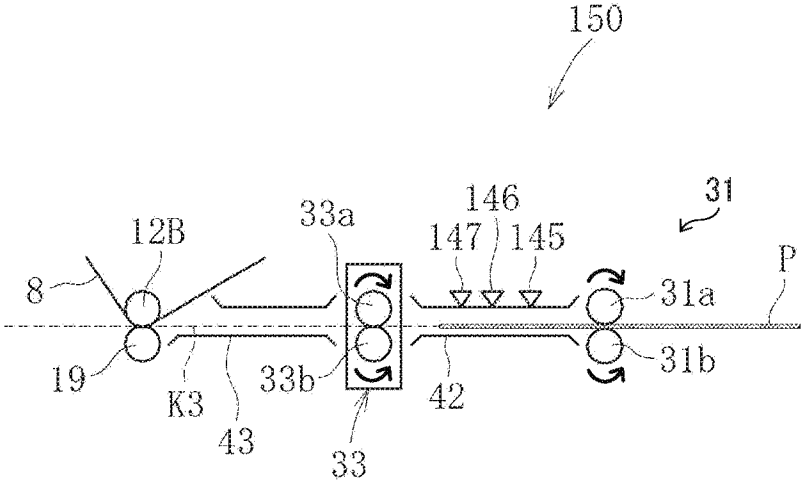
FIG. 21B is a side view illustrating the sheet conveying device of FIG. 21A.
Figure 21A:
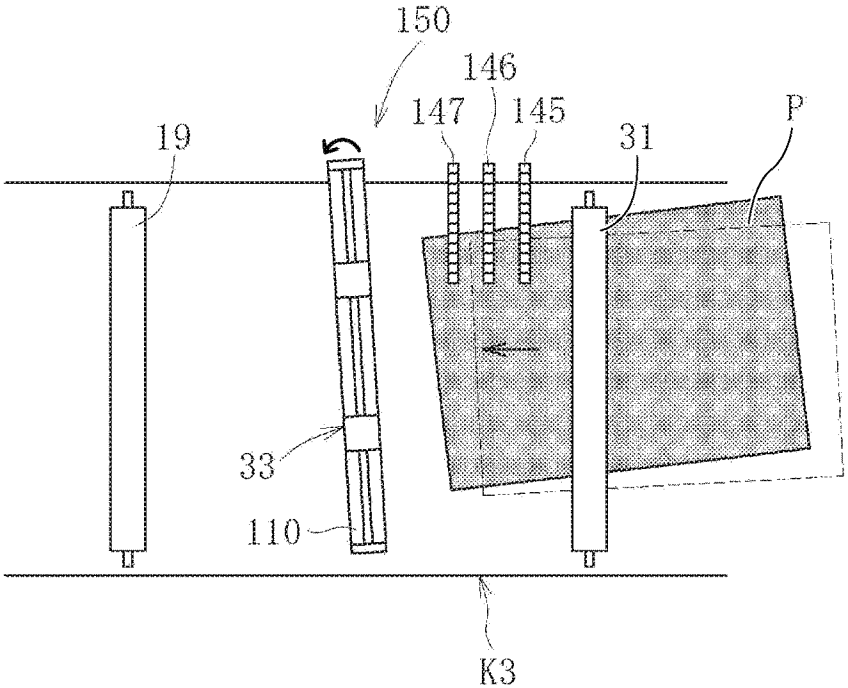
FIG. 21A is a top view illustrating the sheet conveying device according to Variation 1, in which three CiSs are aligned in parallel to each other, after a second detection of positional deviation and before a feed back correction.

Subsequently, the side end of the sheet P comes to the third CIS 147 as illustrated in FIGS. 21A and 21B. However, the lateral displacement amount of the sheet P and the deviation angle of the sheet P may change from the state of the pick up and hold operation illustrated in FIGS. 20A and 20B. In other words, the position of the sheet P changes from the position indicated by a broken line in FIG. 21A to the position indicated by a solid line in FIG. 21A.

Figure 22B:
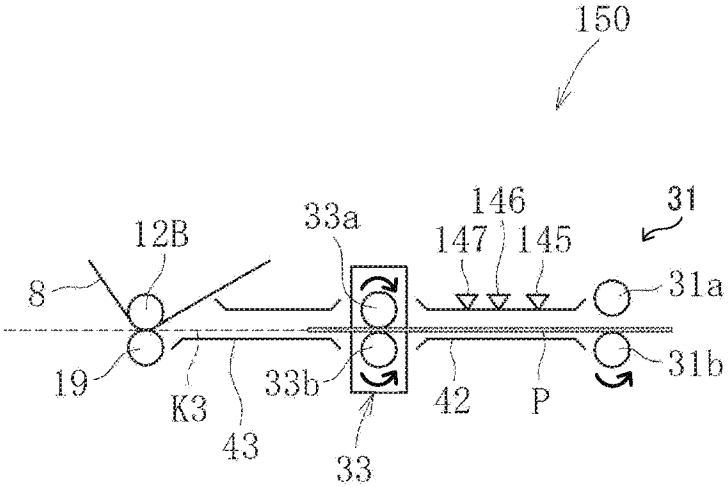
FIG. 22B is a side view illustrating the sheet conveying device of FIG. 22A.
Figure 22A:
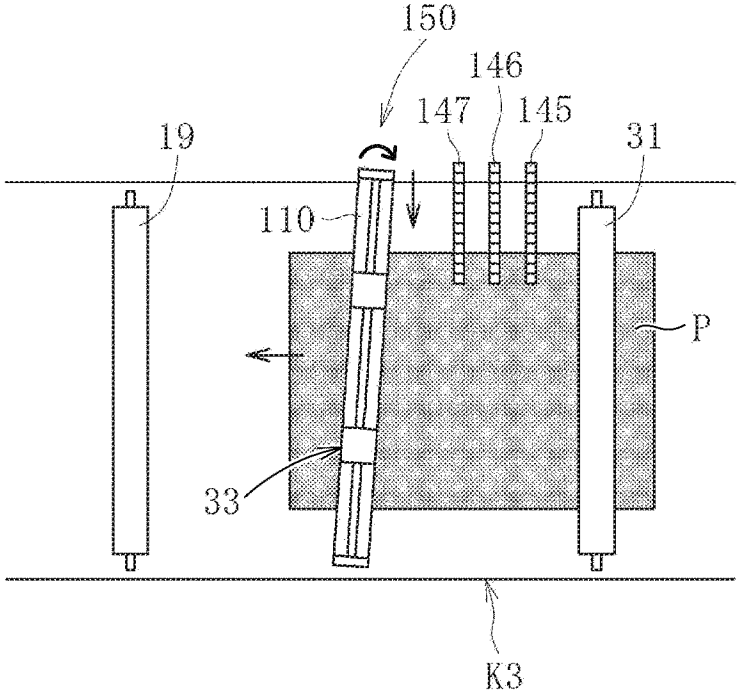
FIG. 22A is a top view illustrating the sheet conveying device according to Variation 1, in which three CISs are aligned in parallel to each other, after the second detection of positional deviation and an adjustment and feed operation.

In the present embodiment of this disclosure, the second CIS 146 and the third CIS 147 detect the change (i.e., the secondary detection). Then, based on the detection result, the pair of sheet holding rollers 33 performs the adjustment and feed control and at the same time drives to compensate the change, as illustrated in FIGS. 22A and 22B. Accordingly, the lateral displacement amount of the sheet P and the deviation angle of the sheet P are corrected with high accuracy.

Figure 23:
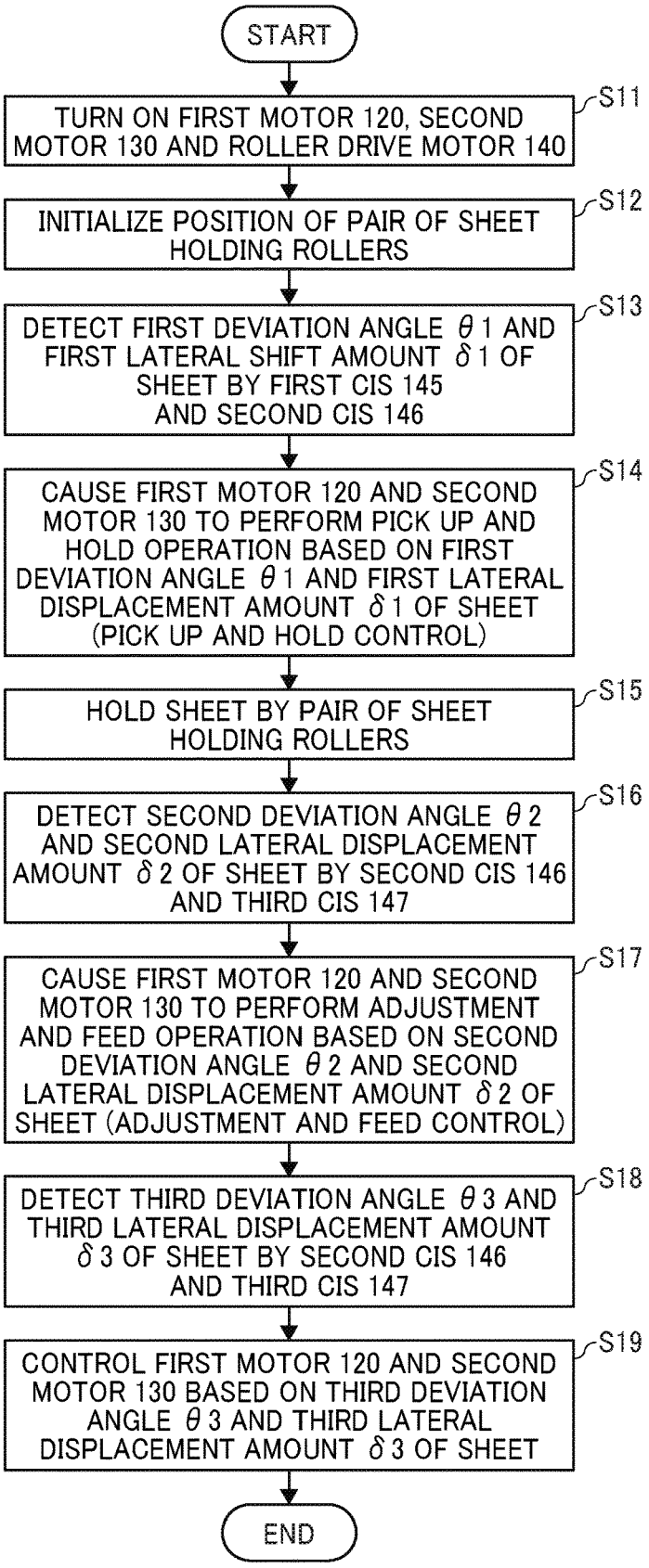
FIG. 23 is a flowchart of correction operations performed in the sheet conveying device according to Variation 1, with reference to FIGS. 19A through 22B.

FIG. 23 is a flowchart of correction operations performed in the sheet conveying device 150 according to Variation 1, with reference to FIGS. 19A through 22B.

As described above, the flowchart of the correction operations of Variation 1 as illustrated in FIG. 23 is basically the same as the flowchart of the correction operations as illustrated in FIG. 11, except that the secondary detection in Variation 1 is performed by the second CIS 146 and the third CIS 147 (i.e., step S16 of the flowchart in FIG. 23).

It is to be noted that, both in the flowchart of FIG. 11 and the flowchart of FIG. 23 (of Variation 1), after the adjustment and feed operation is performed, the second CIS 146 and the third OS 147 perform the tertiary detection. Then, based on the detection result of the tertiary detection, the angular displacement of the sheet P and the lateral displacement of the sheet P are corrected, in step S18 and step S19 in the flowchart of FIG. 23.

Variation 2.

Now, a description is given of an arrangement of the CISs according to Variation 2, with reference to FIGS. 24A through 28.

Figure 24B:
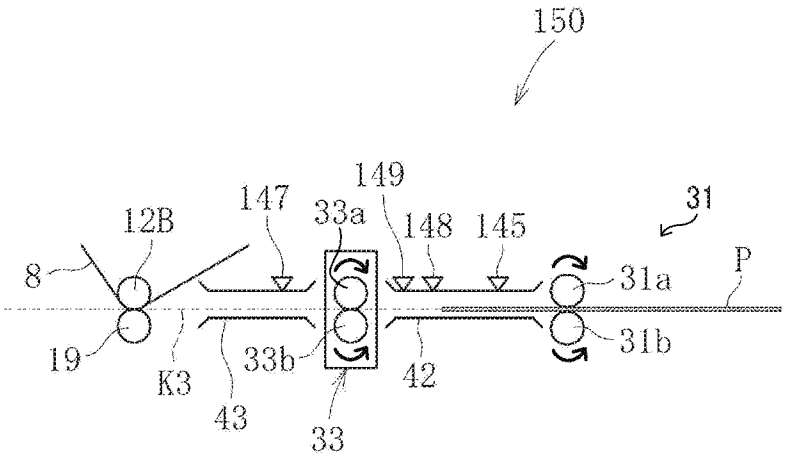
FIG. 24B is a side view illustrating the sheet conveying device of FIG. 24A.
Figure 24A:
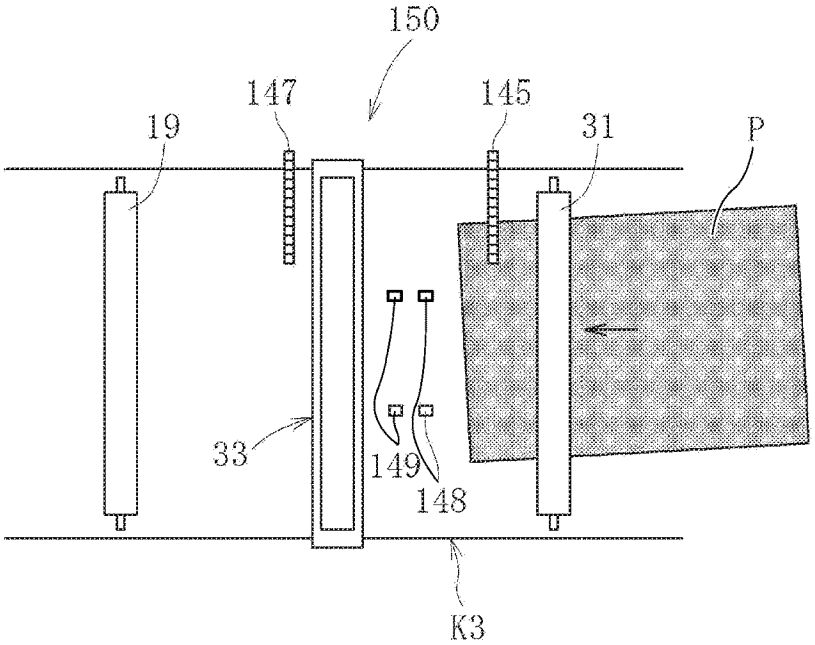
FIG. 24A is a top view illustrating the sheet conveying device according to Variation 2, in which two CISs are aligned across a pair of sheet holding rollers therebetween and angular displacement detection sensors are disposed instead of a middle CIS, before detection of positional deviation.
Figure 25B:
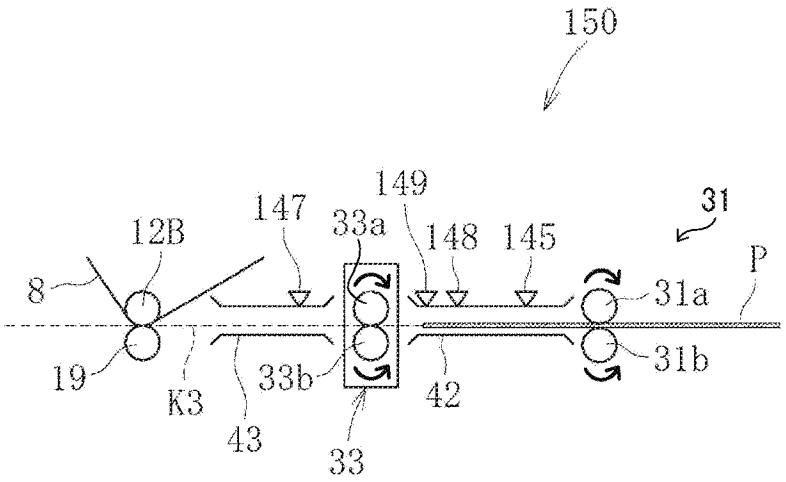
FIG. 25B is a side view illustrating the sheet conveying device of FIG. 25A.
Figure 25A:
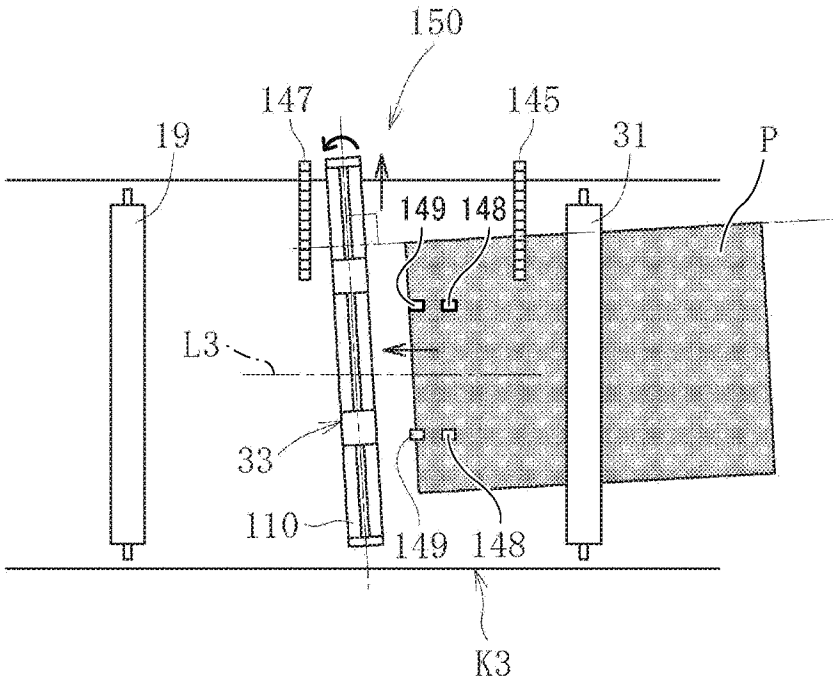
FIG. 25A is a top view illustrating the sheet conveying device according to Variation 2, in which two CISs are aligned across the pair of sheet holding rollers therebetween and angular displacement detection sensors are disposed instead of the middle CIS, after the first detection of positional deviation and the pick up and hold operation.
Figure 26B:
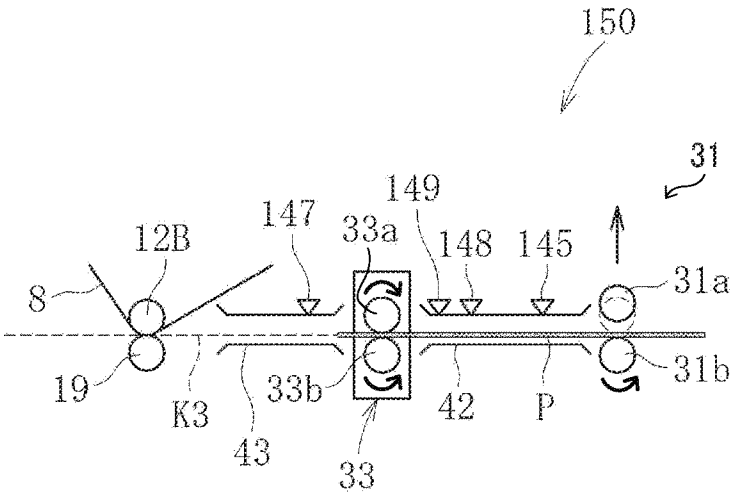
FIG. 26B is a side view illustrating the sheet conveying device of FIG. 26A.
Figure 26A:
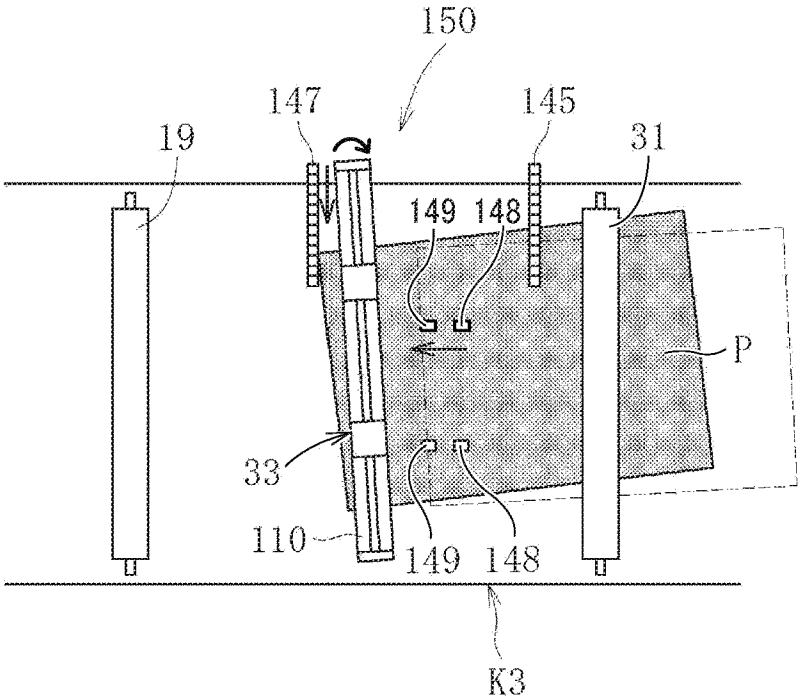
FIG. 26A is a top view illustrating the sheet conveying device according to Variation 2, in which two CISs are aligned across the pair of sheet holding rollers therebetween and angular displacement detection sensors are disposed instead of the middle CIS, after the second detection of positional deviation and before the feed back correction.
Figure 27B:
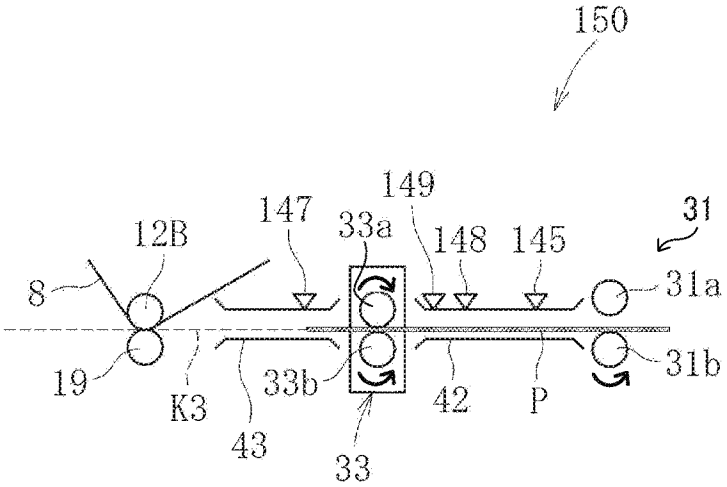
FIG. 27B is a side view illustrating the sheet conveying device of FIG. 27A.
Figure 27A:
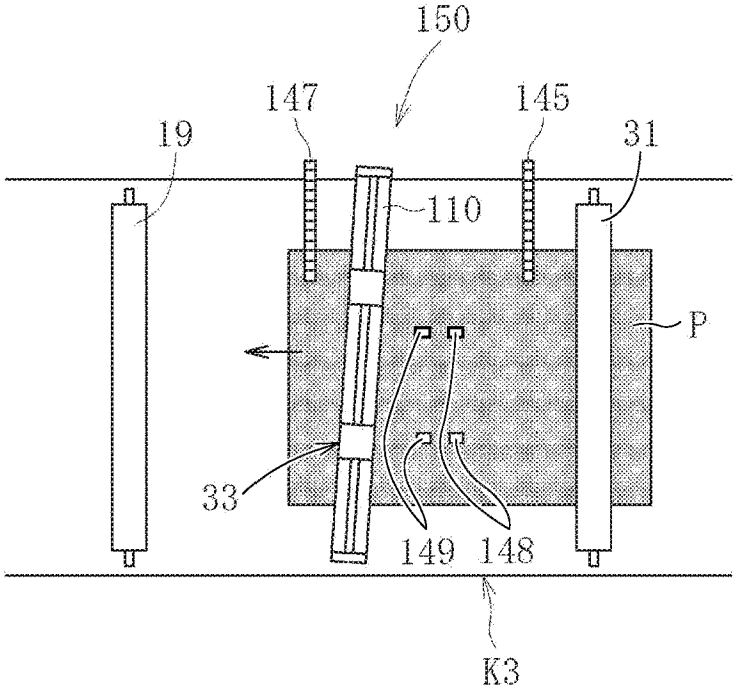
FIG. 27A is a top view illustrating the sheet conveying device according to Variation 2, in which two CISs are aligned across the pair of sheet holding rollers therebetween and angular displacement detection sensors are disposed instead of the middle CIS, after the second detection of positional deviation and the adjustment and feed operation.
Figure 28:
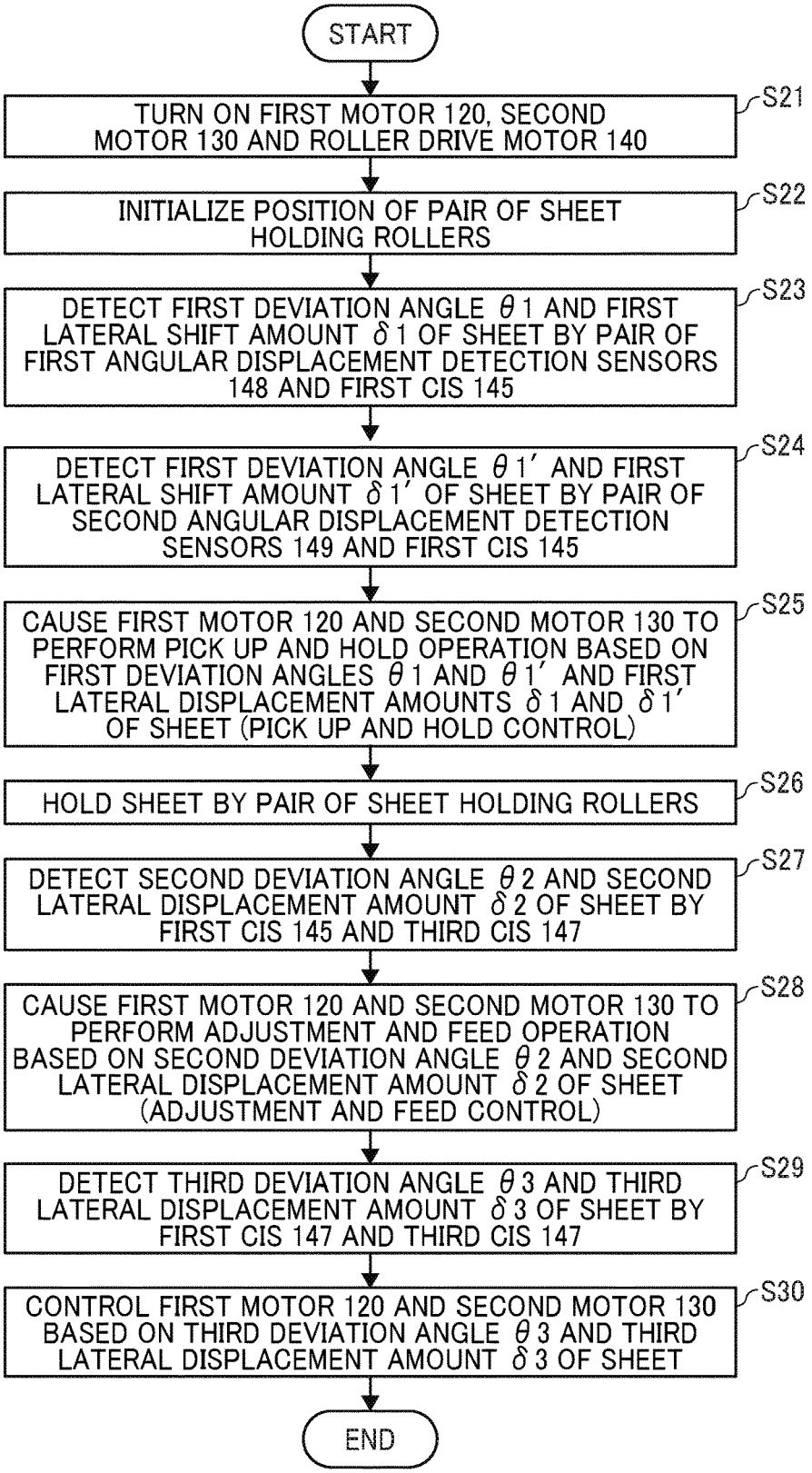
FIG. 28 is a flowchart of correction operations performed in the sheet conveying device according to Variation 2, with reference to FIGS. 24A through 27B.

FIG. 24A is a top view illustrating the sheet conveying device 150 according to Variation 2, in which the first CIS 145 and the third CIS 147 are aligned across the pair of sheet holding rollers 33 therebetween and angular displacement detection sensors are disposed instead of the second CIS 146, before detection of positional deviation. FIG. 24B is a side view illustrating the sheet conveying device 150 of FIG. 24A. FIG. 25A is a top view illustrating the sheet conveying device 150 according to Variation 2, in which the first CIS 145 and the third CIS 147 are aligned across the pair of sheet holding rollers 33 therebetween and angular displacement detection sensors are disposed instead of the second CIS 146, after the first detection of positional deviation and the pick up and hold operation. FIG. 25B is a side view illustrating the sheet conveying device 150 of FIG. 25A. FIG. 26A is a top view illustrating the sheet conveying device 150 according to Variation 2, in which the first CIS 145 and the third CIS 147 are aligned across the pair of sheet holding rollers 33 therebetween and angular displacement detection sensors are disposed instead of the second CIS 146, after the second detection of positional deviation and before the feed back correction. FIG. 26B is a side view illustrating the sheet conveying device 150 of FIG. 26A. FIG. 27A is a top view illustrating the sheet conveying device 150 according to Variation 2, in which the first CIS 145 and the third CIS 147 are aligned across the pair of sheet holding rollers 33 therebetween and angular displacement detection sensors are disposed instead of the second CIS 146, after the second detection of positional deviation and the adjustment and feed operation. FIG. 27B is a side view illustrating the sheet conveying device 150 of FIG. 27A. FIG. 28 is a flowchart of correction operations performed in the sheet conveying device 150 according to Variation 2, with reference to FIGS. 24A through 27B.

In Variation 2, a pair of first angular displacement detection sensors 148 and a pair of second angular displacement detection sensors 149 are disposed, between the first CIS 145 and the pair of sheet holding rollers 33, instead of the second CIS 146. Further, the third CIS 147 is disposed downstream from the pair of sheet holding rollers 33 in the sheet conveying direction and between the pair of sheet holding rollers 33 and the secondary transfer roller 19.

In Variation 2, the first CIS 145, the pair of first angular displacement detection sensors 148 and the pair of second angular displacement detection sensors 149 function as a first detector to detect the position of the sheet P for the pick up and hold operation. By disposing the pair of first angular displacement detection sensors 148 and the pair of second angular displacement detection sensors 149 and performing the detection of the sheet P together with the detection by the first CIS 145, the lateral displacement amount of the sheet P and the deviation angle of the sheet P are detected in two steps (i.e., the primary detection). Specifically, as illustrated in FIGS. 25A and 25B, in a state in which the leading end of the sheet P comes to the pair of first angular displacement detection sensors 148 before the leading end of the sheet P reaches the pair of sheet holding rollers 33, the first CIS 145 detects the lateral displacement amount $\delta 1$ of the sheet P and, at the same time, the pair of first angular displacement detection sensors 148 detects the deviation angle $\theta 1$ of the sheet P (in step S23 of the flowchart of FIG. 28). Then, when the leading end of the sheet P reaches the pair of second angular displacement detection sensors 149, the first CIS 145 detects the lateral displacement amount $\delta 1'$ of the sheet P again and, at the same time, the pair of second angular displacement detection sensors 149 detects the deviation angle $\theta 1'$ of the sheet P (in step S23' of the flowchart of FIG. 28). Then, the pair of sheet holding rollers 33 performs the pick up and hold operation based on the lateral displacement amount $\delta 1$ detected by the first CIS 145 and the deviation angle $\theta 1$ of the sheet P detected by the pair of first angular displacement detection sensors 148. Then, the pair of sheet holding rollers 33 again performs the pick up and hold operation based on the lateral displacement amount $\delta 1'$ detected by the first CIS 145 and the deviation angle $\theta 1'$ of the sheet P detected by the pair of second angular displacement detection sensors 149 (in step S24 of the flowchart of FIG. 28).

According to the above-described operations, the performance of high speed conveyance of the sheet P is maintained and, at the same time, the accuracy of the pick up and hold operation of the pair of sheet holding rollers 33 is enhanced.

Further, in Variation 2, the first CIS 145 and the third CIS 147 function as a second detector to detect the position of the sheet P after the primary detection.

As illustrated in FIGS. 26A and 26B, when the leading end of the sheet P reaches the third CIS 147, the first CIS 145 and the third CIS 147 detect lateral displacement amount of the sheet P and the deviation angle of the sheet P in a state after the leading end of the sheet P has been held in the nip region of the pair of sheet holding rollers 33 (i.e., the secondary detection, in step S26 of the flowchart of FIG. 28). Accordingly, the amount of positional deviation of the sheet P displaced in the nip region of the pair of sheet holding rollers 33 is also be detected.

FIGS. 27A and 27B illustrate a state in which the lateral displacement amount of the sheet P and the deviation angle of the sheet P are corrected by causing the pair of sheet holding rollers 33 to perform the adjust and feed control (in step S27 of the flowchart of FIG. 28) based on the detection results (through the secondary detection).

Further, similar to the above-described embodiment, the tertiary detection is performed in Variation 2. In this case, however, the tertiary detection is performed by the first CIS 145 and the third CIS 147 (in step S28 of the flowchart of FIG. 28). Then, the angular displacement of the sheet P and the lateral displacement of the sheet P are corrected based on the detection result of the tertiary detection (in step S29 of the flowchart of FIG. 28).

Variation 3.

Figure 29:
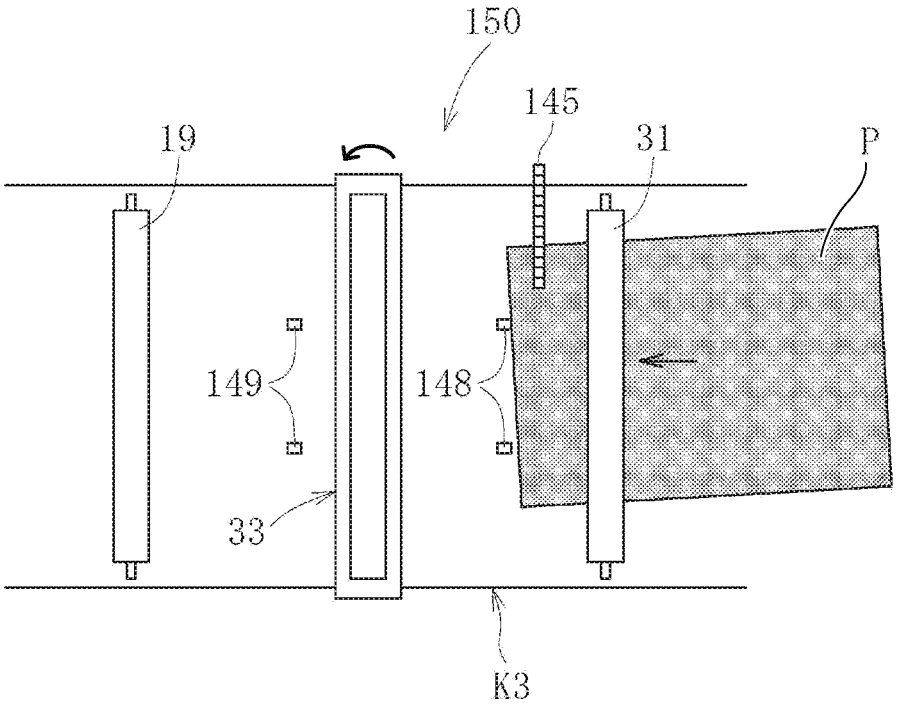
FIG. 29 is a top view illustrating the sheet conveying device according to Variation 3, in which one CIS is disposed and first angular displacement detection sensors and second angular displacement detection sensors are disposed downstream from the CIS in a sheet conveying direction.

Now, a description is given of an arrangement of a single CIS and detection sensors, according to Variation 3, with reference to FIG. 29.

FIG. 29 is a top view illustrating the sheet conveying device 150 according to Variation 3, in which one CIS, which is the first CIS 145 in this case, is disposed and the pair of first angular displacement detection sensors 148 and the pair of second angular displacement detection sensors 149 are disposed downstream from the CIS (i.e., the first CIS 145) in the sheet conveying direction.

In Variation 3, the pair of first angular displacement detection sensors 148 is disposed downstream from the first CIS 145 in the sheet conveying direction and upstream from the pair of sheet holding rollers 33 in the sheet conveying direction. Further, in Variation 3, the pair of second angular displacement detection sensors 149 is disposed downstream from the first CIS 145 and the pair of sheet holding rollers 33 in the sheet conveying direction.

According to the arrangement of the pair of first angular displacement detection sensors 148 and the pair of second angular displacement detection sensors 149 as illustrated in FIG. 26, the first CIS 145 and the pair of first angular displacement detection sensors 148, both of which function as a first detector, detect the lateral displacement amount of the sheet P and the deviation angle of the sheet P before the leading end of the sheet P is held by the nip region of the pair of sheet holding rollers 33 (i.e., the primary detection). Further, the first CIS 145 and the pair of second angular displacement detection sensors 149, both of which function as a second detector, detect the lateral displacement amount of the sheet P and the deviation angle of the sheet P after the leading end of the sheet P is held by the nip region of the pair of sheet holding rollers 33 (i.e., the secondary detection). Accordingly, the amount of positional deviation of the sheet P displaced in the nip region of the pair of sheet holding rollers 33 is also be detected.

Figure 30:
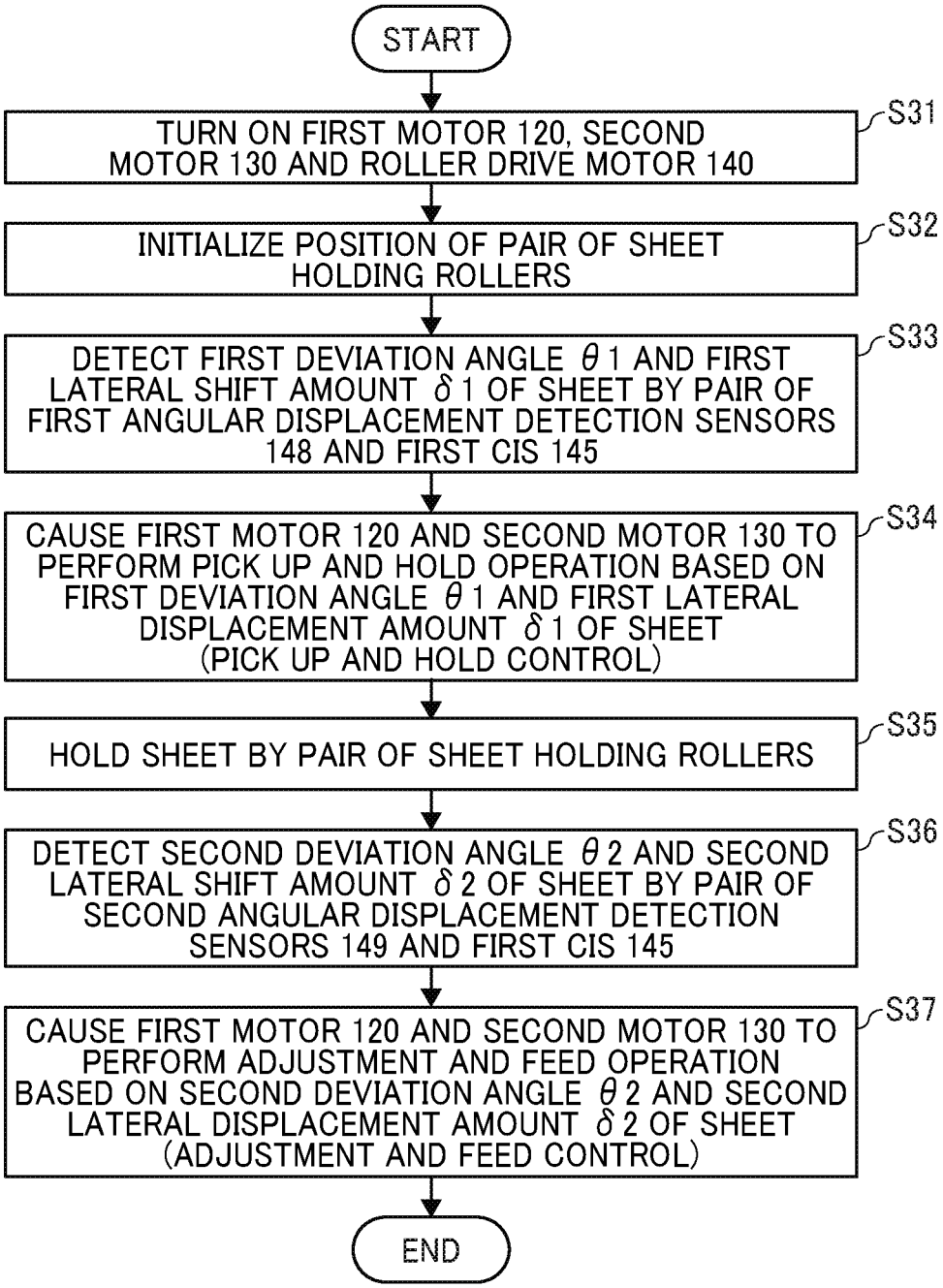
FIG. 30 is a flowchart of correction operations performed in the sheet conveying device according to Variation 3, with reference to FIG. 29.

FIG. 30 is a flowchart of correction operations performed in the sheet conveying device 150 according to Variation 3, with reference to FIG. 29.

As described above, the primary detection is performed by the pair of first angular displacement detection sensors 148 and the first CIS 145 in Variation 3 (in step S33 of the flowchart of FIG. 30), and the pick up and hold operation is performed based on the detection result of the primary detection (in step S34 of the flowchart of FIG. 30). Then, the secondary detection is performed by the pair of second angular displacement detection sensors 149 and the first CIS 145 (in step S36 of the flowchart of FIG. 30), and the adjustment and feed operation is performed based on the detection result of the secondary detection (in step S37 of the flowchart of FIG. 30).

It is to be noted that, in Variation 3, the detection angle cannot be detected after the leading end of the sheet P has passed the pair of second angular displacement detection sensors 149. Accordingly, the tertiary detection performed in the above-described embodiment is not performed.

Variation 4.

Figure 31A:
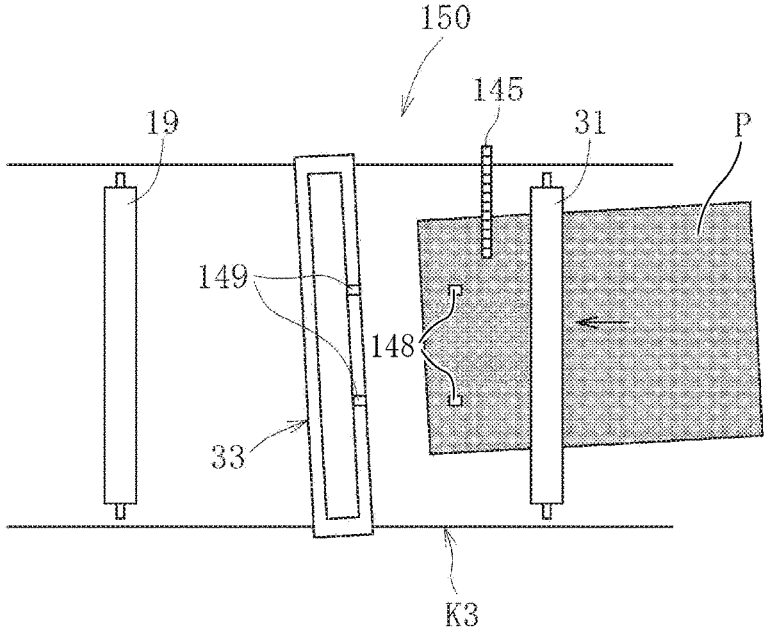
FIG. 31A is a top view illustrating the sheet conveying device according to Variation 4, in which the second angular displacement detection sensors are disposed on an upstream side of the roller holding member.

Now, a description is given of an arrangement of a single CIS and detection sensors according to Variation 4, with reference to FIG. 31A.

FIG. 31A is a top view illustrating the sheet conveying device 150 according to Variation 4, in which the pair of second angular displacement detection sensors 149 are disposed on an upstream side of the roller holding member 110.

In Variation 4, the pair of second angular displacement detection sensors 149 is disposed on an upstream side of the roller holding member 110 immediately upstream from the pair of sheet holding rollers 33 in the sheet conveying direction. That is, in Variation 4, the pair of second angular displacement detection sensors 149 is disposed on the roller holding member 110 to move together with the pair of sheet holding rollers 33. Different from the pair of second angular displacement detection sensors 149, the first CIS 145 and the pair of first angular displacement detection sensors 148 are fixed to the sheet conveyance passage, which is the same arrangement as the configuration illustrated in FIG. 29.

It is to be noted that, in Variation 4, the first CIS 145 and the pair of first angular displacement detection sensors 148 function as a first detector to perform the first detection for the pick up and hold operation and the first CIS 145 and the pair of second angular displacement detection sensors 149 function as a second detector to perform the second detection for the adjustment and feed operation. By arranging the pair of second angular displacement detection sensors 149 disposed immediately upstream from the pair of sheet holding rollers 33 in the sheet conveying direction, the first CIS 145 and the pair of second angular displacement detection sensors 149 detect the lateral displacement amount of the sheet P and the deviation angle of the sheet P immediately before the leading end of the sheet P is held by the nip region of the pair of sheet holding rollers 33.

Further, the second detection is performed after the pick up and hold operation. At this time, since the pair of second angular displacement detection sensors 149 is disposed on the roller holding member 110, the pair of second angular displacement detection sensors 149 detects passage of the sheet P in a state in which the pair of second angular displacement detection sensors 149 is rotated by the amount of movement of the pick up and hold operation according to the deviation angle of the sheet P obtained by the first detection. That is, the deviation angle of the sheet P obtained by the second detection is the amount of displacement not to the regular reference position without any deviation but to the position detected by the first detection. Therefore, the control of the adjustment and feed operation with respect to the deviation angle of the sheet P is performed based on the sum of a value of the deviation angle of the sheet P obtained by the first detection and a value of the deviation angle of the sheet P obtained by the second detection. Accordingly, the amount of change of the deviation angle of the sheet P in a time difference between the detection time of the first detection and the detection time of the second detection can be detected directly by the second detection, and therefore the detection accuracy and the correction accuracy can be enhanced.

Figure 32:
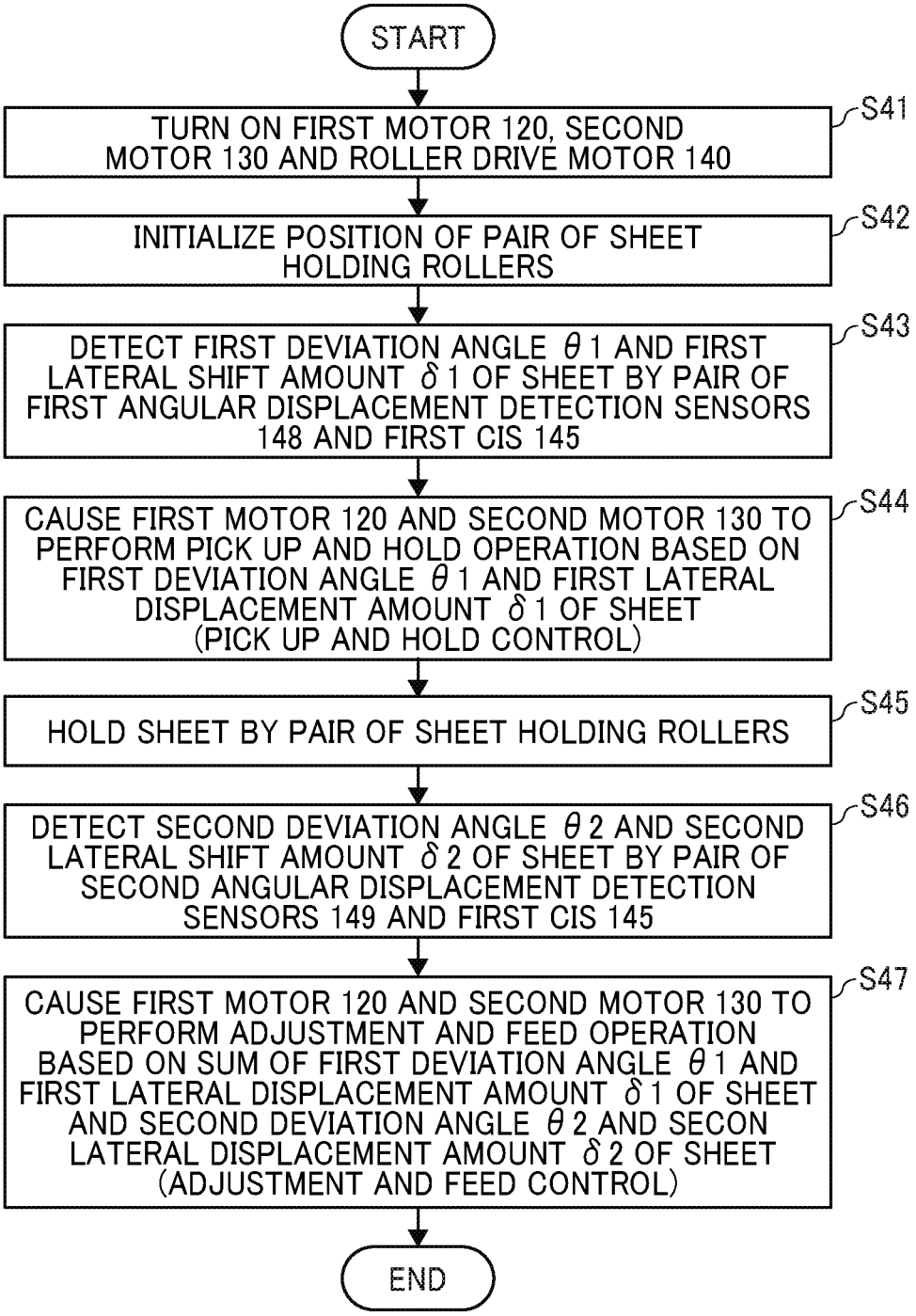
FIG. 32 is a flowchart of correction operations performed in the sheet conveying device according to Variation 4 with reference to FIG. 31A or according to Variation 5 with reference to FIG. 31B.

FIG. 32 is a flowchart of correction operations performed in the sheet conveying device 150 according to Variation 4 with reference to FIG. 31A.

The flowchart of Variation 4 of FIG. 32 is basically same as the flowchart of Variation 3 of FIG. 30, except that the adjustment and feed operation is performed based on the sum of the detection result of the primary detection and the detection result of the secondary detection, in step S47 of the flowchart of FIG. 32.

Variation 5.

Figure 31B:
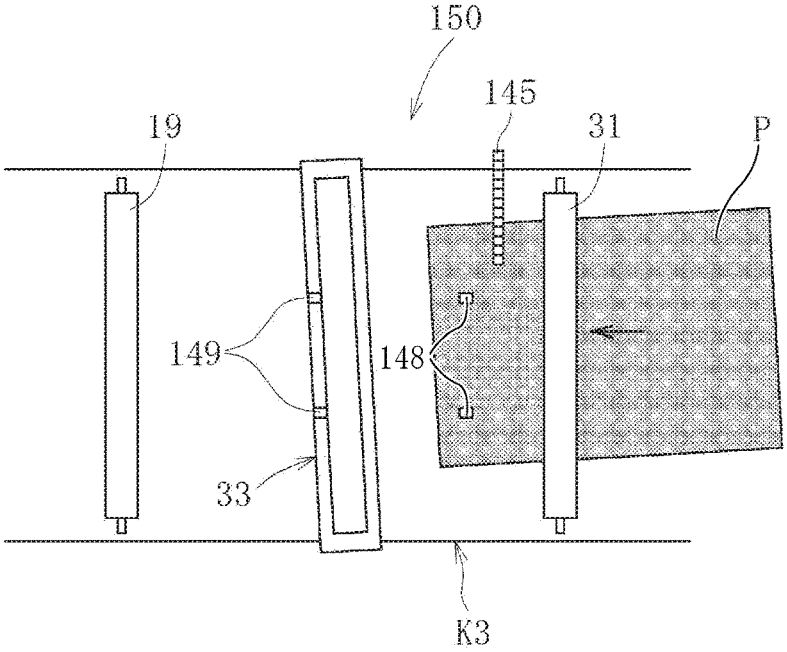
FIG. 31B is a top view illustrating the sheet conveying device according to Variation 5, in which the second angular displacement detection sensors are disposed on a downstream side of the roller holding member.

Now, a description is given of an arrangement of a single CIS and detection sensors according to Variation 5, with reference to FIG. 31B.

FIG. 31B is a top view illustrating the sheet conveying device 150 according to Variation 5, in which the pair of second angular displacement detection sensors 149 are disposed on a downstream side of the roller holding member 110.

In Variation 5, the pair of second angular displacement detection sensors 149 is disposed on a downstream side of the roller holding member 110 immediately downstream from the pair of sheet holding rollers 33 in the sheet conveying direction.

By arranging the pair of second angular displacement detection sensors 149 as illustrated in FIG. 31B, the first CIS 145 and the pair of second angular displacement detection sensors 149 detect the lateral displacement amount of the sheet P and the deviation angle of the sheet P immediately after the leading end of the sheet P has been held by the nip region of the pair of sheet holding rollers 33. Accordingly, in Variation 5 of FIG. 31B, in addition to the amount of change of the deviation angle of the sheet P in the time difference between the first detection and the second detection, the amount of positional deviation of the sheet P by the nip region of the pair of sheet holding rollers 33 can be detected directly by the second detection. Therefore, the detection accuracy and the correction accuracy can be further enhanced.

Further, since the pair of second angular displacement detection sensors 149 is disposed on the roller holding member 110, the roller holding member 110 is not hindered during the rotation thereof. Therefore, due to the arrangement of the pair of second angular displacement detection sensors 149 disposed immediately downstream from the nip region of the pair of sheet holding rollers 33 in the sheet conveying direction, a period of time can be increased from the second detection in which the leading end of the sheet P passes the pair of second angular displacement detection sensors 149 to the arrival of the leading end of the sheet P to the secondary transfer roller 19 disposed downstream from the pair of second angular displacement detection sensors 149 in the sheet conveying direction. Consequently, due to the increase in period of time for passage of the sheet P, the accuracy of the adjustment and feed operation of the pair of sheet holding rollers 33 can be enhanced. Therefore, the accuracy in correction of the positional deviation at the time in which the sheet P reaches the secondary transfer roller 19 can be enhanced.

Now, a description is given of the sheet conveying device 150 according to Variation 6 of this disclosure, with reference to FIGS. 33A through 35B.

In Variation 6, the sheet conveying device 150 employs the first CIS 145, the second CIS 146 and the third CIS 147. The arrangement of the first CIS 145, the second CIS 146 and the third CIS 147 according to Variation 6 is identical to the arrangement of the first CIS 145, the second CIS 146 and the third CIS 147 according the above-described embodiment with reference to FIGS. 12A through 18B. However, the control of the second detection and the adjustment and feed operation of Variation 6 of FIGS. 33A through 35B is different from the above-described embodiment with reference to FIGS. 12A through 18B.

Hereinafter, the method of correcting the angular displacement and lateral displacement of the sheet P is described, with reference to FIGS. 33A through 36.

Figure 33B:
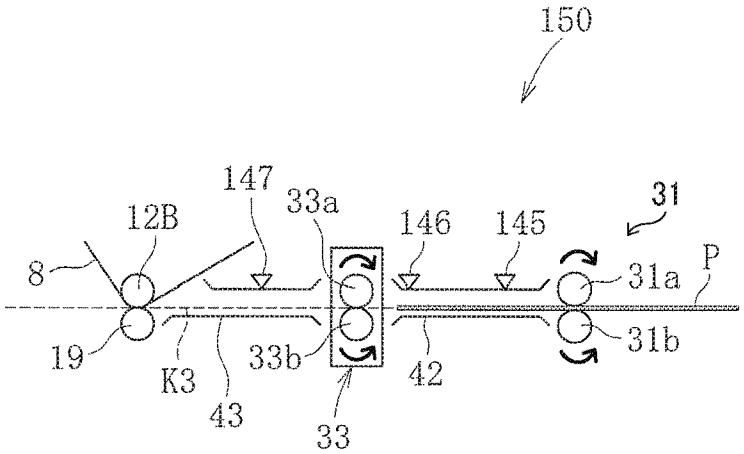
FIG. 33B is a side view illustrating the sheet conveying device of FIG. 33A.
Figure 33A:
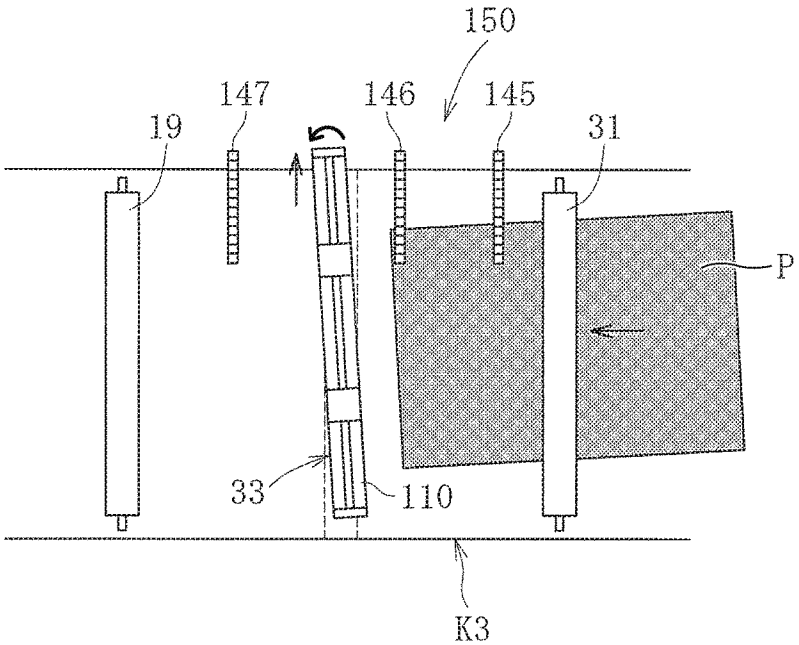
FIG. 33A is a top view illustrating the sheet conveying device according to Variation 6 of this disclosure, in which three CISs are aligned in parallel to each other, after the first detection of positional deviation and the pick up and hold operation.
Figure 34B:
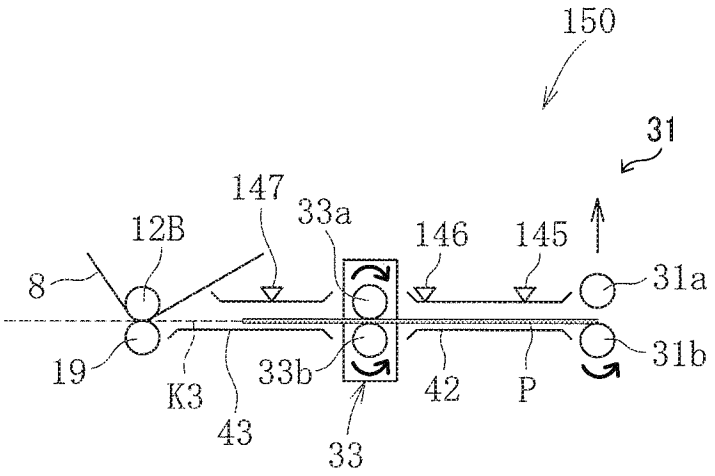
FIG. 34B is a side view illustrating the sheet conveying device of FIG. 34A.
Figure 34A:
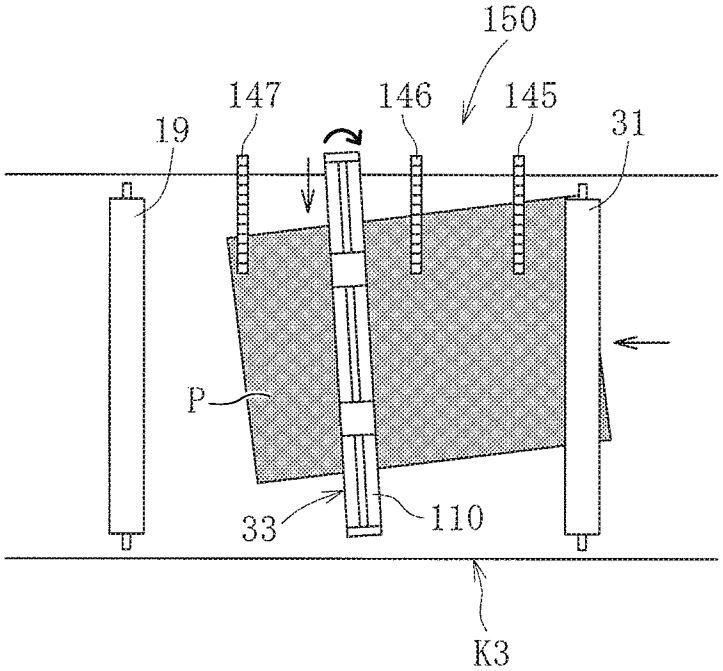
FIG. 34A is a top view illustrating the sheet conveying device according to Variation 6 of this disclosure, in which three CISs are aligned in parallel to each other, in the second detection of positional deviation.
Figure 35B:
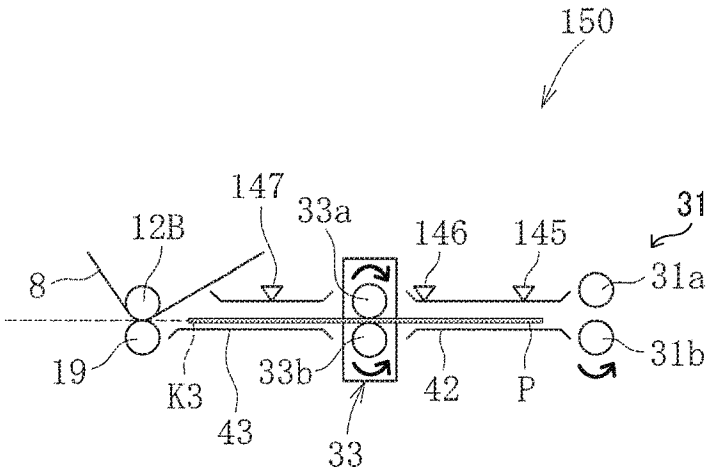
FIG. 35B is a side view illustrating the sheet conveying device of FIG. 35A.
Figure 35A:
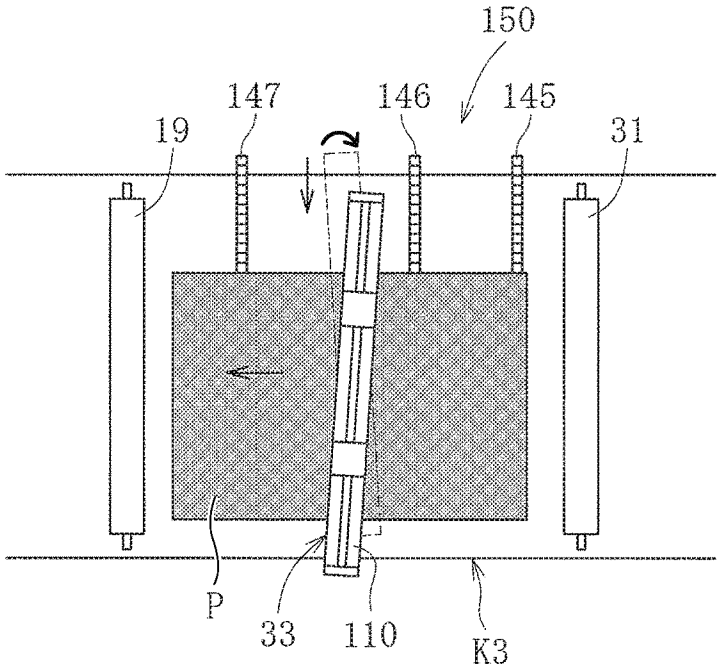
FIG. 35A is a top view illustrating the sheet conveying device according to Variation 6 of this disclosure, in which three CASs are aligned in parallel to each other, after the adjustment and feed operation.
Figure 36:
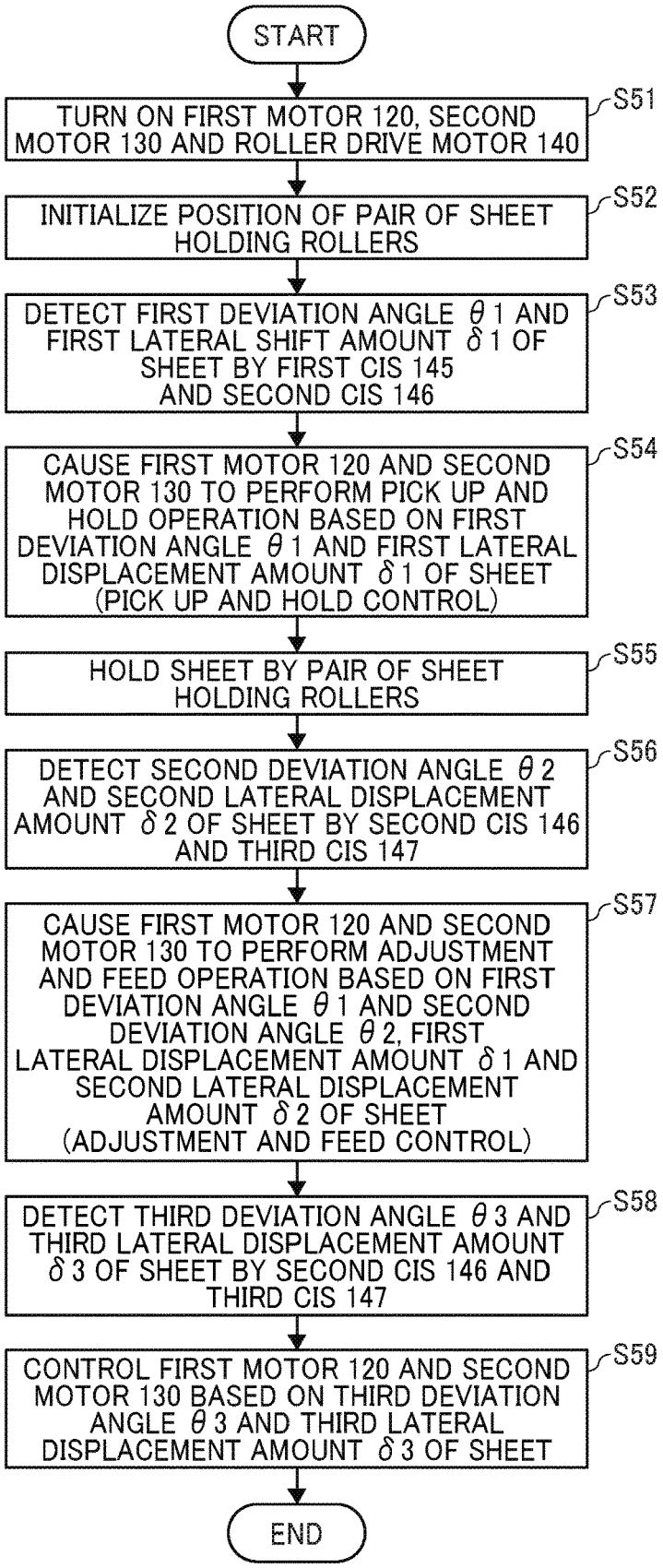
FIG. 36 is a flowchart of correction operations performed in the sheet conveying device according to Variation 6, with reference to FIGS. 33A through 35B.

FIG. 33A is a top view illustrating the sheet conveying device 150 according to Variation 6 of this disclosure, in which three CISs are aligned in parallel to each other, after the primary detection of positional deviation and the pick up and hold operation. FIG. 33B is a side view illustrating the sheet conveying device 150 of FIG. 33A. FIG. 34A is a top view illustrating the sheet conveying device 150 according to Variation 6 of this disclosure, in which three CISs are aligned in parallel to each other, in the secondary detection of positional deviation. FIG. 34B is a side view illustrating the sheet conveying device 150 of FIG. 34A. FIG. 35A is a top view illustrating the sheet conveying device 150 according to Variation 6 of this disclosure, in which three CISs are aligned in parallel to each other, after the adjustment and feed operation. FIG. 35B is a side view illustrating the sheet conveying device 150 of FIG. 35A. FIG. 36 is a flowchart of correction operations performed in the sheet conveying device according to Variation 6, with reference to FIGS. 33A through 35B.

In this embodiment, as illustrated in FIGS. 33A and 33B, on arrival of the side end of the sheet P to the first CIS 145 and the second CIS 146, the first CIS 145 and the second CIS 146 detect the first positional deviation amount SF1 (i.e., the first deviation angle θ1 and the first lateral displacement amount δ1) of the sheet P (i.e., the primary detection, step S53 in the flowchart of FIG. 36). Consequently, the pair of sheet holding rollers 33 is driven based on the first positional deviation amount SF1 to perform the pick up and hold operation by moving from the position of the broken line to the position of the solid line in FIG. 33A (step S54 of the flowchart of FIG. 36).

It is to be noted that the primary detection and the pick up and hold operation based on the detection result of the first detection are the same as the operation of the embodiment with reference to FIGS. 12A through 18B.

Next, the second detection is performed. In the above-described embodiment with reference to FIGS. 12A through 18B, the second detection is performed with the same CISs (i.e., the first CIS 145 and the second CIS 146) as the first detection. By contrast, in the present embodiment, the second detection is performed with the CiSs different from the first detection. To be more specific, as illustrated in FIGS. 34A and 34B, while the sheet P is being held by the pair of sheet holding rollers 33 (in step S55 of the flowchart of FIG. 36), after the leading end of the sheet P has reached the third CIS 147, the second CIS 146 and the third CIS 147 detect the side end of the sheet P (i.e., the secondary detection, in step S56 of the flowchart of FIG. 36). Accordingly, the second positional deviation amount SF2 (i.e., the second deviation angle θ2 and the second lateral deviation amount δ2) is detected.

Then, the adjustment and feed operation is performed by the pair of sheet holding rollers 33 (in step S57 of the flowchart of FIG. 36). In the above-described embodiment with reference to FIGS. 12A through 18B, the adjustment and feed operation is performed based on the detection result of the second detection alone. By contrast, in the present embodiment, the adjustment and feed operation is performed based on the detection results of the first detection and the second detection.

Thereafter, as illustrated in FIGS. 35A and 35B, after the adjustment and feed operation of the pair of sheet holding rollers 33 has been performed, the second CIS 146 and the third CIS 147 further detect the side end of the sheet P (i.e., the tertiary detection, in step S58 of the flowchart of FIG. 36) and the angular displacement of the sheet P and the lateral displacement of the sheet P are corrected by the feedback control of the pair of sheet holding rollers 33 based on the detection results of the second CIS 146 and the third CIS 147 (in step S59 of the flowchart of FIG. 36), which is the same operation as the above-described embodiment of FIGS. 11A through 17B.

Method of Calculating Difference Lateral Displacement Amount and Difference Deviation Angle.

Figure 37A:
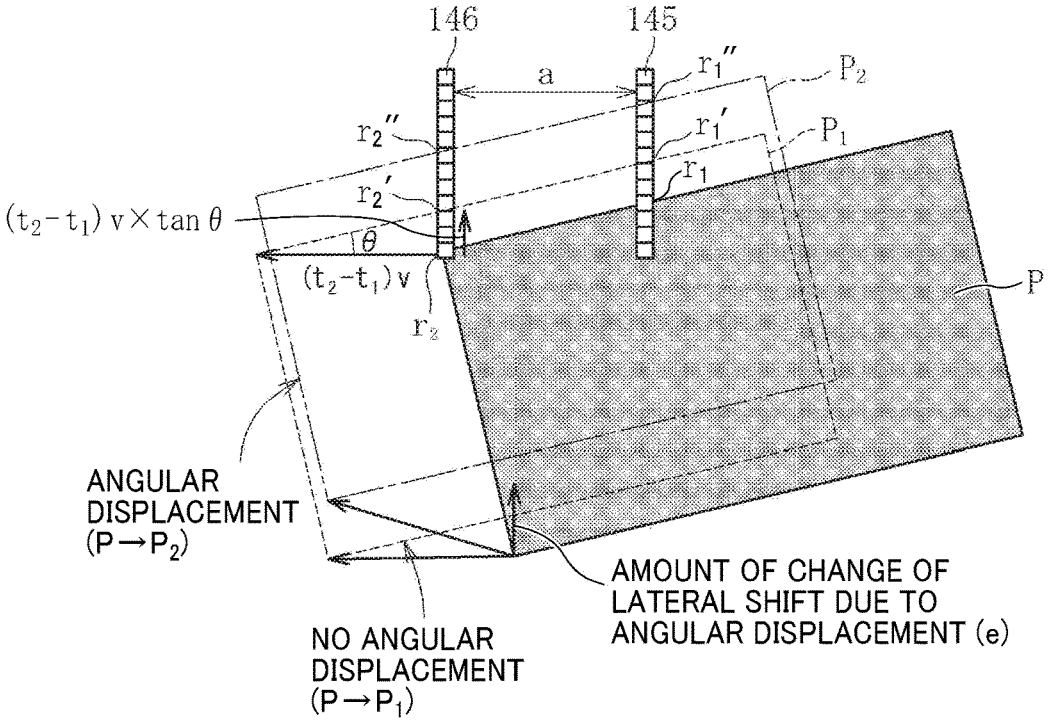
FIG. 37A is a diagram illustrating how to detect the deviation angle and the lateral displacement amount when an angular displacement of the sheet occurs between two CISs.
Figure 37B:
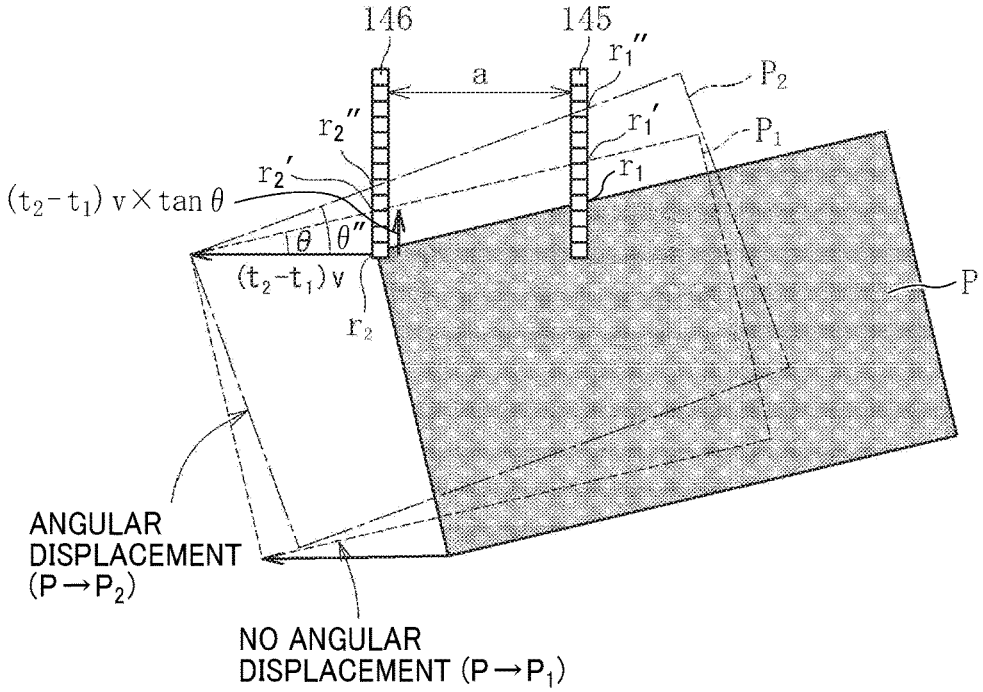
FIG. 37B is a diagram illustrating how to detect the deviation angle and the lateral displacement amount when a change of the angular displacement of the sheet occurs between two CISs.

Next, a description is given of a method of calculating a difference lateral displacement amount and a difference deviation angle of the sheet P detected by the first CIS 145 and the second CIS 146, with reference to FIGS. 37A and 37B.

FIG. 37A is a diagram illustrating how to detect the deviation angle and the lateral displacement amount when an angular displacement of the sheet occurs between two CISs. FIG. 37B is a diagram illustrating how to detect the deviation angle and the lateral displacement amount when a change of the angular displacement of the sheet occurs between two CISs.

In FIGS. 37A and 37B, it is assumed that the sheet P is conveyed from the right to the left at a conveying speed "v". It is also assumed that the position of the side end of the sheet P is detected at a time t1 and the position of the side end of the sheet P is detected again at a time t2.

Method of Calculating Difference Lateral Displacement Amount.

Next, a description is given of a method of calculating a difference lateral displacement amount, with reference to FIG. 37A.

FIG. 37A illustrates the lateral displacement amount of the sheet P due to the angular displacement of the sheet P.

The "angular displacement" of the sheet P indicates that the sheet P is conveyed while the sheet conveying direction of the sheet P is obliquely deviated from a direction vertical to the axis of the pair of sheet conveying rollers 31.

It is assumed that the factor of the angular displacement of the sheet P mainly lies that the sheet conveyance vector of the pair of sheet conveying rollers 31 disposed upstream from the pair of sheet holding rollers 33 is deviated from the vertical direction in the width direction of the sheet P.

In FIG. 37A, it is assumed that the sheet P is located at a position indicated by a solid line, at the time t1 at which the position of the side end of the sheet P is detected, the position of the side end of the sheet P detected by the first CIS 145 is represented as "r1" and the position of the side end of the sheet P detected by the second CIS 146 is represented as "r2". In addition, the relative distance between the first CIS 145 and the second CIS 146 is represented as "a". In this state, when the deviation angle of the sheet P is represented as "θ", the deviation angle θ is calculated by Equation of tan θ=(r2−r1)/a.

In a case in which the sheet P has no oblique sheet conveyance between the first CIS 145 and the second CIS 146 (that is, when the lateral displacement amount is zero), the sheet P is conveyed to the position of a sheet P1 of FIG. 37A at the time t2. In this case, when the position P1 of the side end of the sheet P1 detected by the first CIS 145 is represented as "r1'" and the position of the side end of the sheet P1 detected by the second CIS 146 is represented as "r2'", the value of r1' and the value of r2' are obtained as follows:

$$r1'=r1+(t2-t1)v\times\tan\theta;\text{ and}$$

$$r2'=r2+(t2-t1)v\times\tan\theta.$$

By contrast, in a case in which the sheet P has an oblique sheet conveyance between the first CIS 145 and the second CIS 146, the sheet P is conveyed to the position of a sheet P2 of FIG. 37A at the time t2. In this case, when the position of the side end of the sheet P2 detected by the first CIS 145 is represented as "r1'", the position of the side end of the sheet P2 detected by the second CIS 146 is represented as "r2'", and an amount of lateral shift due to the oblique sheet conveyance (i.e., a difference lateral displacement amount) is represented as "e", the value of r1" and "the value of r2" are obtained as follows:

$$r1''=r1+(t2-t1)v\times\tan\theta+e;\text{ and}$$

$$r2''=r2+(t2-t1)v\times\tan\theta+e.$$

The difference lateral displacement amount "d" is obtained through these two equations while "θ" and "e" are defined as unknown quantities.

Method of Calculating Difference Deviation Angle Amount.

Next, a description is given of a method of calculating a difference deviation angle amount, with reference to FIG. 37B.

FIG. 37B illustrates the deviation angle and the lateral displacement amount when an angular displacement of the sheet P occurs between two CISs.

In a case in which the sheet P has no angular displacement between the first CIS 145 and the second CIS 146 (that is, when the difference deviation angle is zero), the sheet P is conveyed to the position of a sheet P1 of FIG. 37B at the time t2.

In this case, when the position P1 of the side end of the sheet P1 detected by the first CIS 145 is represented as "r1'" and the position of the side end of the sheet P1 detected by the second CIS 146 is represented as "r2'", the value of r1' and the value of r2' are obtained as follows:

$$r1'=r1+(t2-t1)v\times\tan\theta;\text{ and}$$

$$r2'=r2+(t2-t1)v\times\tan\theta.$$

By contrast, in a case in which the sheet P has an angular displacement between the first CIS 145 and the second CIS 146, the sheet P is conveyed to the position of a sheet P2 of FIG. 37B at the time t2.

In this case, when the position of the side end of the sheet P2 detected by the first CIS 145 is represented as "r1'", the position of the side end of the sheet P2 detected by the second CIS 146 is represented as "r2'", and the deviation angle of the sheet P is represented as "θ", the value of r1" and "the value of r2" are obtained as follows:

$$r1''=r1+\{(t2-t1)v+a\}\times\tan\theta'',\text{ and}$$

$$r2''=r2+(t2-t1)v\times\tan\theta''.$$

Here, the difference deviation angle=θ"−θ, where θ" can be obtained by an equation of tan θ"=(r2"−r1")/a, and θ can be obtained by Equation of tan θ=(r2'−r2)/(t2−t1)v. Accordingly, the difference deviation angle (θ"−θ) can be obtained.

Variation of Position of Support Shaft of Roller Supporting Member.

Now, a description is given of the position of the support shaft 110*a* of the roller holding member 110, with reference to Variation 7.

Figure 38:
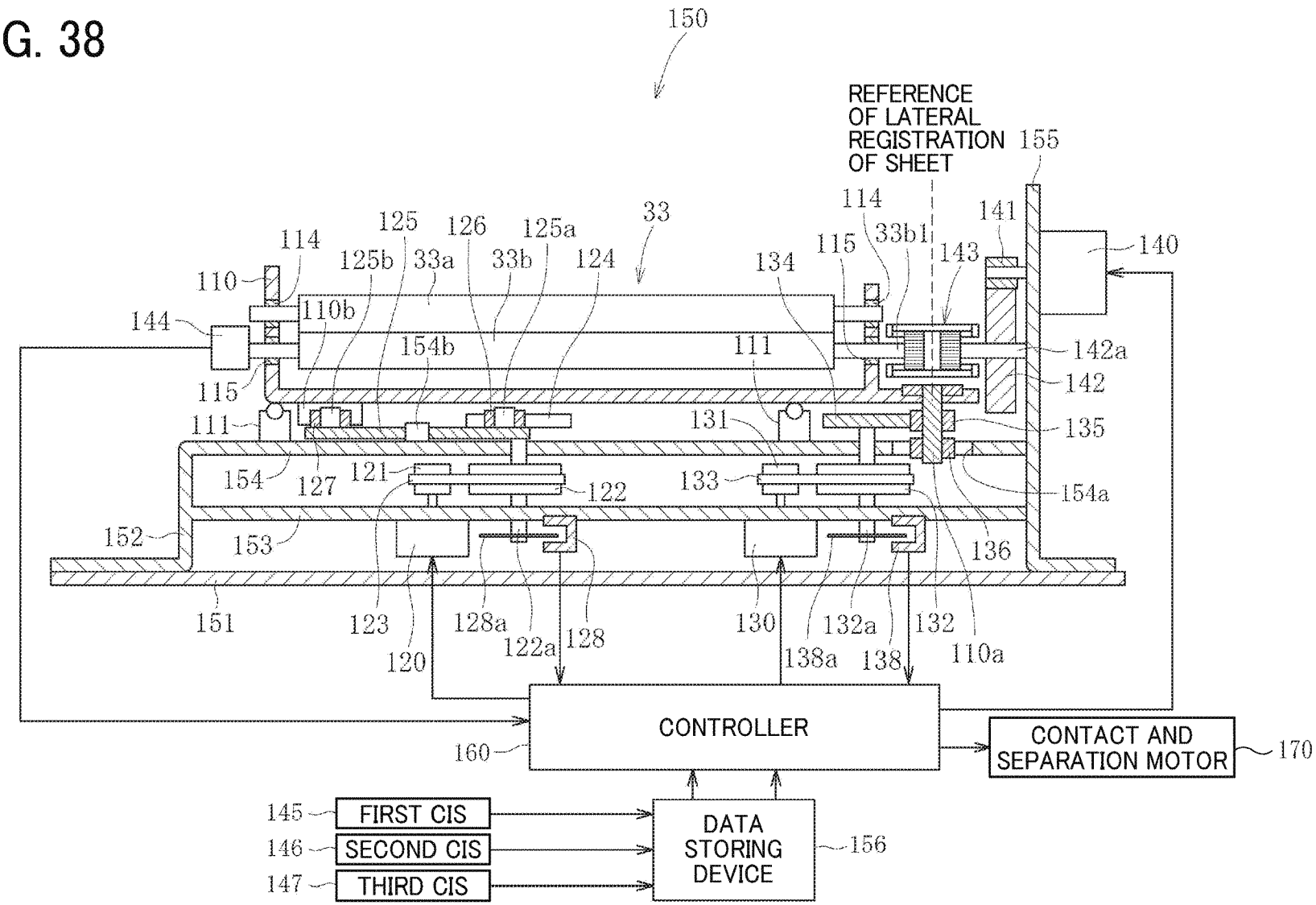
FIG. 38 is a cross sectional view illustrating the sheet conveying device according Variation 7 of this disclosure, in which the position of a support shaft of the roller holding member is changed.

FIG. 38 is a cross sectional view illustrating the sheet conveying device 150 according Variation 7, in which the position of the support shaft 110*a* of the roller holding member 110 is changed. Specifically, the configuration of FIG. 38 according to Variation 7 is different from the configuration of FIG. 5A according to the above-described embodiment, in that the two-step spline coupling 143 and the support shaft 110*a* of the roller holding member 110 are disposed closer in the axial direction of the pair of sheet holding rollers 33 in the configuration of FIG. 38.

The configuration of 5A, in which the two-step spline coupling 143 and the support shaft 110*a* of the roller holding member 110 are disposed spaced apart from each other, is employed to reduce the size of the base frame 152, in other words, to make the base frame 152 more compact. However, the configuration may be more enhanced in order to smoothly transmit the rotation driving force from the two-step spline coupling 143 to the drive roller 33*b* of the pair of sheet holding rollers 33. Specifically, in the configuration of FIG. 5A according to the above-described embodiment, in a case in which the roller holding member 110 is rotated about the support shaft 110*a*, an angle of misalignment is generated to the two-step spline coupling 143.

In order to address the above-described occurrence of an angle of misalignment, as illustrated in FIG. 38, the center of the support shaft 110*a* of the roller holding member 110 in the horizontal direction (i.e., a reference of the lateral registration of the sheet P) is shifted to the right in the drawing sheet. Then, in order to meet the position shift of the support shaft 110*a* of the roller holding member 110, the center of the two-step spline coupling 143 is adjusted. According to this configuration, the position of the support shaft 110*a* moves to the outside of the straight sheet conveyance passage K3 in the width direction, and therefore the width of the base frame 152 increases. However, the rotation driving force can be transmitted to the drive roller 33*b* of the pair of sheet holding rollers 33 with accuracy.

Inkjet Image Forming Apparatus.

Figure 39:
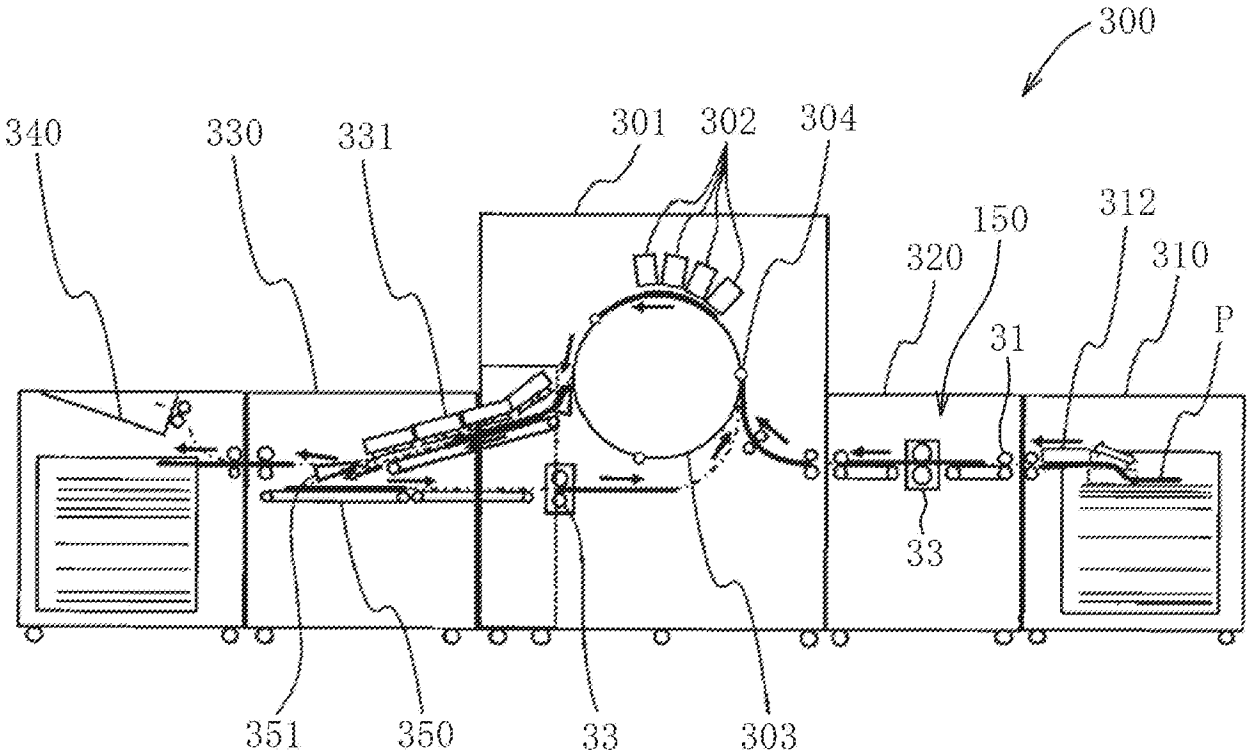
FIG. 39 is a side view illustrating a sheet conveying device according to an embodiment of this disclosure, applied to an inkjet image forming apparatus.

Next, a description is given of a sheet conveying device according to an embodiment of this disclosure, applied to an inkjet image forming apparatus 300, with reference to FIG. 39.

As illustrated in FIG. 39, the inkjet image forming apparatus 300 includes a sheet feeding device 310, a positional deviation correcting device 320, an image forming device 301, a drying device 330, and a sheet output device 340.

The sheet feeding device 310 includes an air separating device 312 that uses air to separate and pick up each sheet P of a sheet bundle that is loaded on the sheet feeding device 310 one by one by air. The sheet P that is picked up by the air separating device 312 is fed to the positional deviation correcting device 320 that is disposed downstream from the sheet feeding device in the sheet conveying direction, to be conveyed toward the image forming device 301.

The sheet P conveyed from the sheet feeding device 310 reaches the positional deviation correcting device 320.

The positional deviation correcting device 320 includes the sheet conveying device 150 in which the pair of sheet conveying rollers 31 and the pair of sheet holding rollers 33 are included. In the positional deviation correcting device 320, the pair of sheet holding rollers 33 performs the correction of angular displacement of the sheet P and the correction of lateral displacement of the sheet P, which is the same operations performed in the image forming apparatus 100 described above.

After the positional deviation of the sheet P is corrected in the positional deviation correcting device 320, the sheet P is conveyed to the image forming device 301 at a predetermined time.

The image forming device 301 includes ink discharging heads 302, a cylindrical drum 303, and sheet grippers 304. When the sheet P after completion of the correction of positional deviation is conveyed to the image forming device 301, the sheet grippers 304 that are mounted on the surface of the cylindrical drum 303 at different positions hold the leading end of the sheet P, so that the sheet P is positioned on the surface of the cylindrical drum 303. Multiple air intake holes are formed in the surface of the cylindrical drum 303. As air is drawn from the back of the sheet P entirely, the sheet P is closely held onto the surface of the cylindrical drum 303. The sheet grippers 304 position the sheet P on the surface of the cylindrical drum 303. The sheet P that has been closely held onto the surface of the cylindrical drum 303 by air is conveyed toward the ink discharging heads 302 as the cylindrical drum 303 rotates in a direction indicated by arrow in FIG. 39.

The image forming device 301 includes the ink discharging heads 302 disposed in order along a circumferential surface of the cylindrical drum 303. Each of the ink discharging heads 302 is housed in a unit filled with ink corresponding to the color of the image. As the sheet P held onto the surface of the cylindrical drum 303 is conveyed below the ink discharging heads 302, respective single color inks are discharged from the ink discharging heads 302 at respective predetermined times. Consequently, a color image is formed on the surface of the sheet P.

The sheet grippers 304 are disposed at three different positions on the circumferential surface of the cylindrical drum 303, so as to grip or clip the leading end of the sheet P. According to this configuration, while the cylindrical drum 303 is rotating for one cycle, image formation is performed on three sheets P.

Then, the sheet P having an image formed by the image forming device 301 is conveyed to the drying device 330.

The drying device 330 includes a drying unit 331. As the sheet P is conveyed below the drying unit 331, water or moisture in the ink of the image formed on the sheet P is evaporated, thereby preventing curling of the sheet P.

After having passed the drying device 330, the sheet P is conveyed to the sheet output device 340, on which the sheets P are stacked and aligned orderly.

The drying device 330 includes a sheet reversing device 351 and a sheet reverse and conveyance device 350.

In a duplex printing mode, after the sheet reversing device 351 reverses the sheet P, the sheet reverse and conveyance device 350 switches the direction of conveyance of the sheet P, so that the sheet P is conveyed to the image forming device 301 again.

Before the sheet P reaches the cylindrical drum 303, the pair of sheet holding rollers 33 performs the correction of angular displacement of the sheet P and the correction of lateral displacement of the sheet P. The sheet P after completion of the corrections of positional deviation is conveyed to the cylindrical drum 303, where the sheet P is gripped by the sheet grippers 304 and is held on the surface of the cylindrical drum 303 with the back face having no image thereon facing up. Then, the ink discharging heads 302 of the image forming device 301 form an image on the back face (with no image formed) of the sheet P that is held on the surface of the cylindrical drum 303.

After passing the drying device 330, the sheet P has respective images on both sides. Then, the sheet P is conveyed to the sheet output device 340, which is the same as in a single-side printing mode, and is stacked and aligned orderly on the sheet output device 340.

In the descriptions above, this disclosure is applied to an electrophotographic image forming apparatus and an inkjet image forming apparatus but is not limited thereto. For example, this disclosure can be applied to a finisher, in other words, a post processing device that performs a stapling operation and a sheet folding operation, to a sheet after completion of image formation.

Post Processing Device.

Figure 40:
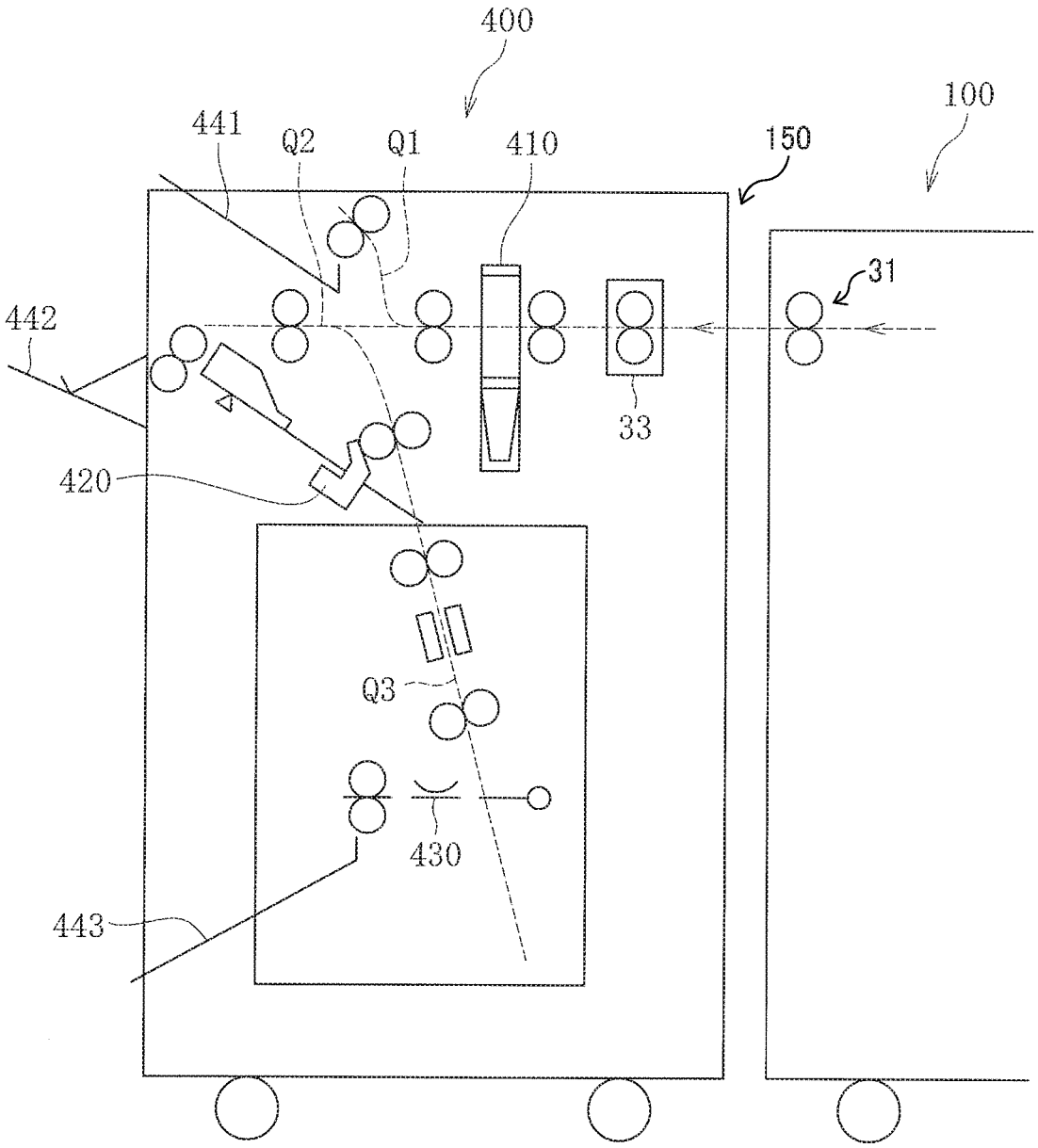
FIG. 40 is a side view illustrating a sheet conveying device according to an embodiment of this disclosure, applied to a post processing device.

Now, a description is given of a post processing device 400 to which this disclosure is applied, with reference to FIG. 40.

FIG. 40 is a side view illustrating the post processing device 400 including the sheet conveying device 150 according to an embodiment of this disclosure.

The post processing device 400 illustrated in FIG. 34 includes a punching device 410, a stapling device 420, a sheet folding device 430 and multiple trays (sheet stackers), which are a first tray 441, a second tray 442 and a third tray 443. The punching device 410 performs a punching process to punch or open holes on a sheet P. The stapling device 420 performs a binding process of a sheet P. The sheet folding device 430 performs a center folding process of a sheet P. The post processing device 400 has three sheet conveyance passages Q1, Q2 and Q3 to perform different post processing operations. After being fed from the image forming apparatus 100, the sheet P is conveyed to a corresponding one of the three sheet conveyance passages Q1, Q2 and Q3.

The first sheet conveyance passage Q1 is a sheet conveyance passage to convey the sheet P to the first tray 441 after the punching device 410 has performed or not performed to the sheet P. The second sheet conveyance passage Q2 is a sheet conveyance passage to convey the sheet to the stapling device 420 where the binding process is performed to the sheet P, and then to the second tray 442. The third sheet conveyance passage Q3 is a sheet conveyance passage to convey the sheet P to the sheet folding device 430 where the center folding process is performed to the sheet P, and then to the third tray 443.

As illustrated in FIG. 40, the sheet P that is fed from the image forming apparatus 100 to the post processing device 400 is conveyed to the sheet conveying device 150 having the pair of sheet holding rollers 33 that is disposed upstream from the punching device 410 in the sheet conveying direction. In the sheet conveying device 150, the pair of sheet holding rollers 33 performs the correction of angular displacement of the sheet P and the correction of lateral displacement of the sheet P, which is the same operation as the pair of sheet holding rollers 33 disposed in the image forming apparatus 100 and the inkjet image forming apparatus 300. Accordingly, the accuracy of the punching process, the binding process and the center folding process performed in the post processing device 400 can be enhanced.

In the above-described embodiments and the variations of this disclosure, each position detector such as the first CIS 145, the second CIS 146, the third CIS 147, the pair of first angular displacement detection sensors 148 and the pair of second angular displacement detection sensors 149 performs detection of the position of the sheet P for two times. However, the number of detection is not limited thereto. For example, the position detector may perform the detection for three or more times. In this case, the pair of sheet holding rollers 33 performs the adjustment and feed operation based on each detection result obtained by each position detection after the second position detection.

In the above-described embodiments and variations of this disclosure, the first position detection of the sheet P performed by the position detectors such as the CISs 145 and 146, the pair of first angular displacement detection sensors 148 and the pair of second angular displacement detection sensors 149 is conveniently referred to as the primary detection. Similarly, the second position detection of the sheet P performed by the position detectors such as the CISs 146 and 147 is conveniently referred to as the secondary detection. However, the primary detection and the secondary detection are not limited to the first position detection and the second position detection, respectively. For example, when the position detectors perform detections of the sheet P for three times in total, the second position detection may be the primary detection and the third position detection may be the secondary detection.

Further, this disclosure can be applied to any sheet conveying device that performs correction of angular displacement of a sheet and correction of lateral displacement of the sheet. For example, this disclosure can be applied to a sheet conveying device that includes the pair of sheet holding rollers 33 functioning as a pair of lateral and angular displacement correction rollers and that a pair of timing rollers is disposed downstream from the pair of sheet holding rollers 33 in the sheet conveying direction.

It is to be noted that this disclosure is applied to the sheet conveying device 150 that conveys a transfer sheet and a paper as the sheet P. However, this disclosure is not limited thereto. For example, this disclosure can also be applied to a sheet conveying device that conveys an original document as the sheet P.

Further, it is to be noted that this disclosure is applied to the sheet conveying device 150 provided to the image forming apparatus 100 that employs electrophotography. However, this disclosure is not limited thereto. For example, this disclosure can also be applied to a sheet conveying device provided to an image forming apparatus that employs an inkjet method or an offset printing machine.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet conveying device comprising:

a pair of sheet holding rollers configured to shift and rotate a sheet;

a detector configured to detect a position of the sheet during conveyance of the sheet in a sheet conveying direction; and a controller configured to shift, rotate, or both shift and rotate the pair of sheet holding rollers in at least one of a width direction and a rotational direction, the detector being configured to perform a primary detection, with the pair of sheet holding rollers being at an initial position, to detect a position of the sheet, before the pair of sheet holding rollers holds the sheet, the controller being configured to perform a first drive of the pair of sheet holding rollers, to shift, rotate, or both shift and rotate the pair of sheet holding rollers from the initial position to a first position, based upon a result of the primary detection, the detector being configured to perform a secondary detection to detect a position of the sheet, the pair of sheet holding rollers being at the first position and contacting the sheet, and the controller being configured to perform a second drive of the pair of sheet holding rollers to shift, rotate, or both shift and rotate the pair of sheet holding rollers from the first position to a second position while contacting the sheet, in a direction different from the first drive of the pair of sheet holding rollers, based upon a result of the secondary detection.

2. The sheet conveying device according to claim 1, wherein the detector includes at least two sensors disposed at an upstream side of the sheet conveying direction from the pair of sheet holding rollers, the at least two sensors being configured to perform both the primary detection and the secondary detection.

3. An image forming apparatus comprising the sheet conveying device according to claim 2.

4. The sheet conveying device according to claim 1, wherein the detector is fixed to a sheet conveyance passage along which the sheet is conveyed in the sheet conveying direction.

5. An image forming apparatus comprising the sheet conveying device according to claim 4.

6. The sheet conveying device according to claim 1, wherein the detector includes a first detector, disposed upstream from the pair of sheet holding rollers in the sheet conveying direction; the sheet conveying device further comprising:

a second detector disposed separate from the first detector, wherein the controller is configured to:

perform the first drive to shift, rotate, or both shift and rotate the pair of sheet holding rollers, based upon the result of the primary detection by the first detector.

7. The sheet conveying device according to claim 6, wherein the second detector is disposed downstream from the pair of sheet holding rollers in the sheet conveying direction.

8. An image forming apparatus comprising the sheet conveying device according to claim 7.

9. An image forming apparatus comprising the sheet conveying device according to claim 6.

10. The sheet conveying device according to claim 1, wherein the position of the sheet detected by the detector includes one of a deviation angle, a lateral displacement amount, and a sum of the deviation angle and the lateral displacement amount.

11. An image forming apparatus comprising the sheet conveying device according to claim 10.

12. An image forming apparatus comprising the sheet conveying device according to claim 1.

13. The sheet conveying device according to claim 1, wherein the detector is configured to perform both the primary detection and the secondary detection at an upstream side of the sheet conveying direction from the pair of sheet holding rollers.

14. A method for a sheet conveying device including a pair of sheet holding rollers configured to shift and rotate a sheet; a detector configured to detect a position of the sheet during conveyance of the sheet in a sheet conveying direction; and a controller configured to shift, rotate, or both shift and rotate the pair of sheet holding rollers in at least one of a width direction and a rotational direction, the method comprising:

performing a primary detection, via the detector and with the pair of sheet holding rollers being at an initial position, to detect a position of the sheet, before the pair of sheet holding rollers holds the sheet;

performing a first drive of the pair of sheet holding rollers, via the controller, to shift, rotate, or both shift and rotate the pair of sheet holding rollers from the initial position to a first position based upon a result of the primary detection;

performing a secondary detection, via the detector, to detect a position of the sheet, the pair of sheet holding rollers being at the first position and contacting the sheet; and performing a second drive of the pair of sheet holding rollers, via the controller, to shift, rotate, or both shift and rotate the pair of sheet holding rollers from the first position to a second position while contacting the sheet, in a direction different from the first drive of the pair of sheet holding rollers, based upon a result of the secondary detection.

15. The method according to claim 14, wherein the detector includes at least two sensors disposed at an upstream side of the sheet conveying direction from the pair of sheet holding rollers, the at least two sensors performing the primary detection and performing the secondary detection.

16. The method according to claim 14, wherein the detector performs both the primary detection and the secondary detection at an upstream side of the sheet conveying direction from the pair of sheet holding rollers.

* * * * *